US005429914A

United States Patent [19]

Kojima et al.

[11] Patent Number: 5,429,914

[45] Date of Patent: Jul. 4, 1995

[54] COMPOSITION HAVING A FIXING ABILITY FOR PHOTOGRAPHY AND METHOD FOR PROCESSING PHOTOGRAPHIC MATERIALS WITH THE SAME

[75] Inventors: Tetsuro Kojima; Nobuo Watanabe, both of Kanagawa, Japan

[73] Assignee: Fuji Photo Film Co., Ltd., Kanagawa, Japan

[21] Appl. No.: 101,789

[22] Filed: Aug. 4, 1993

Related U.S. Application Data

[63] Continuation of Ser. No. 702,574, May 20, 1991, abandoned.

[30] Foreign Application Priority Data

May 21, 1990 [JP] Japan ..... 2-130977

[51] Int. Cl.[6] ..... G03C 5/44; G03C 7/42

[52] U.S. Cl. ..... 430/393; 430/455; 430/459; 430/460

[58] Field of Search ..... 430/393, 400, 455, 456, 430/459, 460

[56] References Cited

U.S. PATENT DOCUMENTS

| | | | |
|---|---|---|---|
| 2,748,000 | 5/1956 | Mader | 430/393 |
| 3,241,966 | 3/1966 | Heilmann et al. | 430/393 |
| 4,144,068 | 3/1979 | Ishibashi et al. | 430/393 |
| 4,446,225 | 5/1984 | Kishimoto et al. | 430/393 |
| 4,500,632 | 2/1985 | Ohmura et al. | 430/393 |
| 4,578,345 | 3/1986 | Ohno et al. | 430/393 |
| 4,707,434 | 11/1987 | Koboshi et al. | 430/393 |
| 4,804,618 | 2/1989 | Ueda et al. | 430/393 |
| 4,845,017 | 7/1989 | Kishimoto et al. | 430/393 |
| 4,908,300 | 3/1990 | Koboshi et al. | 430/393 |
| 5,011,763 | 4/1991 | Morimoto et al. | 430/460 |

*Primary Examiner*—Hoa Van Le

*Attorney, Agent, or Firm*—Sughrue, Mion, Zinn, Macpeak & Seas

[57] ABSTRACT

A composition having a fixing ability for photography which is used as a bath having a fixing ability, for processing an exposed silver halide photographic material comprising a support having thereon at least one light-sensitive silver halide emulsion layer, said compositian being substantially free of thiosulfate ion and comprising as a fixing agent at least one thioether comcompound having at least one group selected from the group consisting of and a heterocyclic group, wherein $M_1$, $M_2$ and $M_3$ may be the same or different, each represents a hydrogen atom or a counter cation; $R_1$ to $R_{19}$, which may be the same or different, each represents a hydrogen atom, an alkyl group, an aryl group, an aralkyl group or an alkenyl group; and $X^{\ominus}$ represents a counter anion.

And a method for processing an exposed silver halide photographic material comprising a support having thereon at least one light-sensitive silver halide emulsion layer, with the steps comprising (a) developing a developing solution, and then (b) processing said material with the above composition having a fixing ability.

6 Claims, No Drawings

COMPOSITION HAVING A FIXING ABILITY FOR PHOTOGRAPHY AND METHOD FOR PROCESSING PHOTOGRAPHIC MATERIALS WITH THE SAME

This is a Continuation of application Ser. No. 07/702,574, filed May 20, 1991, now abandoned.

FIELD OF THE INVENTION

The present invention relates to a method for processing silver halide photographic materials and, more particularly, to a method for processing silver halide photographic materials which ensures excellent fixability and excellent solution stability of a fixing agent-containing bath and a post-bath thereof, even when a replenisher is used in a reduced amount.

BACKGROUND OF THE INVENTION

In general, a photographic processing of silver halide color photographic materials comprises a color developing process and a desilvering process. Silver produced by development is oxidized with a bleaching agent and then dissolved with a fixing agent. As the bleaching agent, ferric ion complex salts (e.g., aminopolycarboxylic acid-Fe(III) complex salts) are commonly used. As the fixing agent, a thiosulfate is employed generally.

On the other hand, a processing step of black-and-white photographic materials comprises a developing process and a removing process of unexposed silver halide. In other words, photographic materials are subjected to fixing after development without bleaching thereby differing from the processing of color photographic materials. Thiosulfates also are used generally as the fixing agent in the processing of black-and-white photographic materials.

In recent years, it is desirable for the processing bath to have a more stable liquid composition in proportion to the reduction in replenishment. In the fixing bath, for example, a sulfite is added as a preservative for preventing oxidation because the thiosulfates usually employed as the fixing agent suffer oxidative deterioration to yield sulfide precipitates. Although an improvement in solution stability is required as further reduction in replenishment is made, the stabilization problem cannot be settled solely by the further addition of sulfites because sulfites also have a solubility problem, or a formation problem of Glauber's salt formed as a precipitate when oxidized and so forth.

Particularly in the photographic processing of silver halide color photographic materials, the bleach-fixing process recently has been carried out using a bleaching agent having higher potential in view of rapidity. Thus, the thiosulfates therein are subject to a more rapid oxidative deterioration.

Accordingly, it is desirable to obtain compounds with a greater capacity in fixability than thiosulfates particularly from the standpoint of increasing the speed of photographic processing. Thus, development of a fixing agent with excellent stability to oxidation and fixability, which can take the place of thiosulfates, has been desired.

However, satisfactory compounds have not been found because compounds which are known as fixing agents other than thiosulfates, namely thiocyanic acid compounds (especially ammonium thiocyanate), thiourea compounds, thioether compounds (e.g., 1,10-dioxa-4,7-dithiadecane) and so on are insufficient in fixability or solubility.

On the other hand, a method for accelerating a bleach-fixing or fixing process by the use of a thioether compound in a bleach-fixing solution or a fixing solution (fixer) is disclosed, e.g., in JP-B-60-24936 (the term "JP-B" as used herein refers to an "examined Japanese patent publication"), JP-A-53-37418 (the term "JP-A" as used herein refers to a "published unexamined Japanese patent application", JP-A-62-129855, JP-A-62-135834, JP-A-62-136651, JP-A-62-136657, JP-A-62-177556, JP-A-54-71634, JP-A-64-21444, JP-A-49-16436, U.S. Pat. Nos. 3,241,966 and 3,716,362, JP-A-2-44355 and so on. However, all of the means adopted therein aimed at stimulating fixation in the presence of thiosulfates. Therefore, such means do not serve one of the purposes of the present invention, that is, heightening solution stability.

U.S. Pat. No 2,748,000 discloses that a thioether compound similar to that of the present invention is used in the bleach-fixing bath as a fixing agent. However, as the similar thioether compound has an insufficient fixing performance and many thermostains (i.e., the stain which is generated under the warm and humid condition) generate after processing, the means does not serve one of the purposes of the present invention.

SUMMARY OF THE INVENTION

Therefore, an object of the present invention is to provide a method for processing silver halide light-sensitive materials which ensures excellent fixability and improved solution stability of a bath containing a fixing agent and of a post-bath thereof and less thermostains after processing, even when replenishers are used in reduced amounts.

The above described object of the present invention is attained by the following means:

(1) A composition having a fixing ability for photography which is used as a bath having a fixing ability, for processing an exposed silver halide photographic material comprising a support having thereon at least one light-sensitive silver halide emulsion layer, said composition being substantially free of thiosulfate ion and comprising as a fixing agent at least one thioether compound having at least one group selected from the group consisting of

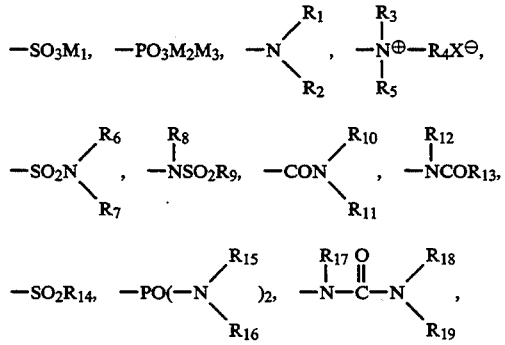

and a heterocyclic group, wherein $M_1$, $M_2$ and $M_3$ may be the same or different, each represents a hydrogen atom or a counter cation; $R_1$ to $R_{19}$, which may be the same or different, each represents a hydrogen atom, an alkyl group, an aryl group, an aralkyl group or an alkenyl group; and $X^{\ominus}$ represents a counter anion.

(2) A method for processing an exposed silver halide phgtographic material comprising a support having thereon at least one light-sensitive silver halide emulsion layer, with the step comprising (a) developing a developing solution, and then (b) processing said material with a composition having a fixing ability, said composition being substantially free of thiosulfate ion and comprising as a fixing agent at least one thioether compound having at least one group selected from the group consisting of

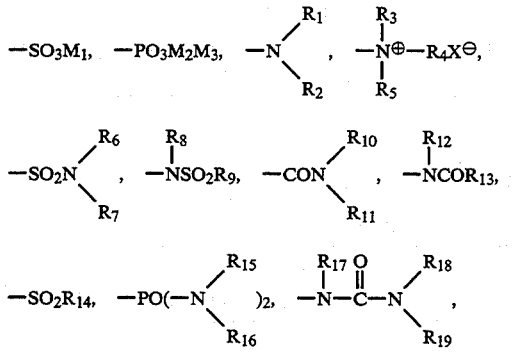

and a heterocyclic group, wherein $M_1$, $M_2$ and $M_3$ may be the same or different, each represents a hydrogen atom or a counter cation; $R_1$ to $R_{19}$, which may be the same or different, each represents a hydrogen atom, an alkyl group, an aryl group, an aralkyl group or an alkenyl group; and $X^{\ominus}$ represents a counter anion.

DETAILED DESCRIPTION OF THE INVENTION

Among the thioether compounds of the present invention, those represented by formula (I) are preferred over others:

$$L_1—(A—L_2)_n—B—L_3 \quad (I)$$

wherein $L_1$ and $L_3$ may be the same or different, each represents an alkyl group, an aryl group, an aralkyl group, an alkenyl group or a heterocyclic group; $L_2$ represents an alkylene group, an arylene group, an aralkylene group, a heterocyclic linkage group or a linkage group formed by combining two or more of the above cited groups; A and B may be the same or different, each represents

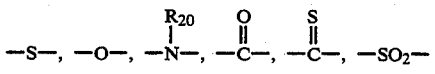

or a linkage group formed by combining two or more of these groups; n represents an integer of from 1 to 10; provided that at least one of $L_1$ and $L_3$ is substituted by

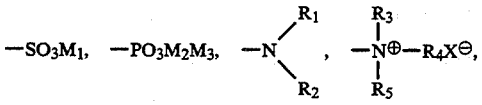

-continued

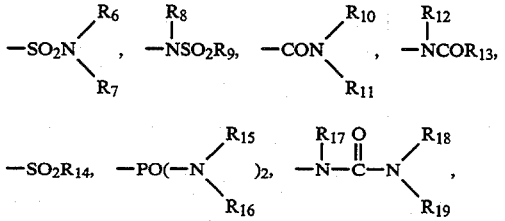

or a heterocyclic group, wherein $M_1$, $M_2$ and $M_3$ may be the same or different, each represents a hydrogen atom or a counter cation; $R_1$ to $R_{20}$ may be the same or different, each represents a hydrogen atom, an alkyl group, an aryl group, an aralkyl group or an alkenyl group; $X^{\ominus}$ represents a counter anion; and at least one of A and B is —S—.

The thioether compounds which are used in the present invention represented by the formula (I) are illustrated below in more detail.

$L_1$ and $L_3$ each represents a substituted or unsubstituted alkyl group having 1 to 10 carbon atoms (e.g., methyl, ethyl, propyl, hexyl, isopropyl and carboxyethyl), a substituted or unsubstituted aryl group having 6 to 12 carbon atoms (e.g., phenyl, 4-methylphenyl and 3-methoxyphenyl), a substituted or unsubstituted aralkyl group having 7 to 12 carbon atoms (e.g., benzyl and phenetyl), a substituted or unsubstituted alkenyl group having 2 to 10 carbon atoms (e.g., vinyl, propenyl and 1-methylvinyl) or a substituted or unsubstituted heterocyclic group having 1 to 10 carbon atoms (e.g., pyridyl, furyl, thienyl and imidazolyl). $L_2$ represents a substituted or unsubstituted alkylene group having 1 to 10 carbon atoms (e.g., methylene, ethylene, trimethylene, tetramethylene, pentamethylene, hexamethylene, 1-methylethylene and 1-hydroxytrimethylene), a substituted or unsubstituted arylene group having 6 to 12 carbon atoms (e.g., phenylene and naphthylene), a substituted or unsubstituted aralkylene group having 7 to 12 carbon atoms (e.g., 1,2-xylylene), a substituted or unsubstituted heterocyclic linkage group having 1 to 10 carbon atoms

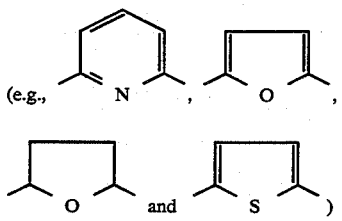

or a linkage group formed by combining two or more of the above cited groups

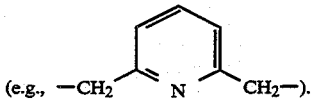

A and B each represents

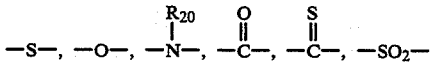

or an arbitrary combination of two or more thereof, with specific examples including

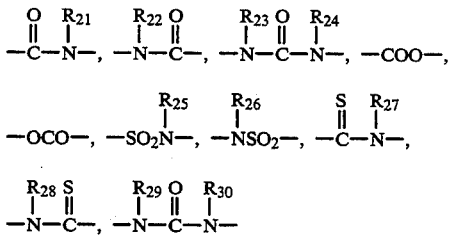

and so on.

n represents an integer from 1 to 10.

Therein, however, at least one of $L_1$ and $L_3$ must be substituted by $—SO_3M_1$, $—PO_3M_2M_3$, $—NR_1R_2$ (which may take the form of a salt, such as hydrochloride, acetate, etc., and, for example, includes unsubstituted amino, methylamino, dimethylamino, N-methyl-N-hydroxyethylamino, N-ethyl-N-carboxyethylamino and like groups),

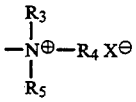

( e.g., trimethylammoniochloride),

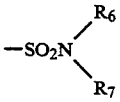

(e.g., unsubstituted sulfamoyl and dimethylsulfamoyl),

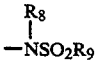

(e.g., methanesulfonamide and benzenesulfonamide),

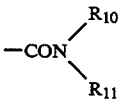

(e.g., unsubstituted carbamoyl, N-methylcarbamoyl and N,N-bis(hydroxyethyl)carbamoyl),

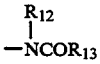

(e.g., formamide, acetamide and 4-methylbenzoylamino), $—SO_2R_{14}$ (e.g., methanesulfonyl and 4-chlorophenylsulfonyl),

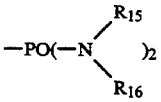

(e.g., unsubstituted phosphonamide and tetramethylphosphonamide),

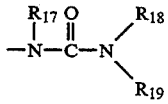

(e.g., unsubstituted ureido and N,N-dimethylureido), or a heterocyclic group (e.g., pyridyl, imidazolyl, thienyl and tetrahydrofuranyl).

In the above cited groups, $M_1$, $M_2$ and $M_3$ each represents a hydrogen atom or a counter cation (e.g., an alkali metal ion such as $Na^+$, $K^+$, etc., an alkaline earth metal ion such as $Mg^{2+}$, $Ca^{2+}$, etc., and an mmonium ion such as ammonium, triethylammonium, etc.); $R_1$ to $R_{30}$ which may be the same or different, each represents a hydrogen atom, a substituted or unsubstituted alkyl group having 1 to 10 carbon atoms (e.g., methyl, ethyl, propyl, hexyl and isopropyl), a substituted or unsubstituted aryl group having 6 to 12 carbon atoms (e.g., phenyl, 4-methylphenyl and 3-methoxyphenyl), a substituted or unsubstituted aralkyl group having 7 to 12 carbon atoms (e.g., benzyl and phenetyl) or a substituted or unsubstituted alkenyl group having 2 to 10 carbon atoms (e.g., vinyl, propenyl and 1-methylvinyl); and $X^\ominus$ represents a counter anion (e.g., halogen ion such as $Cl^-$, $Br^-$, etc., nitrate ion, sulfate ion, acetic acid ion and p-toluenesulfonic acid ion).

Each of the above described groups $L_1$, $L_2$, $L_3$ and $R_1$ to $R_{30}$ may be substituted, e.g., by a lower alkyl graup having 1 to 4 carbon atoms (e.g., methyl and ethyl), an aryl group having 6 to 10 carbon atoms (e.g., phenyl and 4-methylphenyl), an aralkyl group having 7 to 10 carbon atoms (e.g., benzyl), an alkenyl group having 2 to 4 carbon atoms (e.g., propenyl), an alkoxy group having 1 to 4 carbon atoms (e.g., methoxy and ethoxy), a halogen atom (e.g., chlorine and bromine), a cyano group, a nitro group, a carboxyl group (which may have a salt form) or a hydroxyl group.

When n represents 2 or more, the $(A\text{-}L_2)$'s may be the same or different from one another.

Additionally, at least one of A and B represents —S—.

The thioether compounds of the formula (I) produce more desirable effects when at least one of $L_1$ and $L_3$ is an alkyl group having 1 to 6 carbon atoms substituted by $—SO_3M_1$, $—PO_3M_2M_3$, $—NR_1R_2$,

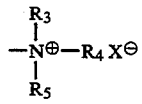

or a heterocyclic group, $L_2$ is an alkylene group having 1 to 6 carbon atoms, A and B each is —S—, —O—, or

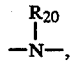

$R_1$, $R_2$, $R_3$, $R_4$, $R_5$ and $R_{20}$ each is a hydrogen atom or an alkyl group having 1 to 6 carbon atoms, and n is an integer of from 1 to 6.

Among the desirable compounds, the cases wherein $L_1$ and $L_3$ each is an alkyl group having 1 to 4 carbon atoms substituted by $—SO_3M_1$ or $—PO_3M_2M_3$, A and B are both —S— and n is an integer of from 1 to 3 are preferred over others.

Specific examples of the compounds of the present invention are illustrated below. However, the present invention should not be construed as being limited to the exemplified compounds:

1. $NaO_3S(CH_2)_2S(CH_2)_2S(CH_2)_2SO_3Na$

2. $NaO_3S(CH_2)_2(SCH_2CH_2)_2S(CH_2)_2SO_3Na$

3. $NaO_3S(CH_2)_2(SCH_2CH_2)_3S(CH_2)_2SO_3Na$

4. $NaO_3S(CH_2)_2(SCH_2CH_2)_4S(CH_2)_2SO_3Na$

5. $NaO_3S(CH_2)_3S(CH_2)_2S(CH_2)_3SO_3Na$

6. $NaO_3S(CH_2)_3(SCH_2CH_2)_2-S(CH_2)_3SO_3Na$

7. $NaO_3S(CH_2)_3(SCH_2CH_2)_3-S(CH_2)_3SO_3Na$

8. $KO_3S(CH_2)_4S(CH_2)_2S(CH_2)_4SO_3K$

9. $H_4NO_3S(CH_2)_4(SCH_2CH_2)_2S(CH_2)_4SO_3NH_4$

10. $H_4NO_3S(CH_2)_2(SCH_2CH_2)_2S(CH_2)_2SO_3NH_4$

11. $NaO_3S(CH_2)_3S(CH_2)_3S(CH_2)_3SO_3Na$

12. $NaO_3S(CH_2)_2S(CH_2)_4S(CH_2)_3SO_3Na$

13. $KO_3S(CH_2)_2S(CH_2)_5S(CH_2)_2SO_3K$

14. $NaO_3S(CH_2)_3S(CH_2)_2O(CH_2)_2S(CH_2)_3SO_3Na$

15. $NaO_3S(CH_2)_2S(CH_2)_2\overset{CH_3}{\overset{|}{N}}(CH_2)_2S(CH_2)_2SO_3Na$ 16. $KO_3S(CH_2)_2S(CH_2)_2\underset{\underset{(CH_2)_2SO_3K}{|}}{N}(CH_2)_2S(CH_2)_2SO_3K$ 17. $NaO_3S(CH_2)_3S(CH_2)_2CONH(CH_2)_2NHCO(CH_2)_2S(CH_2)_3SO_3Na$ 18. $NaO_3S(CH_2)_2SCH_2SCH_2S(CH_2)_2SO_3Na$ 19. 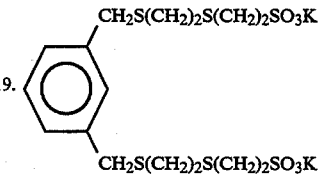

20. 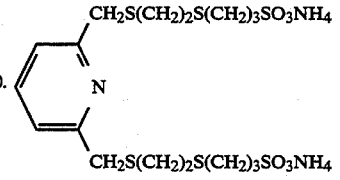

21. 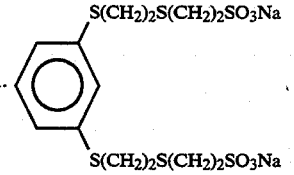

22. $Na_2O_3P(CH_2)_2S(CH_2)_2S(CH_2)_2PO_3Na_2$

23. $Na_2O_3P(CH_2)_2(SCH_2CH_2)_2S(CH_2)_2PO_3Na_2$

24. $Na_2O_3P(CH_2)_3(SCH_2CH_2)_3S(CH_2)_3PO_3Na_2$

-continued

25. $H_2O_3P(CH_2)_2S(CH_2)_2S(CH_2)_2PO_3H_2$

26. 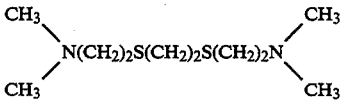

27. $(CH_3)_3\overset{\oplus}{N}(CH_2)_2S(CH_2)_2S(CH_2)_2\overset{\oplus}{N}(CH_3)_3$ $2\,Cl^{\ominus}$ 28. 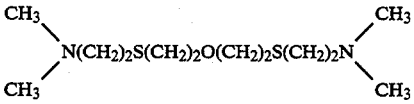

29. 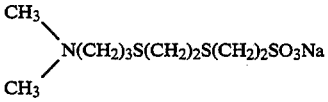

30. $(CH_3)_3\overset{\oplus}{N}(CH_2)_2S(CH_2)_2S(CH_2)_2SO_3Na$

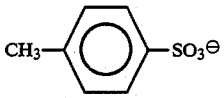

31. $H_2N(CH_2)_2S(CH_2)_2S(CH_2)_2NH_2$

32. $NaO_3S(CH_2)_2(SCH_2CH_2)_6S(CH_2)_2SO_3Na$

33. $H_2NO_2S(CH_2)_2S(CH_2)_2S(CH_2)_2SO_2NH_2$

34. $CH_3SO_2\underset{\underset{CH_3}{|}}{N}(CH_2)_2NH(CH_2)_2S(CH_2)_2CONH_2$

35. $CH_3CONH(CH_2)_3S(CH_2)_2S(CH_2)_3NHCOCH_3$

36. $CH_3SO_2(CH_2)_3S(CH_2)_3S(CH_2)_2SO_3Na$

37. $(H_2N)_2PO(CH_2)_2S(CH_2)_2S(CH_2)_2S(CH_2)_2PO(NH_2)_2$

38. $H_2N\overset{\overset{O}{\|}}{C}NH(CH_2)_2S(CH_2)_2O(CH_2)_2S(CH_2)_2SO_3Na$ 39. 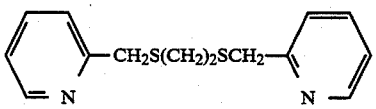

40. 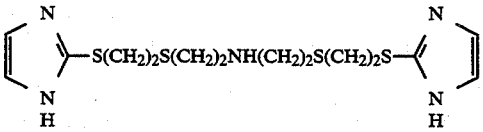

41. $LiO_3S-\overset{CH_3}{\overset{|}{C}}HCH_2CH_2S(CH_2)_2SCH_2CH_2\overset{CH_3}{\overset{|}{C}}HSO_3Li$ The compounds represented by formula (I) of the present invention can be prepared with ease by reference to methods as described, e.g., in *J. Org. Chem.*, 30, 2867 (1965); ibid., 27, 2846 (1962); *J. Am. Chem. Soc.*, 69, 2330 (1947); and so on.

Now, syntheses of the compounds of the present invention are described below, instancing concrete examples.

SYNTHESIS EXAMPLE 1

Synthesis of Compound 5:

400 ml of methyl alcohol to which 25.3 g of ethanedithiol had been added was kept at a temperature of 10° C. or lower as a stream of nitrogen gas was passed therethrough. Thereto, 121 ml of a 28 wt % methyl alcohol solution of sodium methoxide was added dropwise. Thereafter, the temperature of the reaction system was raised to room temperature and 72.1 g of propanesultone was further added dropwise.

After the reaction was carried out for 3 hours at room temperature, the crystalline precipitates were filtered off and recrystallized from 500 ml of a water-methyl alcohol (1:3 by volume) mixture. Thus, 75.9 g of the desired product was obtained in a 74.1% yield. The melting point of the product was 300° C. or higher.

SYNTHESIS EXAMPLE 2

Synthesis of Compound 6:

100 ml of methyl alcohol to which 15.4 g of trithiaheptane had been added was kept at a temperature of 10° C. or lower as a stream of nitrogen gas was passed therethrough. Thereto, 45.1 ml of a 28 wt % methyl alcohol solution of sodium methoxide was added dropwise. Thereafter, the temperature of the reaction system was raised to room temperature and 24.4 g of propanesultone was further added dropwise.

After the reaction was carried out for 2 hours at room temperature, the crystalline precipitates were filtered off and recrystallized from 500 ml of a water-methyl alcohol (1:4 by volume) mixture. Thus, 30.1 g of the desired product was obtained in a 68.1% yield. The melting point of the product was 300° C. or higher.

Examples of a bath having a fixing ability into which the compounds represented by formula (I) of the present invention can be introduced include a fixing bath and a bleach-fixing bath. In addition to the baths, an accelerating bath, a stopping bath, a washing bath, a stabilizing bath or so on may be used.

Examples of a process of the photographic processing applicable to the present invention are illustrated below. Therein, the compounds of the present invention are contained preferably in processing solutions used in the steps. However, the present invention should not be construed as being limited to the examples.

1) (color) development-desilvering-washing
2) (color) development-desilvering-stabilization
3) (color) development-desilvering-washing-stabilization
4) black-and-white development-washing-reversal-color development-washing-desilvering-washing-stabilization Therein, the desilvering step may be any of (a) bleach-fixing, (b) bleaching-bleach-fixing, (c) bleaching-fixing, (d) bleaching-bleach-fixing-fixing, (e) fixing and so on. In addition, a rinsing step may be sandwiched in between the (color) development and the desilvering steps.

Additionally, the compounds of the present invention, although such can be used in all of the steps in each process, may be used in only one bracketed step.

The expression "containing substantially no other fixing agent (i.e., a thiosulfate ion)" signifies that a concentration of other fixing agents is 0.05 mol/liter or less, preferably 0.01 mol/liter or less. It was quite unexpected that the compounds of the present invention were able to function effectively as a fixing agent under the condition that any other fixing agent was not contained in a substantial sense.

An appropriate amount of the compounds of the present invention used in a fixing bath or a bleach-fixing bath is in the range of $1\times10^{-5}$ to 10 mol/liter and preferably $1\times10^{-3}$ to 3 mol/liter.

More specifically, when a halide composition of the silver halide emulsion in a light-sensitive material to be processed is bromoiodide having an iodide content of 1 mol % or more, it is preferable that the compounds of the present invention be used in a concentration of from 0.5 to 2 mol/liter. On the other hand, when the halide composition is bromide, chlorobromide or halides having a high chloride content (not lower than 80 mol %), concentrations ranging from 0.1 to 1 mol/liter are preferred. The compounds of the present invention may be added directly to the tank solution, or fed thereto in a condition that they are contained in a replenisher. Also, they may be brought thereinto from the prebath.

As photographic processing has advanced in reduction of replenishment in recent years, it is desirable that every processing bath have heightened solution stability. The problem concerning the stabilities of a fixing bath (or a bleach-fixing bath) and a washing bath as the postbath thereof consists in precipitation of sulfides caused by oxidative deterioration of thiosulfates used as a fixing agent. The reason for the presence of such a problem in the washing bath also is that a fixing solution (or a bleach-fix solution) is brought into the washing bath upon processing. Although sulfites are used usually as an antioxidant to prevent the generation of such precipitates, the problem in the case of reduced replenishment can no longer be solved by increasing sulfites alone because sulfites have a problem in solubility and generate precipitates of Glauber's salt through oxidation.

As a result of examining various compounds to take the place of thiosulfates for the purpose of finding a fixing agent excellent in stability to oxidation, it has been found that thioether compounds have an ability to fix and generate no precipitate even in the case of reduced replenishment because of high stability.

Although it is desirable to use a bleaching agent of high oxidizing power in a bleach-fixing bath from the standpoint of expediting photographic processing, there is a limit to the oxidizing power the bleaching agent may have when thiosulfates are used as a fixing agent because the oxidizing ability of the bleaching agents leads to the tendency of thiosulfate deterioration. However, the thioether compounds of the present invention are stable in the combined use with a bleaching agent of high oxidizing power so thioethers can cope with the more rapid methods of photographic processing now used and under development.

The silver halide color photographic materials which can be used are described below in detail.

A silver halide color photographic material usable in the present invention comprises a support having thereon at least one blue-sensitive, green-sensitive or red-sensitive silver halide emulsion layer. The silver halide emulsion layers and other light-insensitive layers do not have any particular restrictions as to the number of constituent layers and their arrangement. A typical silver halide color photographic material is a silver halide photographic material having on a support at least one light-sensitive layer comprising two or more of silver halide emulsion layers which have substantially the same color sensitivity but which differ in photographic speed. Said light-sensitive layer is a unit light-sensitive layer with color sensitivity to any of blue light, green light and red light. As for the arrangement of the unit light-sensitive layers in a multilayer silver halide color photographic material, it is general to arrange a support, a red-sensitive layer, a green-sensitive layer and a blue-sensitive layer, in that order. However, such an order as cited above may be reversed, if desired. Also, it is possible to take an arrangement that constituent layers having the same color sensitivity hold a light-sensitive layer differing in color sensitivity therebetween.

Moreover, light-insensitive layers including various kinds of interlayers may be provided between silver halide light-sensitive layers, and at the topmost and the lowest positions.

In such interlayers, couplers and DIR compounds and conventionally used color stain inhibitors may be incorporated.

Plural silver halide emulsion layers which constitute each of the unit light-sensitive layers can assume preferably a two-layer structure consisting of a high-speed emulsion layer and a slow-speed emulsion layer, as disclosed in West German Patent 1,121,470 or British Patent 923,045. In general, it is preferred to arrange the constituent layers of a unit light-sensitive layer so that the photographic speed may decrease in the direction of the support. Also, a light-insensitive layer may be provided between constituent layers of each unit light-sensitive layer. On the other hand, it is also possible to dispose a slow-speed emulsion layer on the side far from the support and to dispose a high-speed emulsion layer on the side near to the support, as disclosed, e.g., in JP-A-57-112751, JP-A-62-200350, JP-A-62-206541 and JP-A-62-206543.

More specifically, a slow-speed blue-sensitive layer (BL), a high-speed blue-sensitive layer (BH), a high-speed green-sensitive layer (GH), a slow-speed green-sensitive layer (GL), a high-speed red-sensitive layer (RH) and a slow-speed red-sensitive layer (RL) can be arranged in that order from the farthest side of the support. Also, the arrangement of BH/BL/GL/GH/RH/RL/support, BH/BL/GH/GL/RL/RH/support and so on are adoptable.

In addition, an arrangement of blue-sensitive layer/GH/RH/GL/RL/support as disclosed in JP-B-55-34932 and an arrangement of blue-sensitive layer/GL/RL/GH/RH/support as disclosed in JP-A-56-25738 and JP-A-62-63936 can be adopted.

As for the arrangement of three layers differing in photographic speed, as disclosed in JP-B-49-15495, it is possible to arrange the layers so that the photographic speed may be decreased in the direction of the support, that is, to dispose a silver halide emulsion layer of the highest speed as an upper layer, a silver halide emulsion layer having a speed lower than that of the upper layer as an intermediate layer, and a silver halide emulsion layer having a speed lower than that of the intermediate layer as the lowest layer. In the similar case, wherein the unit light-sensitive layer takes a three-layer structure, a medium-speed emulsion layer, a high-speed emulsion layer and a low-speed emulsion layer may be arranged in that order from the far side of the support, as disclosed in JP-A-59-202464.

As described above, the optimal layer structure and arrangements can be chosen from various combinations depending on the end use purpose of the photographic material.

When the silver halide color photographic material of the present invention is used as color negative or color reversal film, silver halide contained in photographic emulsion layers is preferably silver iodobromide, iodochloride or iodochlorobromide having an iodide content of about 30 mol % or less. Particularly preferred silver halide therein is silver iodobromide or iodochlorobromide having an iodide content of from about 2 mol % to about 25 mol %.

When the silver halide color photographic material is color photographic paper, substantially iodide-free silver chlorobromide or chloride is preferred as silver halide contained in its photographic emulsion layers. The term "substantially iodide-free" as used herein is intended to permit an iodide cantent of 1 mol % or less, preferably 0.2 mol % or less. As for the halide composition of such a silver chlorobromide emulsion, bromide and chloride may be present in the emulsion in any ratio. Although the bromide/chloride ratio can be changed variously depending on the purpose, chloride contents of not less than 2 mol % are preferred. In the photographic materials suitable for rapid processing, silver halide emulsions having a high chloride content, that is to say, high chloride content emulsions, are used to advantage. A chloride content in the high chloride content emulsions is preferably 90 mol % or more, more preferably 95 mol % or more. For the purpose of reducing the amount of a replenisher in the development processing, emulsions comprising nearly pure silver chloride, or those having a chloride content of from 98 to 99.9 mol %, can be used desirably.

Silver halide grains in the photographic emulsions may be those having a regular crystal form, such as that of a cube, an octahedron, a tetradecahedron, etc., those having an irregular crystal form, such as that of a sphere, a tabular, etc., those having crystal defects, such as twinned plane or those having a composite form of two or more of the above cited forms.

Silver halide photographic emulsions usable in the present invention can be prepared using known methods described, e.g., in *Research Disclosure* (abbreviated as RD, hereinafter), Vol. 176, No. 17643, pp. 22 and 23, entitled "1. Emulsion Preparation and Types", (December, 1978); and ibid., Vol. 187, No. 18716, p. 648 (November, 1979); and so on.

Monodispersed emulsions disclosed, e.g., in U.S. Pat. Nos. 3,574,628 and 3,655,394, and British Patent 1,413,748 are also used to advantage.

Also, tabular grains with an aspect ratio of at least 5 can be used in the present invention. Such tabular grains can be prepared with ease in accordance with methods as described, e.g., in Gutoff, *Photographic Science and Engineering*, Vol. 14, pp. 248 to 257 (1970), U.S. Pat. Nos. 4,434,226, 4,414,310, 4,433,048 and 4,439,520, British Patent 2,112,157 and so on.

The crystal structure of the grains may be uniform throughout, the interior and the surface of the grains may differ in halide composition or the grains may assume a layer structure. Further, silver halide grains in which crystal surfaces differing in halide composition are fused together through epitaxial growth or emulsion grains in which silver halide grains are fused together with a salt other than silver halide, such as silver thiocyanate, lead oxide or the like may be used.

A mixture of grains with various crystal forms may be used.

Silver halide emulsions which have undergone physical ripening, chemical sensitization and spectral sensitization treatments generally are used. In a process of allowing the produced silver halide grains to ripen physically, various polyvalent metal ion impurities (e.g., salts or complex salts of cadmium, zinc, lead, copper, thallium, iron, ruthenium, rhodium, palladium, osmium, iridium, platinum, etc.) may be introduced. As for the compounds used for chemical sensitization, those disclosed in JP-A-62-215272, from page 18 (right lower column) to page 22 (right upper column), can be given as examples. Additives used in the steps are described in RD Nos. 17643 and 18716, and pages on which they are described are summarized in the following table. In addition, other known photographic additives usable in the present invention are described in the above cited literature and set forth together in the following table.

| Additives | RD 17643 | RD 18716 |
|---|---|---|
| 1. Chemical Sensitizers | Page 23 | Page 648, right column |
| 2. Sensitivity Increasing Agents | — | " |
| 3. Spectral Sensitizers and Supersensitizers | Pages 23–24 | Page 648, right column to page 649, right column |
| 4. Brightening Agents | Page 24 | — |
| 5. Antifoggants and Stabilizers | Pages 24–25 | Page 649, right column |
| 6. Light Absorbents, Filter Dyes and Ultraviolet Absorbents | Pages 25–26 | Page 649, right column to page 650, left column |
| 7. Stain Inhibitors | Page 25, right column | Page 650, left to right columns |
| 8. Dye Image Stabilizers | Page 25 | — |
| 9. Brightening Agents | Page 26 | Page 651, left column |
| 10. Binders | Page 26 | " |
| 11. Plasticizers and Lubricants | Page 27 | Page 650, right column |
| 12. Coating Aids and Surface Active Agents | Pages 26–27 | " |
| 13. Antistatic Agents | Page 27 | " |

In order to prevent photographic properties from deteriorating due to formaldehyde gas, it is desirable in the present invention that a compound capable of fixing formaldehyde gas through the reaction therewith, as disclosed in U.S. Pat. Nos. 4,411,987 and 4,435,503, be incorporated in the photographic material.

Various kinds of color couplers can be used in the present invention also, and specific examples thereof are disclosed in the patents cited in the foregoing RD 17643 (Items VII-C to VII-G).

As the yellow couplers, those disclosed, e.g., in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and EP 0249473A are preferred.

As the magenta couplers, 5-pyrazolone compaunds and pyrazoloazole compounds are preferred. In particular, those disclosed in U.S. Pat. Nos. 4,310,619 and 4,351,897, European Patent 73,636, U.S. Pat. Nos. 3,061,432 and 3,725 064 RD 24220 (June, 1984), JP-A-60 33552, RD 24230 (June, 1984), JP-A-60-43659, JP-A-61-72238, JP-A-60-35730, JP-A-55-118034, JP-A-60-185951, U.S. Pat. Nos. 4,500,630, 4,540,654 and 4,556,630, WO (PCT) 88/04793 can be used to advantage.

Cyan couplers which can be used preferably include those of phenol and naphthol types, as disclosed, e.g., in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, EP 0121365A, EP 0249453A, U.S. Pat. Nos. 3,446,622, 4,333,999, 4,753,871, 4,451,559, 4,427,767, 4,690,889, 4,254,212 and 4,296,199 and JP-A-61-42658.

As the colored couplers for compensating for unnecessary absorptions the formed colors have, those disclosed, e.g., in RD 17643 (Item VII-G), U.S. Pat. No. 4,163,670, JP-B-57-39413, U.S. Pat. Nos. 4,004,929 and 4,138,258, and British Patent 1,146,368 are preferred. In addition, it is desirable to use the couplers capable of compensating for unnecessary absorptions of the formed colors by fluorescent dyes released upon coupling reaction, which are disclosed in U.S. Pat. No. 4,774,181; and the couplers having as a releasing group a dye precursor moiety capable of forming a dye by the reaction with a color developing agent, which are disclosed in U.S. Pat. No 4,777,120.

As the couplers which can form dyes of moderate diffusibility, those disclosed in U.S. Pat. No. 4,366,237, British Patent 2,125,570, European Patent 96,570, West German Patent Application (OLS) No. 3,234,533 are preferred.

Typical examples of polymerized couplers are disclosed, e.g., in U.S. Pat. Nos. 3,451,820, 4,080,211, 4,367,282, 4,409,320 and 4,576,910, and British Patent 2,102,173.

Also, couplers capable of releasing a photographically useful group in proportion to the progress of the coupling reaction can be used to advantage in the present invention. As preferred examples of couplers capable of releasing a development inhibitor, that is to say, DIR couplers, mention may be made of those disclosed in the patents cited in RD 17643 (Item VII-F), JP-A-57-151944, JP-A-57-154234, JP-A-60-184248 and JP-A-63-37346, and U.S. Pat. Nos. 4,248,962 and 4,782,012. On the other hand, preferred examples of couplers capable of releasing imagewise a nucleating agent or a development accelerator upon development are disclosed in British Patents 2,097,140 and 2,131,188, JP-A-59-157638 and JP-A-59-170840.

Other couplers which can be used in the present invention include competing couplers as disclosed in U.S. Pat. No. 4,130,427, multiequivalent couplers as disclosed in U.S. Pat. Nos. 4,283,472, 4,338,393 and 4,310,618, DIR redox compound-releasing couplers, DIR coupler-releasing couplers, DIR coupler-releasing redox compounds or DIR redox compound-releasing redox compounds as disclosed in JP-A-60-185950 and JP-A-62-24252, couplers capable of releasing a dye which can recover its color after elimination as disclosed in EP 0173302A, bleaching accelerator-releasing couplers as described in RD 11449, RD 24241 and JP-A-61-201247, ligand-releasing couplers as disclosed in U.S. Pat. No. 4,553,477, leuco dye-releasing couplers as disclosed in JP-A-63-75747, fluorescent dye-releasing couplers as disclosed in U.S. Pat. No. 4,774,181 and so on.

Those couplers can be introduced into the photographic materials using various known dispersion methods.

Examples of high boiling point solvents which can be used in the oil-in-water dispersion method are described, e.g., in U.S. Pat. No. 2,322,027. More specifically, high boiling point organic solvents having a boiling point of 175° C. or higher under ordinary pressure which can be used in the oil-in-water dispersion method include phthalic acid esters (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate and bis(1,1-diethylpropyl)phthalate), phosphoric or phosphonic acid esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate and di-2-ethylhexylphenyl phosphonate), benzoic acid esters (e.g., 2-ethylhexylbenzoate, dodecylbenzoate and 2-ethylhexyl-p-hydroxybenzoate), amides (e.g., N,N-diethyldodecanamide, N,N-diethyllaurylamide and N-tetradecylpyrrolidone), alcohols or phenols (e.g., isostearyl alcohol and 2,4-di-tert-amylphenol), aliphatic carboxylic acid esters (e.g., bis(2-ethylhexyl)sebacate, dioctylazelate, glycerol tributyrate, isostearyl lactate and trioctyl citrate), aniline derivatives (e.g., N,N-dibutyl-2-butoxy-5-tert-octylaniline), hydrocarbons (e.g., paraffin, dodecylbenzene and diisopropylnaphthalene) and so on. In addition, organic solvents having a boiling point of about 30° C. or more, preferably from about 50° C. to about 160° C. can be used as an auxiliary solvent, with typical examples including ethyl acetate, butyl acetate, ethyl propionate, methyl ethyl ketone, cyclohexanone, 2-ethoxyethyl acetate, dimethylformamide and so on.

The latex dispersion method, processes and effects thereof, and latexes used as impregnant are described specifically in U.S. Pat. No. 4,199,363, West German Patent Application (OLS) Nos. 2,541,274 and 2,541,230 and so on.

Also, those couplers can be dispersed in such a manner that firstly a loadable latex polymer (e.g., those disclosed in U.S. Pat. No. 4,203,716) is impregnated there-with in the presence or absence of a high boiling point organic solvent as cited above or are dissolved in a water-insoluble but organic solvent-soluble polymer and then are dispersed into a hydrophilic colloid solution in the form of emulsion.

It is desirable to use homo- or copolymers disclosed in WO 88/0072 (pages 12–30) as such a latex polymer. In particular, acrylamide polymers are preferred in respect of stabilization of color images and so on.

The present invention can be applied to various kinds of color photosensitive materials. Typical examples thereof include color negative films for amateur use or motion picture use, color reversal films for slide or television, color papers, direct positive color photosensitive materials, color positive films and color reversal papers.

Supports which can be used properly in the present invention are described, e.g., in RD 17643 (page 28), and RD 18716 (from the right column on page 647 to the left column on page 648).

In the photosensitive materials of the present invention, it is desirable that a total thickness of all of the hydrophilic colloid layers present on the side of their emulsion layers should be generally 25 μm or less, preferably 20 μm or less, and a film swelling speed $T_{\frac{1}{2}}$ is generally 30 seconds or less (preferably 15 seconds or less). The term film thickness refers to the film thickness measured after 2 days standing under an atmosphere of 25° C.–55% RH, and the film swelling speed $T_{\frac{1}{2}}$ can be determined by techniques well known in the art. For example, the measurement can be effected by the use of a swellometer of the type described in A. Green et al., *Photogr. Sci. Eng.*, Vol. 19, No. 2, pp. 124 to 129 and $T_{\frac{1}{2}}$ is defined as the time required to reach one-half the saturated film thickness which is taken as 90% of the maximum swollen film thickness attained when the film is processed with a color developer at 30° C. for 3 minutes and 15 seconds.

The film swelling speed $T_{\frac{1}{2}}$ can be adjusted to a proper value by adding a hardener to gelatin as a binder, or by changing the condition of preservation after coating. The degree of swelling is preferably from 150 to 400%. The degree of swelling can be calculated from the maximum swollen film thickness determined under the above described condition, according to the following equation:

$$\frac{(\text{maximum swollen film thickness} - \text{film thickness})}{\text{film thickness}}$$

The above cited color photographic materials can be development processed using general methods as described in RD 17643 (pp. 28–29) and RD 18716 (p. 615, from left to right columns).

The color developing solution to be used for the development processing of the photosensitive materials is preferably an alkaline aqueous solution containing as a main component an aromatic primary amine-type calor developing agent. Those preferred as such a color developing agent are p-phenylenediamine compounds, though aminophenol compounds are also useful. Typical representatives of p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline and 3-methyl-4-amino-N-ethyl-N-β-methoxyethylaniline, and sulfates, hydrochlorides or p-toluenesulfonates of the above cited anilines. The compounds can also be used as a mixture of two or more thereof.

In general, the color developing solution contains pH buffering agents such as carbonates, borates or phosphates of alkali metals, and development inhibitors or antifoggants such as bromides, iodides, benzimidazoles, benzothiazoles or mercapto compounds. In addition, it can contain optionally various kinds of preservatives, e.g., hydroxylamine, diethylhydroxylamine, sulfites, hydrazines, phenylsemicarbazides, triethanolamine, catechol sulfonic acids, triethylenediamine(1,4-diazabicyclo[2,2,2]octane)'s and so on; organic solvents such as ethylene glycol, diethylene glycol, etc.; development accelerators such as benzyl alcohol, polyethylene glycol, quaternary ammonium salts, amines, etc.; dye forming couplers; competing couplers; fogging agents such as sodium borohydride; auxiliary developers such as 1-phenyl-3-pyrazolidone, etc.; viscosity imparting agents; various chelating agents represented by aminopolycarboxylic acids, aminopolyphosphonic acids, alkylphosphonic acids and phosphonocarboxylic acids (e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid and ethylenediamine-di(o-hydroxyphenylacetic acid) and salts of the above cited acids); brightening agents such as 4,4'-diamino-2,2'-disulfostilbene compounds; and various kinds of surface active agents such as alkylsulfonic acids, arylsulfonic acids, aliphatic carboxylic acids, aromatic carboxylic acids and so on.

However, it is desirable that benzyl alcohol is not substantially contained in the color developer from the standpoint of the prevention of environmental pollution, the facility in preparation and the prevention of color stain. The expression "is not substantially contained" means that benzyl alcohol may be contained in an amount of 2 ml or less per liter of the color developer (although it is more desirable that benzyl alcohol is absent entirely from the color developer).

In the case where a reversal processing is carried out, a black-and-white development is performed generally prior to color development. In a black-and-white developing solution, known black-and-white developing agents, such as dihydroxybenzenes including hydroquinone, 3-pyrazolidones including 1-phenyl-3-pyrazolidone or aminophenols including N-methyl-p-aminophenol can be used individually or in combination.

The pH of such a color developing solution and a black-and-white developing solution ranges generally from 9 to 12. The amount of the developing solutions to be replenished, although such depends on the kind of color photographic light-sensitive materials to be processed, is generally 3 liters or less per $m^2$ of the light-sensitive material processed therein. Also, it is feasible to reduce the amount of the replenisher to 500 ml or less by lowering the bromide ion concentration in the replenisher. On the occasion that a so-called high chloride content photosensitive material is employed, it is particularly desirable to lower the bromide ion concentration and, what is more, to raise relatively the chloride concentration in the color developer, because it can effect excellent photographic properties and processability and can inhibit fluctuation in attainable photographic properties. Under such a condition, it is possible to reduce the amount of the replenisher to about 20 ml or less per $m^2$ of the photosensitive materials processed, which corresponds to a situatian that the color developing bath has substantially no overflow. When a replenisher is used in a reduced amount, it is to be desired that evaporation and aerial oxidation of the developing solution be prevented by reducing contact area between air and the developing solution in a processing tank. Also, the amount of the replenisher to be used can be reduced by adopting a measure to inhibit the accumulation of bromide ion in the developing solution.

The processing temperature of the color developing solution is preferably within the range of 30 to 45° C. The processing time upon color development, although generally ranging from 20 seconds to 5 minutes, preferably is from 30 seconds to 3 minutes, can be shortened further by carrying out the processing under the conditions of high temperature and high pH and by using a developing agent in a high concentration.

Photographic emulsion layers are subjected generally to a bleach processing after the color development. The bleach processing may be carried out simultaneously with a fixation processing (blix processing) or separately therefrom. To further increase processing speed, a blix processing may be carried out after a bleach processing. Also, a processing may be carried out with two successive bleach-fixing baths, a fixation processing may be carried out before a blix processing or a bleach processing may be carried out after a blix processing. That is, any manner may be employed in desilvering, if desired. Examples of bleaching agents which can be used include compounds of polyvalent metals, such as Fe(III), Co(III) or the like; peroxy acids; and so on. As representatives of such bleaching agents, ferricyanides; dichromates; Fe(III) or Co(III) complex salts of organic acids, for example, aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid, etc., citric acid, tartaric acid, malic acid and so on; persulfates; bromates; permanganates; nitrobenzenes; and so on can be instanced. Among the bleaching agents, (aminopolycarbonato)iron(III) complex salts represented by (ethylenediaminetetraacetonato)iron(III) complex salts and persulfates are favored particularly from the viewpoints of rapid processing and prevention of environmental pollution. Additionally, (aminopolycarbonato)iron(III) complex salts are useful especially in both bleaching and bleach-fixing baths. As the bleaching agents those having a redox potential of 150 mV or more are preferred in the respect of bleaching power, and specific examples thereof are given below.

| Compound No. | Redox Potential (mV vs. NHE, pH = 6) |
|---|---|
| 1. (N-(2-acetamido)iminodiacetato)-iron(III) complex | 180 |
| 2. (Methyliminodiacetato)iron(III) complex | 200 |
| 3. (Iminodiacetato)iron(III) complex | 210 |
| 4. (1,4-Butylenediaminetetraacetato)-iron(III) complex | 230 |
| 5. (Diethylenethioetherdiaminetetra-acetato)iron(III) complex | 230 |
| 6. (Glycoletherdiaminetetraacetato)-iron(III) complex | 240 |
| 7. (1,3-Propylenediaminetetraacetato)-iron(III) complex | 250 |

Among the complexes, (1,3-diaminopropanetetraacetato)iron(III) complex is most appropriate to the bleaching bath for photograph-taking negative photosensitive materials from the viewpoint of bleaching power. The bleaching or bleach-fixing bath utilizing an (aminopolycarbonato)iron(III) camplex as cited above is adjusted generally to a pH range of 4.0 to 8.0. For the purpose of expediting processing, the processing may be carried out under pH values lower than the above described range.

In a bleaching bath, a bleach-fixing bath and/or a prebath thereof, a bleaching accelerator can be used, if desired. Specific examples of useful bleaching accelerators include mercapto group- or disulfido group-containing compounds as disclosed in JP-A-53-95630, U.S. Pat. No. 3,893,858, West German Patent 1,290,812 and RD No. 17129 (July, 1978) and so on; thiazolidine derivatives disclosed in JP-A-50-140129; thiourea derivatives disclosed in U.S. Pat. No. 3,706,561; iodides disclosed in JP-A-58-16235; polyoxyethylene compounds disclosed in West German Patent 2,748,430; polyamine compounds disclosed in JP-B-45-8836; and bromide ion. Among these compounds, those containing a mercapto group or a disulfido group are favored over others because of their great effect on bleach acceleration. In particular, the compounds disclosed in U.S. Pat. No. 3,893,858, West German Patent 1,290,812 and JP-A-53-95630 are preferred. In addition, the compounds disclosed in U.S. Pat. No. 4,552,834 are desirable. Bleaching accelerators as cited above may be incorporated in photosensitive materials. In the bleach-fix processing of color photosensitive materials for photography, such bleaching accelerators as described above are especially effective.

To the present processing solutions having a fixing ability can be added known additives, for example, rehalogenating agents such as ammonium bromide and ammonium chloride, pH buffering agents such as ammonium nitrate, etc., and metal corrosion inhibitors such as ammonium sulfate, etc.

In the fixing bath of the present invention, known fixing agents Other than thiosulfates may be used in addition to the compounds of the present invention.

As examples of usable fixing agents, mention may be made of thiocyanato complexes, well-known thioether compounds other than thioether compounds of the present invention, thioureas and a large quantity of iodide. To the bleach-fixing solution, sulfites, bisulfites or carbonyl-bisulfite adducts, and sulfinic acid compounds may be added, if desired. In the fixing solution, it is desirable for improvement in stability that chelating agents of aminopolycarboxylic acid series or organophosphonic acid series (preferably 1-hydroxy-ethylidene-1,1-diphosphonic acid and N,N,N',N'-ethylenediaminetetraphosphonic acid) be contained.

The processing solutions having a fixing ability can contain further various kinds of brightening agents, defoaming agents, surface active agents, polyvinyl pyrrolidone, methanol and so on.

In the desilvering process, it is desired from the standpoint of reducing desilvering time that each processing bath be stirred as vigorously as possible. As the stirring means, methods as disclosed in JP-A-62-183460 and JP-A-62-183461 can be instanced. In the case of using a means of causing a jet stream to impinge against a photosensitive material, it is desirable to design such that the impingement may take place for not longer than 15 seconds after introduction of the photosensitive material into the processing solution.

The crossover time from the color developing bath to the bleaching bath (or a period of time which intervenes between the emergence from the color developing bath and the submergence in the bleaching bath, during which the photosensitive material stays in the air) preferably is controlled to not longer than 10 seconds in the present invention from the standpoints of diminishing bleach fog and adhesion of stains to the surface of the photosensitive material. Further, the crossover time from the bleaching solution to the present processing solution having a fixing ability is preferably within 10 seconds from the standpoint of bringing about an improvement on failure of color restoration of cyan dyes.

In the case of photograph-taking color photosensitive materials (having a silver coverage, e.g., ranging from 4 to 12 g/$M^2$), a suitable amount of the fixing solution to be replenished is 800 ml/$m^2$ or less, and that of the bleach-fixing solution to be replenished is 50 ml/$m^2$ or less.

After the desilvering processing, silver halide color photographic materials usable in the present invention are, in general, subjected to a washing and/or stabilization processing. The volume of washing water required in the washing processing can be set variously depending on the characteristics of photosensitive materials to be processed (e.g., on what kinds of couplers are incorporated therein), end use purposes of the photosensitive materials to be processed, the temperature of the washing water, the number of washing tanks (the number of stages), the manner of replenishing the washing water (as to, e.g., whether a current of water flows in the counter direction, or not) and other various conditions. Of the conditions, the relation between the number of washing tanks and the volume of washing water in the multistage countercurrent process can be determined according to the methods described in Journal of the Society of Motion Picture and Television Engineers, Volume 64, pages 248 to 253 (May, 1955).

According to the multistage countercurrent process described in the foregoing literature, the volume of washing water can be decreased sharply. However, the process has a disadvantage, e.g., in that bacteria which have propagated in the tanks because of an increase in staying time of water in the tanks produce a suspended matter and the resulting suspended matter sticks to the photosensitive materials processed therein. As the means of solving such a problem as described above, the method of lowering calcium and magnesium ion concentrations, as disclosed in JP-A-62-288838, can be employed to great advantage. Further, bactericides such as isothiazolone compounds and thiabendazole compounds disclosed in JP-A-57-8542; chlorine-containing germicides such as sodium salt of chlorinated isocyanuric acid; and other germicides such as benzotriazoles, as described in Hiroshi Horiguchi, *Bohkin-Bohbaizai no Kagaku* (which means "Chemistry of Antibacterial Agents and Antimolds"), Sankyo Shuppan (1986); *Biseibutsu no Mekkin Sakkin Bohbai Gijutsu* (which means "Arts of Sterilizing and Pasteurizing Microbes, and Proofing against Molds"), compiled by Eisei Gijutsukai, published by Kogyo Gijutsu Kai in 1982; and *Bohkin-Bohbazai Jiten* (which means "Thesaurus of Antibacterial Agents and Antimolds"), compiled by Nippon Bohkin Bohbai Gakkai.

A suitable pH of the washing water in the processing of the photosensitive materials of the present invention ranges generally from 4 to 9 and more preferably from 5 to 8. The washing temperature and time, although such can be chosen variously depending on the characteristics and the intended use of the photosensitive materials to be processed, are within the range of generally 20 seconds to 10 minutes at temperatures from 15° C. to 45° C. and preferably 30 seconds to 5 minutes at temperatures from 25° C. to 40° C.

Also, the photosensitive material of the present invention can be processed directly with a stabilizer instead of undergoing the above described washing processing. To such a stabilization processing, all of known methods as disclosed in JP-A-57-8543, JP-A-58-14834 and JP-A-60-220345 can be employed.

On the other hand, a stabilization processing may be carried out subsequently to the above described washing processing. For example, a stabilizing bath containing dye stabilizing agents represented by formaldehyde, hexamethylenetetramine, hexahydrotriazine and N-methylol compounds, which is used as the final bath of color photosensitive materials for photograph-taking use, can be instanced. To the stabilizing bath also, ammonium compounds, metal compounds such as Bi compounds, Al compounds, etc., brightening agents, various kinds of chelating agents, film pH modifiers, hardeners, germicides, antimolds, alkanolamines and surfactants (preferably those of silicone type) can be added. As the water used in the washing or stabilizing process, although city water can be used as it is, it is subjected preferably to a deionization treatment using ion exchange resins for the purpose of reducing both Ca and Mg ion concentrations to 5 mg/liter or less, or a pasteurization treatment with a halogen lamp, a UV sterilization lamp or the like.

A suitable amount of the above described washing water and/or stabilizing solution to be replenished is generally from 1 to 5 times, preferably from 2 to 30 times, and more preferably from 2 to 15 times, the quantity of the processing solution brought thereinto from the prebath by the photosensitive material with a unit area. The solution overflowing the washing bath and/or the stabilizing bath in proportion to the replenishment can be reused in another processing step, such as a desilvering step.

In the silver halide color photographic material of the present invention, a color developing agent may be incorporated with the intention of simplifying and expediting the photographic processing. In incorporating the color developing agent, it is desired that it be used in the form of precursor. As examples of such precursors, mention may be made of indoaniline compounds disclosed in U.S. Pat. No.3,342,597, compounds of Schiff base-type disclosed in U.S. Pat. No. 3,342,599, RD Nos. 14850 and 15159, aldol compounds disclosed in RD No. 13924, metal complexes disclosed in U.S. Pat. No. 3,719,492 and urethane compounds disclosed in JP-A-53-135628.

In the silver halide color photographic materials of the present invention, various kinds of 1-phenyl-3-pyrazolidones may be incorporated for the purpose of accelerating color development, if desired. Typical examples of such pyrazolidones are disclosed in JP-A-56-64339, JP-A-57-144547 and JP-A-58-115438.

Various kinds of processing solutions in the present invention are used in the temperature range of 10° to 50° C. Although a standard temperature generally is within the range of 33° C. to 38° C., temperatures higher than the above range can be chosen with the intention of reducing the processing time through acceleration of the processing, or those lower than the foregoing range can be chosen in order to achieve an improvement in image quality and enhancement of the stability of the processing solution. Moreover, a processing with a cobalt or hydrogen peroxide intensifier as disclosed in West German Patent 2,226,770 or U.S. Pat. No. 3,675,499, respectively, may be carried out for the purpose of saving silver in the photosensitive materials.

A photagraphic material using direct positive silver halides is cited as an example of silver halide color photosensitive materials. A photographic processing applied to the photographic material of that type is described below:

After imagewise exposure, a direct positive silver halide color photographic material is developed with a surface developer containing an aromatic primary amine color developing agent adjusted to pH 11.5 or lower after or as it receives a fogging treatment with light or a nucleating agent, bleached and fixed to produce effectively a direct positive color image. In this processing, it is more effective to adjust the color developer to pH 11.0 to 10.0.

As the fogging treatments applicable to the present invention, there are a method of conferring a second exposure upon the entire surface of light-sensitive layers, that is, a so-called "optical fogging method", and a method of performing a development processing in the presence of a nucleating agent, that is to say, a "chemical fogging method". Also, the development processing may be carried out in the presence of both a nucleating agent and fogging light, or a photosensitive material in which a nucleating agent is incorporated may be exposed to fogging light.

Details of the optical fogging method are described in JP-A-63-108336 (on pages 47 to 49) and specific examples of nucleating agents usable in the present invention are illustrated on pages 49 to 67 of the foregoing patent specification. In particular, the compounds represented by formulae (N-I) and (N-II) can be used to advantage. Specific examples of such compounds which can be used preferably in the present invention include those illustrated as (N-I-1) to (N-I-10) on pages 56 to 58 of the foregoing patent specification and those illustrated as (N-II-1) to (N-II-12) on pages 63 to 66 of the same patent specification.

Nucleation accelerators which can be used in the present invention include those disclosed on page 68, line 11 to page 71, line 3 of the foregoing patent specification. As for the specific examples thereof, those illustrated as (A-1) to (A-13) on pages 69 to 70 are used preferably herein.

Color developers usable in the development processing of the photosensitive material of the above described type include those described on pages 71 (line 4) to 72 (line 9) of the foregoing patent specification. As the aromatic primary amine color developing agent, p-phenylenediamine compounds are preferred in particular. As typical examples thereof, mention may be made of 3-methyl-4-amino-N-ethyl-N-(β-methanesulfonamidoethyl)aniline, 3-methyl-4-amino-N-ethyl-N-(β-hydroxyethyl)aniline, 3-methyl-4-amino-N-ethyl-N-methoxyethylaniline and salts thereof such as sulfates, hydrochlorides, etc.

Next, silver halide black-and-white photographic materials and photographic processings applicable thereto are described in detail below.

The silver halide emulsions which can be used in the present invention have no particular restriction with respect to halide composition, and any silver halides, including silver chloride, silver chlorobromide, silver iodobromide, silver bromide and silver iodobromochloride may be used. However, it is desirable that an iodide content therein should be 10 mol % or less, especially 5 mol % or less.

The silver halide grains in the photographic emulsions which can be used in the present invention, although they can have a relatively broad size distribution, preferably have a narrow size distribution. In particular, it is desirable that the grains should have a size distribution such that 90%, based on weight or number, of the whole grains may have their individual sizes within the range of ±40% of the average grain size.

On the occasion that photographic materials are used for formation of negative images of high contrast, fine grain silver halide emulsions having an average grain size of 0.7 μm or less, especially 0.5 μm or less, are used preferably. Such emulsions, although have basically no limitation on grain size distribution, are preferably monodispersed. The term monodispersed emulsion as used herein is intended to include the emulsions in which at least 95%, based on weight or number of grains, of the whole grains have their individual sizes within the range of ±40% of the average grain size.

Silver halide grains in the photographic emulsions may have a regular crystal form, such as that of a cube, an octahedron, a rhombododecahedron, a tetradecahedron, etc., an irregular crystal form, such as that of a sphere, a tabular, etc., or a composite form of two or more of the above cited forms.

The interior and the surface of the silver halide grains may differ, or the silver halide grains may be uniform throughout.

As the silver halide emulsions used in the present invention, cadmium salts, zinc salts, lead salts, thallium salts, rhodium salts or complexes, iridium salts or complexes, and the like may be present in a process of producing silver halide grains or allowing the produced silver halide grains to ripen physically.

It is desirable that silver halides to be used in the present invention be prepared in the presence of from $1\times10^{-8}$ to $1\times10^{-5}$ mol/mol Ag of an iridium salt or complex and designed so as to have a halide distribution that an iodide content in a surface part of each grain is greater than an average iodide content in the grain as a whole. The emulsions comprising such silver haloiodides can have much higher sensitivity and high gamma value.

The silver halide emulsions used in the present invention, even though they need not be sensitized chemically, are generally subjected to chemical sensitization. For chemical sensitization, known sulfur sensitization, reduction sensitization and noble metal sensitization methods can be employed independently or in combination thereof.

A gold sensitization method is representative of noble metal sensitization methods, and uses gold compounds, mainly gold complexes. Therein, complexes of other noble metals, e.g., platinum, palladium, rhodium, etc., may be contained together. Specific examples thereof are disclosed, e.g., in U.S. Pat. No. 2,448,060, British Patent 618,016 and so on.

As the suitable sulfur sensitizers which can be used, various sulfur compounds, such as thiosulfates, thioureas, thiazoles, rhodanines, etc., can be instanced in addition to sulfur compounds contained in gelatin.

In a process of producing the silver halide emulsion, it is desirable in particular that an iridium or rhodium salt be used before the conclusion of physical ripening, especially at the time of grain formation.

As disclosed in JP-A-61-223734 and JP-A-62-90646, it is desirable from the standpoint of an increase in maximum density (Dmax) that a silver halide emulsion layer relating to the present invention comprise two kinds of monodispersed emulsions differing in average grain size. Therein, it is preferred to use a chemically sensitized emulsion as the small size monodispersed emulsion. As the method for chemical sensitization, sulfur sensitization is most suitable. On the other hand, the large size monodispersed emulsion grains, although they may be chemically sensitized, are not sensitized chemically as a general rule, because they tend to generate black peppers. Accordingly, it is desired that the large size grains be sensitized chemically, if desired, to such a slight extent as not to generate black peppers. The expression "sensitized chemically to a slight extent" as used herein means that the time spent for chemical sensitization is shortened, the temperature during chemical sensitization is lowered and the amount of chemical sensitizers used is reduced, compared with those parameters adopted for the chemical sensitization of small size grains. The sensitivity difference between the large size grains and the small size grains does not have any particular restriction. However, the difference ranges preferably from 0.1 to 1.0, especially from 0.2 to 0.7, expressed in terms of $\Delta\log E$, and it is desirable that the large size monodispersed emulsion have higher sensitivity. The average size of the small size monodispersed grains is generally not more than 90%, preferably not more than 80%, of that of the large size monodispersed grains. A suitable average size of the silver halide emulsion grains is within the range of generally 0.02 to 1.0 μm, preferably 0.1 to 0.5 μm, and it is desirable that both large size and small size monodispersed grains have their respective average sizes within said range.

When two or more kinds of emulsions differing in grain size are used, a silver coverage of the small size monodispersed emulsion amounts preferably to 40 to 90 wt %, more preferably to 50 to 80 wt %, of the total silver coverage.

Monodispersed emulsions differing in grain size may be introduced in the same emulsion layer, or separate layers. In the latter case, it is desirable that a large size emulsion should constitute the upper layer and a small size emulsion the lower layer.

Additionally, a suitable total silver coverage ranges from 1 to 8 g/m$^2$.

To photosensitive materials used in the present invention, sensitizing dyes described on pages 45 to 53 of JP-A-55-52050 (e.g., cyanine dyes, merocyanine dyes) can be added. The sensitizing dyes may be used individually or in combination. Combinations of sensitizing dyes are often used for the purpose of supersensitization. Compounds which can exhibit a supersensitizing effect in combination with a certain sensitizing dyes although themselves do not sensitize spectrally silver halide emulsions or do not absorb light in the visible region may be incorporated into the silver halide emulsions. Useful sensitizing dyes, supersensitizing combinations of dyes and substances capable of producing a supersensitizing effect are described in RD 17643, p. 23, Item IV-J (December, 1978).

The photosensitive materials which can be used in the present invention can contain a wide variety of compounds for the purpose of preventing fog or stabilizing photographic functions during production, storage or photographic processing. Specific examples of such compounds include azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc.; mercaptopyrimidines; mercaptotriazines; thioketo Compounds such as oxazolinethione; azaindenes such as triazaindenes, tetraazaindenes (especially 4-hydroxy-substituted (1,3,3a,7)tetraazaindenes), pentaazaindenes, etc.; and a number of compounds known as an antifoggant or a stabilizer, e.g., benzenethiosulfonic acids, benzenesulfinic acids, benzenesulfonic acid amides, etc. Among the compounds, benzotriazoles (e.g., 5-methylbenzotriazole) and nitroindazoles (e.g., 5-nitroindazole) are preferred over others. Also, these compounds may be present in processing solutions.

Photosensitive materials which can be used in the present invention may contain a nucleating agent in photographic emulsion layers or other hydrophilic colloid layers.

Suitable examples of a nucleating agent which can be used in the present invention include those disclosed in RD 23516, p. 346 (November, 1983), references Cited therein, U.S. Pat. Nos. 4,080,207, 4,269,929, 4,276,364, 4,278,748, 4,385,108, 4,459,347, 4,560,638 and 4,478,928, British Patent 2,011,391 B, JP-A-60-179734, JP-A-62-270948, JP-A-63-29751, JP-A-61-170733, JP-A-61-270744, JP-A-62-948, European Patent 217,310 or U.S.

Pat. No. 4,686,167, JP-A-62-178246, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-1-100530, JP-A-1-105941, JP-A-1-105943, JP-A-64-10233, JP-A-1-90439, JP-A-1-276128, JP-A-1-283548, JP-A-1-280747, JP-A-1-283549, JP-A-1-285940, JP-A-2-2541, JP-A-2-77057, JP-A-2-198440, JP-A-2-198441, JP-A-2-198442, JP-A-2-196234, JP-A-2-196235, JP-A-2-220042, JP-A-2-221953, JP-A-2-221954, JP-A-2-302750, JP-A-2-304550 and Japanese Patent Application Nos. 63-179760, 1-18377, 1-18378, 1-18379, 1-15755, 1-16814, 1-40792, 1-42615, 1-42616, 1-123693 and 1-126284.

As developing accelerators or nucleation infectious developing accelerators suitable for the present invention, compounds as disclosed in JP-A-53-77616, JP-A-54-37732, JP-A-53-137133, JP-A-60-140340, JP-A-60-14959 and so on, and various kinds of compounds containing N or S atom(s) are effective.

Optimal amounts of the accelerators added, although such depends on the kind thereof, are preferably within the range of $1.0\times10^{-3}$ to 0.5 g/m$^2$ particularly $5.0\times10^{-3}$ to 0.1 g/m$^2$.

Photosensitive materials which can be used in the present invention may contain a desensitizer in the photographic emulsion layers or other hydrophilic colloid layers.

An organic desensitizer which can be used in the present invention is prescribed by a polarographic half-wave potential, or a redox potential determined by polarography. More specifically, it is required of the organic desensitizer that the sum of its polarographic anode and cathode potentials become positive. The measurement of the polarographic redox potential is described, e.g., in U.S. Pat. No. 3,501,307. It is desirable that such an organic desensitizer have at least one water-soluble group, such as a sulfonic acid group, a carboxylic acid group, or so on. The acid groups may form salts together with organic bases (e.g., ammonia, pyridine, triethylamine, piperidine and morpholine) or alkali metals (e.g., sodium and potassium).

The organic desensitizers of formulae (III) and (IV) illustrated on pages 55 to 72 of JP-A-63-133145 are used preferably in the present invention.

Such organic desensitizers preferably are present in a silver halide emulsion layer in an amount of $1.0\times10^{-8}$ to $1.0\times10^{-4}$ mol, particularly $1.0\times10^{-7}$ to $1.0\times10^{-5}$ mol, per square meter.

In the emulsion layers of the present invention, or other hydrophilic colloid layers, water-soluble dyes may be present as filter dyes, for prevention of irradiation and for other various purposes. As for the filter dyes, dyes for further lowering photographic speed, preferably ultraviolet absorbents having spectral absorption maxima in the intrinsic sensitivity region of silver halides and dyes showing substantial absorption of light at wavelengths ranging mainly from 380 to 600 nm which can function so as to enhance the safety to safelight when the photographic material is handled as bright room-type light-sensitive material, can be used.

Such dyes may be added to emulsion layers as occasion calls, or may be added to a light-insensitive hydrophilic colloid layer located farther from the support than an emulsion layer together with a mordant, and fixed thereto.

The coverage of an ultraviolet absorbent added ranges generally from $1\times10^{-2}$ to 1 g/m$^2$, preferably from 50 to 500 mg/m$^2$, which depends on a molecular extinction coefficient of the ultraviolet absorbent.

The above described ultraviolet absorbent is dissolved in a proper solvent (e.g., water, alcohols such as methanol, ethanol, propanol, etc., acetone, methyl cellosolve or a mixture of two or more thereof) and added to a coating composition.

Suitable examples of an ultraviolet absorbent which can be used include aryl-substituted benzotriazole compounds, 4-thiazolidone compounds, benzophenone compounds, cinnamate compounds, butadiene compounds, benzoxazole compounds and ultraviolet-absorbing polymers.

More specifically, the above cited ultraviolet absorbents are disclosed, e.g., in U.S. Pat. Nos. 3,533,794, 3,314,794 and 3,352,681, JP-A-46-2784, U.S. Pat. Nos. 3,705,805, 3,707,375, 4,045,229, 3,700,455 and 3,499,762, and West German Patent 1,547,863.

Suitable examples of a filter dye which can be used include oxonol dyes, hemioxonol dyes, styryl dyes, merocyanine dyes, cyanine dyes and azo dyes. In particular, water-soluble dyes or dyes of the kind which can be decolored with alkali or sulfite ion are used to advantage in respect that color stains after development can be reduced.

Specific examples of filter dyes which can be used include pyrazoloneoxonol dyes disclosed in U.S. Pat. No. 2,274,782, diarylazo dyes disclosed in U.S. Pat. No. 2,956,879, styryl dyes and butadienyl dyes disclosed in U.S. Pat. Nos. 3,423,207 and 3,384,487, merocyanine dyes disclosed in U.S. Pat. No. 2,257,583, merocyanine dyes and oxonol dyes disclosed in U.S. Pat. Nos. 3,486,897, 3,652,284 and 3,718,472, enaminohemioxonol dyes disclosed in U.S. Pat. No. 3,976,661, and dyes disclosed in British Patents 584,609 and 1,177,429, JP-A-48-85130, JP-A-49-99620, JP-A-49-114420, U.S. Pat. Nos. 2,533,472, 3,148,187, 3,177,078, 3,247,127, 3,540,887, 3,575,704 and 3,653,905.

Such dyes are dissolved in a proper solvent (e.g., water, alcohols such as methanol, ethanol, propanol, etc., acetone, methyl cellosolve or a mixture of two or more thereof) and added to a coating composition for a light-insensitive hydrophilic colloid layer of the present invention.

In general, a proper coverage of such dyes can be found within the range of $1\times10^{-3}$ to 1 g/m$^2$, particularly $1\times10^{-3}$ to 0.5 g/m$^2$.

Photographic light-sensitive materials which can be used in the present invention may contain inorganic or organic hardeners in the photographic emulsion layers and other hydrophilic colloid layers. Specifically, chromates, aldehydes (e.g., formaldehyde and glutaraldehyde), N-methylol compounds (e.g., dimethylolurea), active vinyl compounds (e.g., 1,3,5-triacryloyl-hexahydro-S-triazine and 1,3-vinylsulfonyl-2propanol), active halogen-containing compounds (e.g., 2,4-dichloro-6-hydroxy-S-triazine), mucohalogenic acids and so on can be used individually or in combination of two or more thereof.

The photographic emulsion layers and other hydrophilic colloid layers of photosensitive materials used in the present invention may contain various kinds of surface active agents for a wide variety of purposes, for instance, as a coating aid, prevention of generation of static charges, improvement in slippability, emulsifying dispersion, prevention of adhesion, improvements in photographic characteristics (e.g., acceleration of development, increase in contrast, sensitization, etc) and so on. Surface active agents which are favored particularly in the present invention are polyalkylene oxides having a molecular weight of 600 or above, as disclosed in JP-B-58-9412. When surface active agents are used as an antistatic agent, fluorine-containing surface active agents (for details of which U.S. Pat. No. 4,201,586, JP-A-60-80849 and JP-A-59-74554 should be referred to) can be used to great advantage.

For the purpose of prevention of adhesion, the photographic light-sensitive materials used in the present invention can contain a matting agent, such as silica, magnesium oxide, polymethyl methacrylate, etc., in photographic emulsion layers and other hydrophilic colloid layers.

For the purpose of improvement in dimensional stability, the photographic emulsions used in the present invention can contain a dispersion of water-insoluble or sparingly water-soluble synthetic polymer. Suitable examples of constituent monomers for such synthetic polymers include alkyl(meth)acrylates, alkoxyalkyl(-meth)acrylates, glycidyl(meth)acrylates, combination of two or more of the acrylates and combination of one or more of such an acrylate with acrylic acid, methacrylic acid or so on.

In silver halide emulsion layers and other layers of the photographic light-sensitive materials used in the present invention, it is desirable to incorporate a compound containing an acid group. Suitable examples of such a compound include organic acids such as salicylic acid, acetic acid, ascorbic acid and the like, and homo- or copolymers containing as constitutional repeating units acid monomers such as acrylic acid, maleic acid, phthalic acid and the like. For details of such acid polymers JP-A-61-223834, JP-A-61-228437, JP-A-62-25745 and JP-A-62-55642 can be referred to. As the acid compounds, ascorbic acid is most preferred in the group of low molecular weight compounds, while water dispersible latexes of copolymers constituted by acid monomers, such as acrylic acid, and crosslinking monomers having two or more unsaturated groups, such as divinyl benzene, are most preferred in the group of high molecular weight compounds.

In the development processing of silver halide black-and-white photosensitive materials used in the present invention, a developer used can contain conventionally used additives (e.g., developing agents, alkali agents, pH buffers, preservatives and chelating agents). To the processing of the present invention, any of known methods can be applied, and any of known processing solution can be used. Additionally, a processing temperature generally is chosen from the range of 18° C. to 50° C. Of course, temperatures lower than 18° C. and those higher than 50° C. may be adopted.

In a black-and-white developer, dihydroxybenzenes, 1-phenyl-3-pyrazolidones, aminophenols and other known developing agents can be used alone or in combination.

Specific examples of a developing agent of dihydroxybenzene type which can be used in the present invention include hydroquinone, chlorohydroquinone, bromohydroquinone, isopropylhydroquinone, methylhydro-hydroquinone, 2,3-dichlorohydroquinone, 2,3-dibromohydroquinone, 2,5-dimethylhydroquinone and so on. Hydroquinone is favored, in particular.

Specific examples of an auxiliary developing agent of 1-phenyl-3-pyrazolidone or its derivative type include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and so on.

Specific examples of an auxiliary developing agent of p-aminophenol type include N-methyl-p-aminophenol, p-aminophenol, N-(β-hydroxyethyl)-p-aminophenol, N-(4-hydroxyphenyl)glycine, 2-methyl-p-aminophenol, p-benzylaminophenol and so on. N-methyl-p-aminophenol is favored, in particular.

In general, it is desirable that a developing agent of dihydroxybenzene type be used in an amount of from 0.05 to 0.8 mol/liter. In the combined use of dihydroxybenzenes with 1-phenyl-3-pyrazolidones or p-aminophenols, it is desirable that the former be used in an amount of from 0.05 to 0.5 mol/liter, while the latter be used in an amount of 0.06 mol/liter or less.

As examples of sulfite type preservatives used in the present invention, mention may be made of sodium sulfite, potassium sulfite, lithium sulfite, sodium hydrogensulfite, potassium metabisulfite, formaldehydesodium hydrogensulfite and so on. In a black-and-white developer, particularly in a developer for the graphic arts, sulfites are used in an amount of 0.3 mol/-liter or more. However, sulfites added in too large an amount separate out as precipitates in the developer to pollute the developer, so the upper limit of the addition amount should be set to 1.2 mol/liter.

Alkali agents used in the developer of the present invention include pH modifiers and buffers, such as sodium hydroxide, patassium hydroxide, sodium carbonate, potassium carbonate, sodium tertiary phosphate, potassium tertiary phosphate, sodium silicate, potassium silicate and so on.

In addition to the above cited components, other additives, such a development inhibitor (e.g., boron compounds including boric acid, borax, etc., sodium bromide, potassium bromide, potassium iodide), an organic solvent (e.g., ethylene glycol, diethylene glycol, triethylene glycol, dimethylformamide, methyl cellosolve, hexylene glycol, ethanol and methanol) and an antifoggant or a black pepper fog inhibitor (e.g., mercapto compounds including 1-phenyl-5-mercaptotetrazole, sodium 2-mercaptobenzimidazole-5-sulfonate and the like; indazole compounds including 5-nitroindazole; benzotriazole compounds including 5-methylbenzotriazole) may be contained. Further, a toning agent, a surface active agent, a defoaming agent, a water softener, a hardener and so on may be contained, if desired.

Furthermore, in the developer used in the present invention, the compounds disclosed in JP-A-56-24347 as a silver stain inhibitor, the compounds disclosed in JP-A-62-212651 as an uneven development inhibitor, and the compounds disclosed in Japanese Patent Application No. 60-109743 as a dissolutian assistance can be contained.

Moreover, the developer used in the present invention can contain as buffers, boric acid disclosed in JP-A-62-186259, sugars disclosed in JP-A-60-93433 (e.g., saccharose), oximes (e.g., acetoxime), phenols (e.g., 5-sulfosalicylic acid) and tertiary phosphates (e.g., sodium salt, potassium salt).

A fixing solution is an aqueous solution containing a fixing agent, and optionally a hardener (e.g., water-soluble aluminum compounds), acetic acid and dibasic acids (e.g., tartaric acid, citric acid and salts thereof) and adjusted to pH 3.8 or higher, preferably to pH of 4.0 to 7.5.

In the fixing bath used in the present invention, the compounds of the present invention may be used together with known fixing agents other than thiosulfates.

As examples of known fixing agents which can be used in the present invention, mention may be made of thiocyanates, thioether compounds, thioureas and so on.

Water-soluble aluminum salts which can function mainly as a hardener in the fixing solution are compounds generally known as a hardener for an acidic hardening fixing solution, with specific examples including aluminum chloride, aluminum sulfate, potassium alum and so on.

As the foregoing dibasic acids, tartaric acid (including an Na or K salt thereof) or its derivatives, and citric acid (including an Na or K salt thereof) or its derivatives can be used independently or in combination of two or more thereof. The compounds become effective when contained in an amount of preferably 0.005 mol or more, particularly from 0.01 to 0.03 mol, per liter of the fixing solution.

Further, the fixing solution can contain pH buffers (e.g., acetic acid and boric acid), pH modifiers (e.g., ammonia and sulfuric acid), image preservation improvers (e.g., potassium iodide) and chelating agents. The pH buffers therein are used in a concentration of generally from 10 to 40 g/liter, preferably from 18 to 25 g/liter, because the pH of the developer used is high.

A suitable temperature and time for fixation are similar to those for development. Specifically, the fixing time ranges from 10 seconds to 1 minute under temperatures of from abaut 20° C. to abaut 50° C.

In washing water, antimolds (e.g., compounds as described in H. Horiguchi, *Bohkin Bohbai no Kagaku*, compounds disclosed in JP-A-62-115154, washing accelerators (e.g., sulfites), chelating agents and so on may be contained.

A washing solution may be replenished in an amount of 1,200 ml/m$^2$ or less (including zero).

Zero replenishment of the washing solution (or a stabilizing solution) signifies washing with so-called reservoired water. As a method for reducing a replenisher in quantity, a multistage countercurrent method (in which the number of stages is, e.g., 2 or 3) has been known for a long time.

Problems produced by reduction of a replenisher for the washing solution or the like in quantity can be solved by properly combining the arts described in the process of color photographic materials which has been described above, and thereby satisfactory processability can be obtained.

In carrying out the washing operation with a small amount of water according to the method of the present invention, it is desirable to use a washing tank equipped with squeegee rollers and crossover racks as disclosed in JP-A-63-18350 and JP-A-62-287252.

Further, all or part of the overflow generated from the washing or stabilizing bath through the replenishment of water, to which a moldproofing means is applied, in proportion to the progress of the processing can be utilized in the prior step, that is to say, can be fed to the processing solution having fixability, as disclosed in JP-A-60-235133 and JP-A-63-129343.

Furthermore, water-soluble surface active agents and defoaming agents may be added for prevention of water unevenness (marks), which tend to be generated when a small amount of water is used in the washing step, and for inhibiting ingredients of the processing solution attached to squeegee rollers from transferring to the processed films.

In addition, the dye absorbents disclosed in JP-A-63-163456 may be put in the washing tank for the purpose of preventing stains caused by dyes eluted from photosensitive materials.

According to the above described embodiments, developed and fixed photographic materials are washed and then dried. The washing is carried out in order to almost completely remove silver salts dissolved by fixation and a suitable washing time ranges from 10 seconds to 3 minutes under temperatures from about 20° C. to about 50° C. The drying is carried out in the temperature range of about 40° C. to abgut 100° C. A suitable drying time, although can be changed properly depending on the surrounding condition, is generally within the range of about 5 seconds to 3 minutes and 30 seconds.

Automatic developing machines of the carrier roller type are disclosed, e.g., in U.S. Pat. Nos. 3,025,779 and 3,545,971. In the present invention, such machines are simply referred to as carrier roller auto processors. Those carrier roller auto processors comprise development, fixation, washing and drying parts. In the present invention also, it is most suitable for the photographic processing to follow in the foregoing steps, although other steps (e.g., a stop step) are not excluded. Therein, water saving can be achieved by applying a 2- or 3-stage countercurrent washing method to the washing step.

It is desired that the developers used in the present invention be preserved using a packing material having low oxygen-perviousness as disclosed in JP-A-61-73147. In addition, the replenishment system disclosed in JP-A-62-91939 can be applied effectively to the developing bath used in the present invention.

Photographic light-sensitive materials relating to the present invention include general black-and-white silver halide photographic materials (e.g., photograph-taking black-and-white sensitive materials, X-ray black-and-white sensitive materials and graphic arts black-and-white sensitive materials), general multilayer silver halide color photographic materials (e.g., color negative films, color reversal films, color positive films, motion picture color negative films, color photographic paper, reversal color photographic paper and direct positive color photographic paper), laser scanner infrared-sensitive materials, diffusion transfer photosensitive materials (e.g., silver salt diffusion transfer photosensitive materials and color diffusion transfer photosensitive materials), heat developable photosensitive materials and so on.

The compounds of the present invention can not only effect the stabilization of a fixing solution or a fixing solution having a bleaching ability also (e.g., a bleach-fixing solution) (particularly preventing generation of sulfides), but also provide a processing composition or a processing solution with excellent fixing ability.

In addition, the compounds of the present invention can ensure a stable processing even when the replenishment for a fixing solution or a bleach-fixing solution is carried Out in a greatly reduced quantity.

Moreover, when the compounds of the present invention are used as a fixing agent, the combined use with other fixing agents (e.g., thiocyanates) does not spoil so greatly the above described effects.

EXAMPLES

The present invention will now be illustrated in more detail by reference to the following examples. However, the present invention should not be construed as being limited to these examples.

EXAMPLE 1

On a cellulose triacetate film support having a subbing layer were coated the layers having compositions described below to prepare a multilayer color photosensitive material (Sample 101).

As the coverages of ingredients of each constituent layer, those of silver halide emulsions and colloidal silvers are expressed in g/m$^2$ based on silver, those of couplers, additives and gelatin in g/m$^2$ and those of sensitizing dyes are expressed in mol per mol of silver halide contained in the same layer.

| | |
|---|---|
| First Layer (antihalation layer) | |
| Black Colloidal Silver | 0.15 |
| Gelatin | 1.5 |
| ExM-8 | 0.08 |
| UV-1 | 0.03 |
| UV-2 | 0.06 |
| Solv-2 | 0.08 |
| UV-3 | 0.07 |
| Cpd-5 | $6 \times 10^{-4}$ |
| Second Layer (interlayer) | |
| Gelatin | 1.5 |
| UV-1 | 0.03 |
| UV-2 | 0.06 |
| UV-3 | 0.07 |
| ExF-1 | 0.004 |
| Solv-2 | 0.07 |
| Cpd-5 | $6 \times 10^{-4}$ |
| Third Layer (first red-sensitive emulsion layer) | |
| Silver Iodobromide Emulsion (iodide content: 2 mol % on average, higher in the inner part; sphere corresponding diameter: 0.3 μm, with a variation coefficient of 29%; grain form: mixture of normal and twinned crystals; diameter/thickness ratio: 2.5) | 0.5 |
| Gelatin | 0.8 |
| ExS-1 | $1.0 \times 10^{-4}$ |
| ExS-2 | $3.0 \times 10^{-4}$ |
| ExS-3 | $1 \times 10^{-5}$ |
| ExC-3 | 0.22 |
| ExC-4 | 0.02 |
| Cpd-5 | $3 \times 10^{-4}$ |
| Fourth Layer (second red-sensitive emulsion layer | |
| Silver Iodobromide Emulsion (iodide content: 4 mol % on average, higher in the inner part; sphere corresponding diameter: 0.55 μm, with a variation coefficient of 20%; grain form: mixture of normal and twinned crystals; diameter/thickness ratio: 1) | 0.7 |
| Gelatin | 1.26 |
| ExS-1 | $1 \times 10^{-4}$ |
| ExS-2 | $3 \times 10^{-4}$ |
| ExS-3 | $1 \times 10^{-5}$ |
| ExC-3 | 0.33 |
| ExC-4 | 0.01 |
| ExY-15 | 0.01 |
| ExC-7 | 0.04 |
| ExC-2 | 0.08 |
| Solv-1 | 0.03 |
| Cpd-5 | $5 \times 10^{-4}$ |
| Fifth Layer (third red-sensitive emulsion layer) | |
| Silver Iodobromide Emulsion (iodide content: 10 mol % on average, higher in the inner part; sphere corresponding diameter: 0.7 μm, with a variation coefficient of 30%; grain form: mixture of twinned crystals; diameter/thickness ratio: 2) | 0.7 |
| Gelatin | 0.8 |
| ExS-1 | $1 \times 10^{-4}$ |

-continued

| | |
|---|---|
| ExS-2 | $3 \times 10^{-4}$ |
| ExS-3 | $1 \times 10^{-5}$ |
| ExC-5 | 0.05 |
| ExC-6 | 0.06 |
| Solv-1 | 0.15 |
| Solv-2 | 0.08 |
| Cpd-5 | $3 \times 10^{-5}$ |
| Sixth Layer (interlayer) | |
| Gelatin | 1.0 |
| Cpd-5 | $4 \times 10^{-4}$ |
| Cpd-1 | 0.10 |
| Cpd-4 | 1.23 |
| Solv-1 | 0.05 |
| Cpd-3 | 0.25 |
| Seventh Layer (first green-sensitive emulsion layer) | |
| Silver Iodobromide Emulsion (iodide content: 2 mol % on average, higher in the inner part; sphere corresponding diameter: 0.3 μm, with a variation coefficient of 28%; grain form: mixture of normal and twinned crystals; diameter/thickness ratio: 2.5) | 0.3 |
| Gelatin | 0.4 |
| ExS-4 | $5 \times 10^{-4}$ |
| ExS-6 | $0.3 \times 10^{-4}$ |
| ExS-5 | $2 \times 10^{-4}$ |
| ExM-9 | 0.2 |
| ExY-14 | 0.03 |
| ExM-8 | 0.03 |
| Solv-1 | 0.2 |
| Cpd-5 | $2 \times 10^{-4}$ |
| Eighth Layer (second green-sensitive emulsion layer) | |
| Silver Iodobromide Emulsion (iodide content: 4 mol % on average, higher in the inner part; sphere corresponding diameter: 0.55 μm, with a variation coefficient of 20%; grain form: mixture of normal and twinned crystals; diameter/thickness ratio: 4) | 0.6 |
| Gelatin | 0.8 |
| ExS-4 | $5 \times 10^{-4}$ |
| ExS-5 | $2 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-14 | 0.04 |
| Solv-1 | 0.2 |
| Cpd-5 | $3 \times 10^{-4}$ |
| Ninth Layer (third green-sensitive emulsion layer) | |
| Silver Iodobromide Emulsion (iodide content: 10 mol % on average, higher in the inner part; sphere corresponding diameter: 0.7 μm, with a variation coefficient of 30%; grain form: mixture of normal and twinned crystals; diameter/thickness ratio: 2.0) | 0.85 |
| Gelatin | 1.0 |
| ExS-4 | $2.0 \times 10^{-4}$ |
| ExS-5 | $2.0 \times 10^{-4}$ |
| ExS-6 | $0.2 \times 10^{-4}$ |
| ExS-7 | $3.0 \times 10^{-4}$ |
| ExM-12 | 0.06 |
| ExM-13 | 0.02 |
| ExM-8 | 0.02 |
| Solv-1 | 0.20 |
| Solv-2 | 0.05 |
| Cpd-2 | 0.01 |
| Cpd-5 | $4 \times 10^{-4}$ |
| Tenth Layer (yellow filter layer) | |
| Gelatin | 0.9 |
| Yellow Colloidal Silver | 0.05 |
| Cpd-1 | 0.2 |
| Solv-1 | 0.15 |
| Cpd-5 | $4 \times 10^{-4}$ |
| Eleventh Layer (first blue-sensitive emulsion layer) | |
| Silver Iodobromide Emulsion (iodide content: 4 mol % on average, higher in the inner part; sphere corresponding diameter: 0.5 μm, with a variation coefficient of 15%; grain form: octahedron) | 0.4 |
| Gelatin | 1.0 |
| ExS-8 | $2 \times 10^{-4}$ |
| ExY-16 | 0.9 |

-continued

| | |
|---|---|
| ExY-14 | 0.09 |
| Solv-1 | 0.3 |
| Cpd-2 | 0.01 |
| Cpd-5 | $4 \times 10^{-4}$ |
| Twelfth Layer (second blue-sensitive emulsion layer) | |
| Silver Iodobromide Emulsion (iodide content: 10 mol % an average, higher in the inner part; sphere corresponding diameter: 1.3 μm, with a variation coefficient of 25%; grain form: mixture of normal and twinned crystals; diameter/thickness ratio: 4.5) | 0.5 |
| Gelatin | 0.6 |
| ExS-8 | $1 \times 10^{-4}$ |
| ExY-16 | 0.12 |
| Solv-1 | 0.04 |
| Cpd-5 | $2 \times 10^{-4}$ |
| Thirteenth Layer (first protective layer) | |
| Fine Grain Silver Iodobromide (average grain size: 0.07 μm, iodide content: 1 mol %) | 0.2 |

-continued

| | |
|---|---|
| Gelatin | 0.8 |
| UV-3 | 0.1 |
| UV-4 | 0.1 |
| UV-5 | 0.2 |
| Solv-3 | 0.04 |
| Cpd-5 | $3 \times 10^{-4}$ |
| Fourteenth Layer (second protective layer) | |
| Gelatin | 0.9 |
| Polymethyl Methacrylate Particles (diameter: 1.5 μm) | 0.2 |
| Cpd-5 | $4 \times 10^{-4}$ |
| H-1 | 0.4 |

In each constituent layer, a surface active agent was added as coating aid, in addition to the above described ingredients. The thus prepared photosensitive material was named Sample 101.

Chemical formulae or names of the compounds used for Sample 101 are illustrated below.

UV-4:

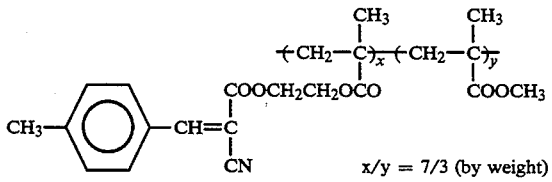

UV-5:

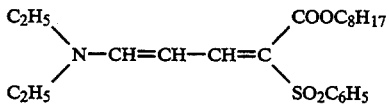

UV-1:

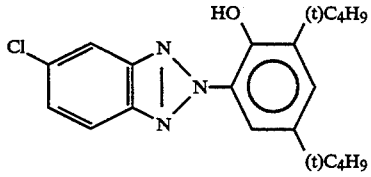

UV-2:

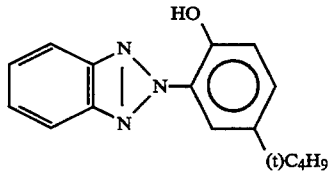

UV-3:

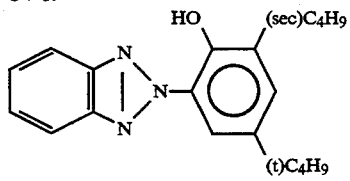

Solv-1:
Tricresyl Phosphate

Solv-2:
Dibutyl Phthalate

Solv-3:
Bis(2-ethylhexyl) Phthalate

ExM-8:

-continued
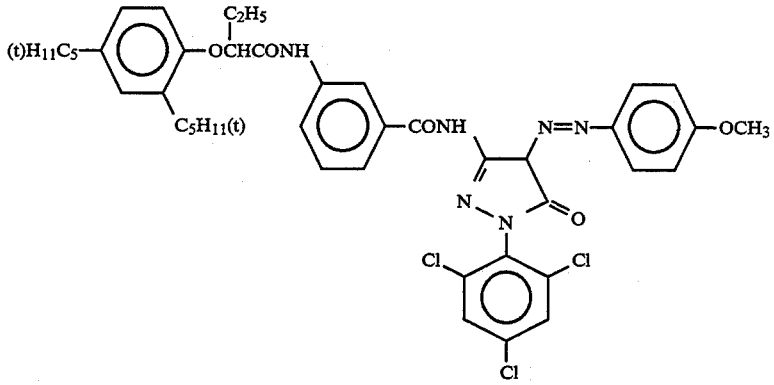
ExF-1:
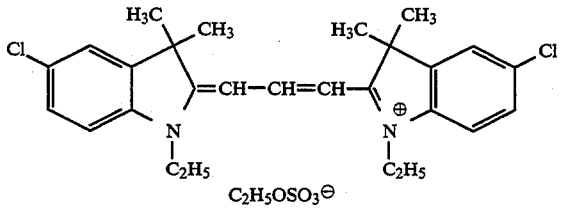
ExC-2:
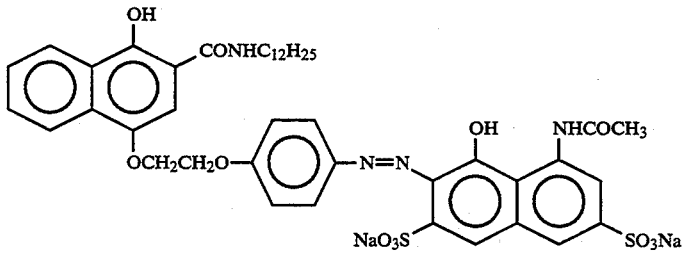
ExC-3:
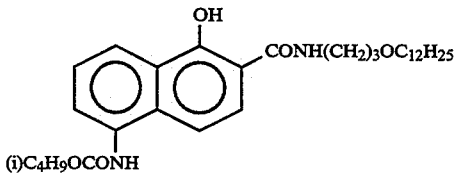
ExY-14:
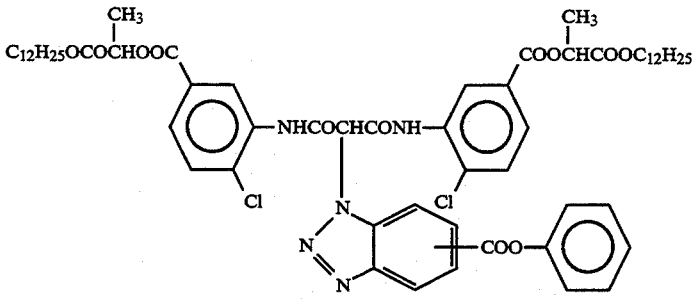
ExC-4:

-continued
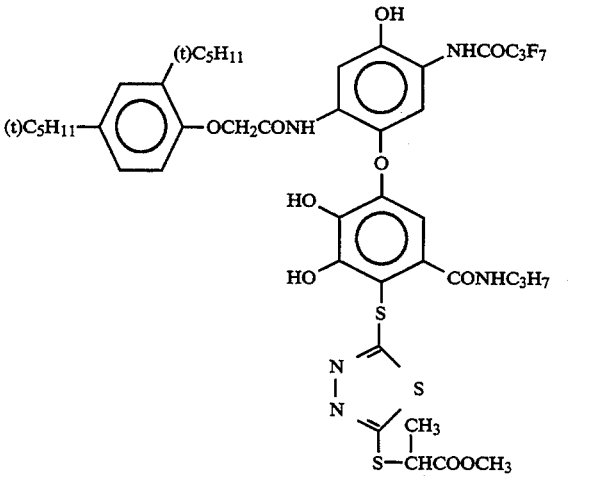
ExY-15:
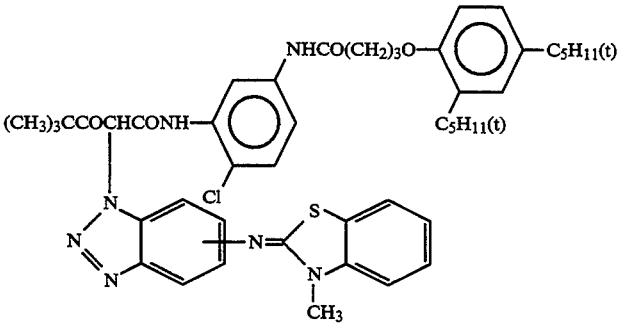
ExC-5:
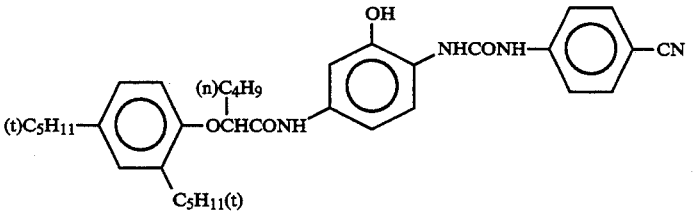
ExC-6:
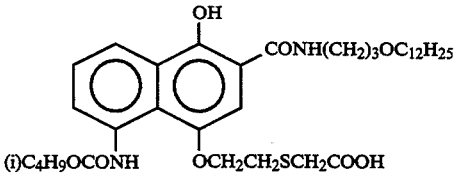
ExC-7:
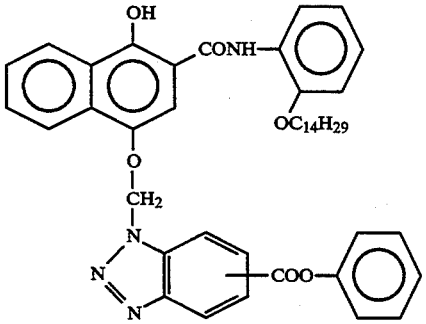
ExM-9:

-continued
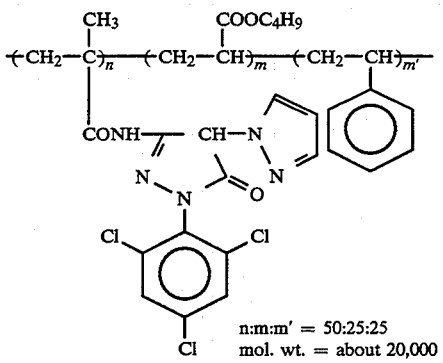
ExM-10:
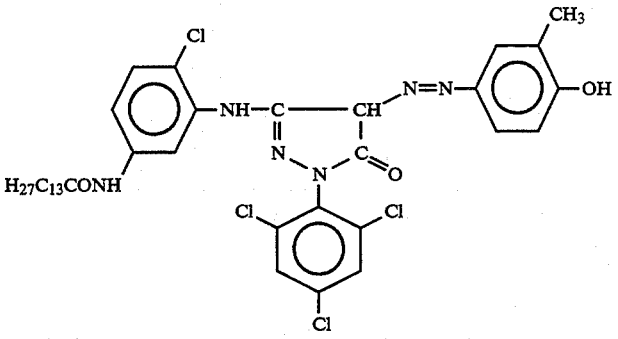
ExM-12:
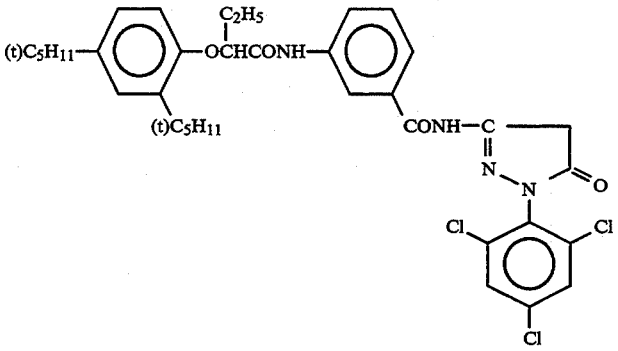
ExM-13:
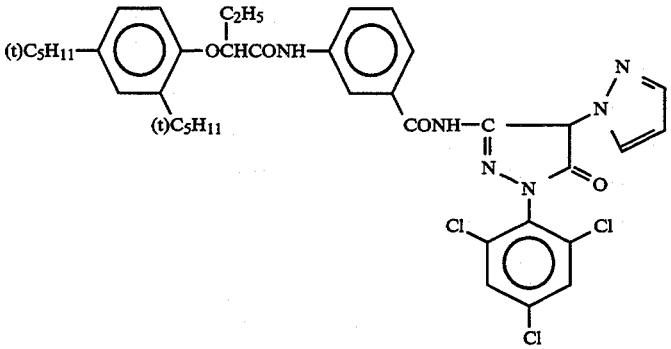
ExY-16:

-continued
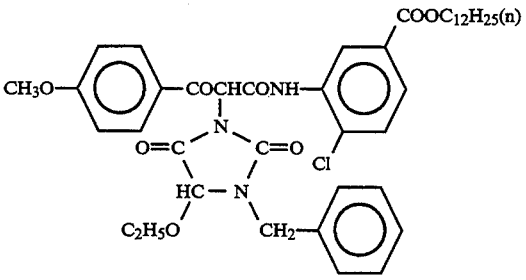
Cpd-1:
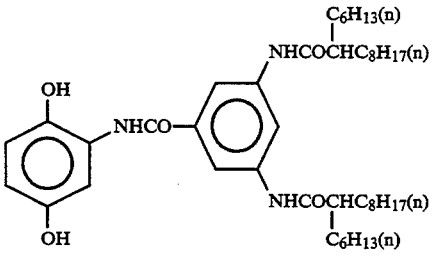
Cpd-2:
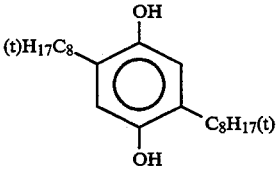
ExS-1:
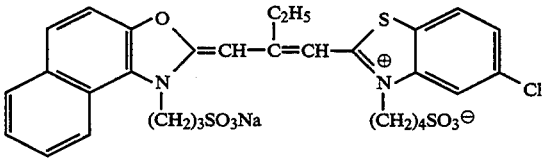
ExS-2:
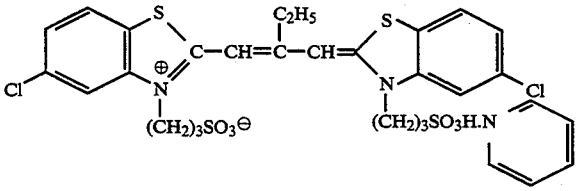
ExS-3:
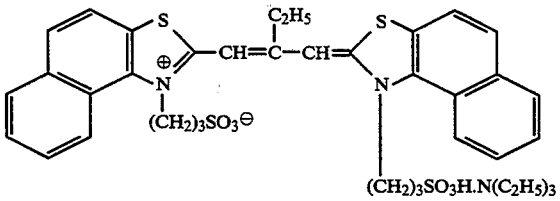
ExS-4:
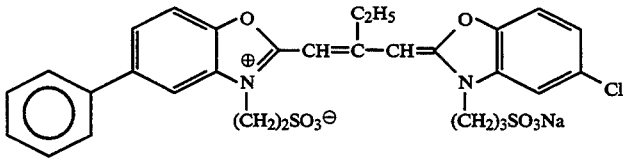
ExS-5:

-continued

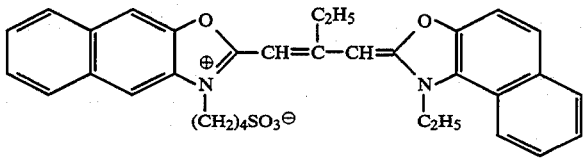

ExS-6:

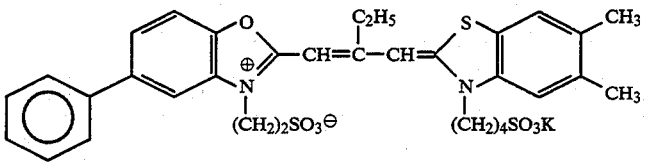

ExS-7:

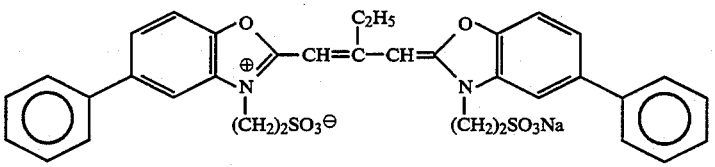

ExS-8:

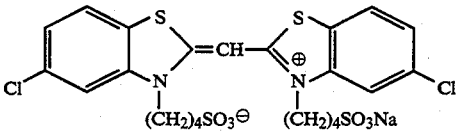

H-1:

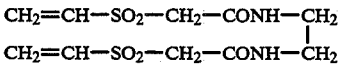

Cpd-3:

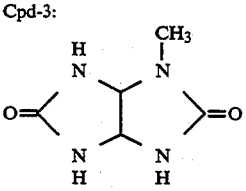

Cpd-4:

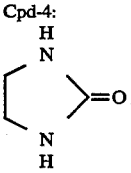

Cpd-5:

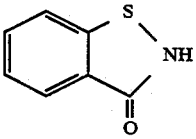

The total dry thickness of the all coated layers of the thus prepared Sample 101, excluding the support and the subbing layer, was 17.6 μm and the swelling speed ($T_{\frac{1}{2}}$) was 8 seconds.

The prepared sample was cut so as to have a width of 35 mm and subjected to black-and-white exposure. Then, the running processing was performed using an auto processor in accordance with the following procedure until the cumulated amount of the replenisher for the fixing solution became 3 times the tank volume of the mother liquor (i.e., tank solution).

| Processing Steps | | | | |
|---|---|---|---|---|
| Step | Time | Temperature (°C.) | Amount* Replenished (ml) | Tank Volume (l) |
| Color Development | 3 min 15 sec | 38 | 15 | 20 |

-continued

| Step | Time | Processing Steps Temperature (°C.) | Amount* Replenished (ml) | Tank Volume (l) |
|---|---|---|---|---|
| Bleaching | 4 min 30 sec | 38 | 10 | 40 |
| Washing | 2 min 10 sec | 35 | 10 | 20 |
| Fixing | 4 min 20 sec | 38 | (1) 30 ml or (2) 15 ml | 30 |
| Washing (1) | 1 min 05 sec | 35 | countercurrent piping from (2) to (1) | 10 |
| Washing (2) | 1 min 00 sec | 35 | 20 | 10 |
| Stabilization | 1 min 05 sec | 38 | 10 | 10 |
| Drying | 4 min 20 sec | 55 | — | — |

*per 1 meter long by 35 mm wide.

The composition of each processing solution used was described below.

| | Tank Solution | Replenisher |
|---|---|---|
| Color Developing Solution | | |
| Diethylenetriaminepentaacetic Acid | 1.0 g | 1.1 g |
| 1-Hydroxyethylidene-1,1-diphosphonic Acid | 3.0 g | 3.2 g |
| Sodium Sulfite | 4.0 g | 4.9 g |
| Potassium Carbonate | 30.0 g | 30.0 g |
| Potassium Bromide | 1.4 g | — |
| Potassium Iodide | 1.5 mg | — |
| Hydroxylamine Sulfate | 2.4 g | 3.6 g |
| 4-(N-Ethyl-N-β-hydroxyethylamino)-2-methylaniline Sulfate | 4.5 g | 7.2 g |
| Water to make | 1,000 ml | 1,000 ml |
| pH adjusted to | 10.05 | 10.10 |
| Bleaching Solution | | |
| Ammonium 1,3-propylenediaminetetraacetatoferrate(III) Monohydrate | 144.0 g | 206.0 g |
| Ammonium Bromide | 84.0 g | 120.0 g |
| Ammonium Nitrate | 30.0 g | 41.7 g |
| Acetic Acid (98 wt %) | 28.0 g | 40.0 g |
| Hydroxyacetic Acid | 63.0 g | 90.0 g |
| Water to make | 1,000 ml | 1,000 ml |
| pH (adjusted with 27 wt % aqueous ammonia) | 3.0 | 2.8 |
| Fixing Solution | | |
| Disodium Dthylenediaminetetraacetate | 0.5 g | 1.0 g |
| Sodium Sulfite | 7.0 g | 12.0 g |
| Sodium Hydrogensulfite | 5.0 g | 9.5 g |
| Fixing Agent: | | |
| 70 wt % Aqueous Solution of Ammonium Thiosulfate or | 170.0 ml | 240.0 ml |
| Fixing Agent Set Forth in Table 1 | 0.8 mol | 0.8 mol |
| Water to make | 1,000 ml | 1,000 ml |

-continued

| | Tank Solution | Replenisher |
|---|---|---|
| pH adjusted to | 6.7 | 6.7 |

Washing Solution (Tank solution=Replenisher)

City water was passed through a column of mixed-bed system in which H-type strong acid cation exchange resin (Amberlite IR-120B, produced by Rohm & Haas Co.) and OH-type anion exchange resin (Amberlite IR-400, produced by Rohm & Haas Co.) were charged, resulting in reduction of calcium and magnesium ion concentrations to 3 mg/liter or less. To the thus purified water were added 20 mg/liter of sodium dichloroisocyanurate and 1.5 g/liter of sodium sulfate. The pH of the solution was within the range of 6.5 to 7.5.

| | Tank Solution | Replenisher |
|---|---|---|
| Stabilizing Solution | | |
| Formaldehyde (37 wt % aq. soln.) | 2.0 ml | 3.0 ml |
| Polyoxyethylene-p-monononylphenylether (average polymerization degree: 10) | 0.3 g | 0.45 g |
| Disodium Ethylenediaminetetraacetate | 0.05 g | 0.08 g |
| Water to make | 1,000 ml | 1,000 ml |
| pH adjusted to | 5.0–8.0 | 5.0–8.0 |

After the conclusion of the running processing, samples of the same kind as used in the running processing were subjected to the same running processing as described above, except that the fixing time was shortened to 2 minutes and 3 minutes, respectively.

Each of the thus processed samples was examined for the amount of residual silver in the unexposed area using a fluorescent X-ray analyzer.

Further, the fixing bath and the washing bath (1) were examined by visual observation as to whether precipitates were generated or not. Further the processed samples after completion of the running processing were stored in thermal condition (i.e., the warm and humid condition) of 60° C. and 70% RH for 10 days, and then the minimum density (Dmin) of magenta before and after warming and humidifying was measured for the samples.

The results obtained are shown in Table 1. Therein, the evaluation marks regarding the absence or presence of precipitates in the processing baths represent the following situations, respectively:

G: No precipitate was observed by naked eye.

M: Small amounts of precipitates were observed.

B: Large amounts of precipitates were observed.

TABLE 1

| Fixing Agent | Amount Replenished (fixing bath) | Amount of Residual Silver (μg/cm²) 2 Minute Fixation | 3 Minute Fixation | Presence or Absence of Precipitates in Fixing Bath | Presence or Absence of Precipitates in Washing Bath | Variation of Minimum Density of Magenta before and after Warming and Humidifying (ΔDmin) | Note |
|---|---|---|---|---|---|---|---|
| Ammonium | (1) | 25 | 4.0 | M | M | +0.07 | Comparison |
| Thiosulfate | (2) | 35 | 8.5 | B | B | +0.09 | |
| Compound 1 | (1) | 20 | 1.2 | G | G | +0.03 | Invention |
| | (2) | 25 | 1.5 | G | G | +0.04 | |
| Compound 2 | (1) | 16 | 0.9 | G | G | +0.02 | Invention |
| | (2) | 19 | 1.2 | G | G | +0.03 | |

TABLE 1-continued

| Fixing Agent | Amount Replenished (fixing bath) | Amount of Residual Silver ($\mu g/cm^2$) 2 Minute Fixation | 3 Minute Fixation | Presence or Absence of Precipitates in Fixing Bath | Presence or Absence of Precipitates in Washing Bath | Variation of Minimum Density of Magenta before and after Warming and Humidifying (ΔDmin) | Note |
|---|---|---|---|---|---|---|---|
| Compound 5 | (1) | 20 | 1.2 | G | G | +0.03 | Invention |
| | (2) | 25 | 1.5 | G | G | +0.04 | |
| Compound 6 | (1) | 15 | 0.9 | G | G | +0.02 | Invention |
| | (2) | 21 | 1.2 | G | G | +0.03 | |
| Compound 23 | (1) | 21 | 1.3 | G | G | +0.03 | Invention |
| | (2) | 27 | 1.7 | G | G | +0.04 | |
| Compound 26 | (1) | 22 | 1.4 | G | G | +0.03 | Invention |
| | (2) | 24 | 1.8 | G | G | +0.04 | |

As is apparent from the results of Table 1, no precipitation was caused even by the running processing when the compounds of the present invention were used, that is to say, excellent solution stability was achieved by the use of the compounds of the present invention, and what is more, 3 minute fixation sufficed for the desilvering. Consequently, it is seen that the compounds of the present invention are superior to thiosulfates. Additionally, the effects were more remarkable when replenishment was reduced in quantity, and further it is seen that the generation of thermostains (i.e., the stain which is generated under the warm and humid condition) are less.

EXAMPLE 2

The same procedures as in Example 1 were repeated, except that Compounds 8, 11, 16, 17, 19 and 22 were used, respectively, in place of Compound 1. Thus, by analogy with Example 1, an excellent result that the fixing solutions of the present invention had high fixing ability and no precipitation occurred during the running processing was obtained and furhter, the thermostains are scarcely generated. In addition, the effects were remarkable particularly when the fixing solutions were replenished in the reduced amount.

EXAMPLE 3

On a paper support laminated with polyethylene on both sides were coated the layers described below to produce a multilayer color photographic paper. Coating solutions employed were prepared in the following manner.

Preparation of Coating Solution for First Layer:

A mixture of 19.1 g of a yellow coupler (ExY), 4.4 g of a color image stabilizer (Cpd-1) and 0.7 g of a color image stabilizer (Cpd-7) was dissolved in a mixed solvent consisting of 27.2 ml of ethyl acetate and 8.2 g of a solvent (Solv-1) and then dispersed in an emulsified condition into 185 ml of a 10% aqueous gelatin solution containing 8 ml of a 10% solution of sodium dodecylbenzenesulfonate. On the other hand, two kinds of silver chlorobromide emulsions (both of which had a crystal form of a cube; one of which had an average grain size of 0.88 $\mu$m and a variation coefficient af 0.08 with respect to the grain size distribution, and the other of which had an average grain size of 0.70 $\mu$m and a variation coefficient of 0.10 with respect to the grain size distribution; both of which contain 0.2 mol % of silver bromide in such a condition as to be localized at the grain surface) were prepared. The blue-sensitive sensitizing dyes illustrated below were added to the large grain size emulsion in the same amount of $2.0\times10^{-4}$mol per mol silver, and to the small grain size emulsion in the same amount of $2.5\times10^{-4}$ mol per mol of silver, and then they were subjected to sulfur sensitization. The resulting emulsions were mixed together in a ratio (the former emulsion to the latter one ) of 3:7 by mol (based on silver). The thus obtained emulsion was mixed homogeneously with the foregoing emulsified dispersion, and thereto were added other ingredients described below so as to obtain the coating solution for the first layer having the composition described below.

Coating solutions for the second to seventh layers were prepared respectioely in the same manner as that for the first layer. In each layer, the sodium salt of 1-oxy-3,5-dichloro-S-triazine was used as a hardener.

The spectral sensitizing dyes used in each layer are illustrated below.

Blue-sensitive Emulsion Layer:

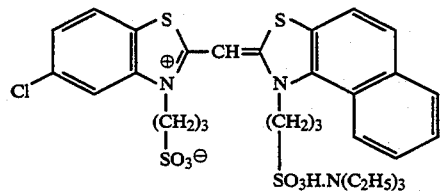

-continued

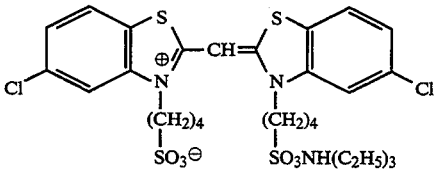

(both were added to the large grain size emulsion in an amount of $2.0 \times 10^{-4}$ mol/mol-Ag, and to the small grain size emulsion in an amount of $2.5 \times 10^{-4}$ mol/mol-Ag)

Green-sensitive Emulsion Layer:

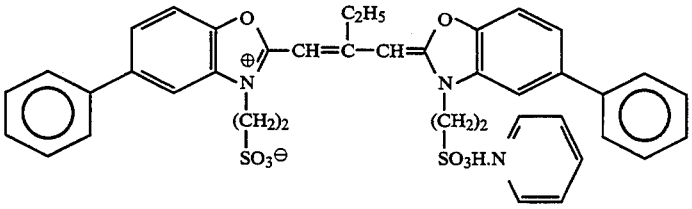

(which was added to the large grain size emulsion in an amount of $4.0 \times 10^{-4}$ mol/mol-Ag, and to the small grain size emulsion in an amount of $5.6 \times 10^{-4}$ mol/mol-Ag)

and

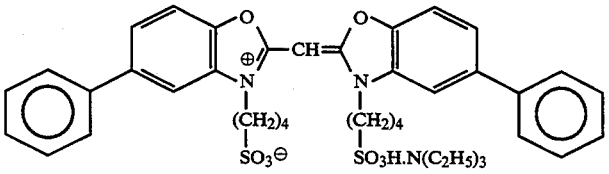

(which was added to the large grain size emulsion in an amount of $7.0 \times 10^{-5}$ mol/mol-Ag, and to the small grain size emulsion in an amount of $1.0 \times 10^{-5}$ mol/mol-Ag)

Red-sensitive Emulsion Layer:

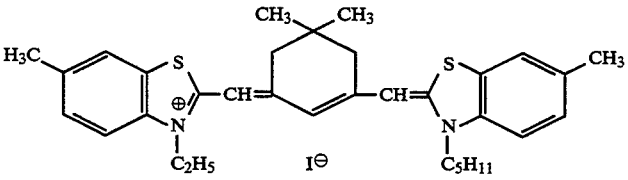

(which was added to the large grain size emulsion in an amount of $0.9 \times 10^{-4}$ mol/mol-Ag, and to the small grain size emulsion in an amount of $1.1 \times 10^{-4}$ mol/mol-Ag)

To the red-sensitive emulsion layer, the following compound was added in an amount of $2.6 \times 10^{-3}$ mol per mol of silver halide:

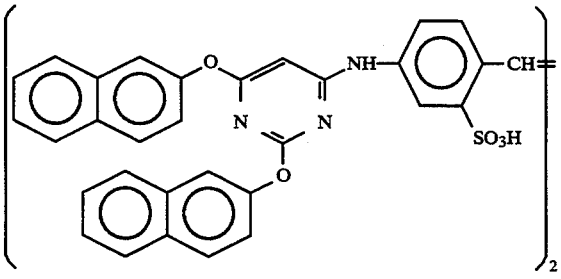

In addition, 1-(5-methylureidophenyl)-5-mercaptotetrazole was added to the blue-sensitive emulsion layer, the green-sensitive emulsion layer and the red-sensitive emulsion layer in amounts of $8.5 \times 10^{-5}$ mol, $7.7 \times 10^{-4}$ mol and $2.5 \times 10^{-4}$ mol, respectively, per mol of silver halide.

Moreover, 4-hydroxy-6-methyl-l,3,3a,7-tetraazaindene was added to the blue-sensitive emulsion layer and the green-sensitive layer in amounts of $1 \times 10^{-4}$ mol and $2 \times 10-4$ mol, respectively, per mol of silver halide.

For the purpose of preventing irradiation, the following dyes were added to each emulsion layers:

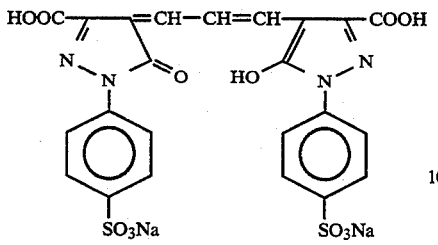

10 mg/m$^2$ and

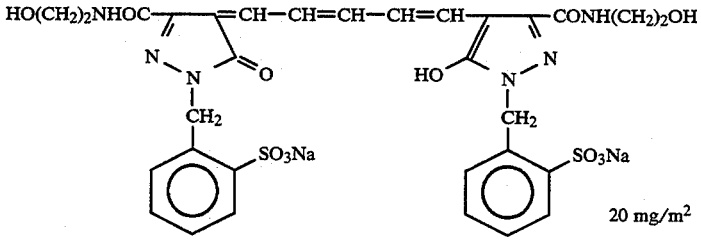

20 mg/m$^2$

The composition of each constituent layer is described below. Each figure on the right side represents a coverage (g/m$^2$) of the ingredient corresponding thereto. As the silver halide emulsion, the figure represents the coverage based on silver.

| | |
|---|---|
| Support: | |
| Polyethylene-laminated paper (which contained white pigment ($TiO_2$) and a bluish dye (ultramarine) in the polyethlene on the side of the first layer) | |
| First Layer (blue-sensitive layer) | |
| Silver Chlorobromide Emulsion (described above) | 0.30 |
| Gelatin | 1.86 |
| Yellow Coupler (ExY) | 0.82 |
| Color Image Stabilizer (Gpd-1) | 0.19 |
| Solvent (Solv-1) | 0.35 |
| Color Image Stabilizer (Cpd-7) | 0.06 |
| Second Layer (color stain inhibiting layer): | |
| Gelatin | 0.99 |
| Color Stain Inhibitor (Cpd-5) | 0.08 |
| Solvent (Solv-1) | 0.16 |
| Solvent (Solv-4) | 0.08 |
| Third Layer (green-sensitive layer): | |
| Silver Chlorobromide Emulsion (having a cubic crystal form, and being a 1:3 mixture of an emulsion having an average grain size of 0.55 μm and a variation coefficient of 0.10 with respect to grain size distribution with an emulsion having an average grain size of 0.39 μm and a variation coefficient of 0.08 with respect to grain size distribution, which each contained 0.8 mol % of AgBr in such a condition as to be localized at the grain surface) | 0.12 |
| Gelatin | 1.24 |
| Magenta Coupler (ExM) | 0.20 |
| Color Image Stabilizer (Cpd-2) | 0.03 |
| Color Image Stabilizer (Cpd-3) | 0.15 |
| Color Image Stabilizer (Cpd-4) | 0.02 |
| Color Image Stabilizer (Cpd-9) | 0.02 |
| Solvent (Solv-2) | 0.40 |
| Fourth Layer (ultraviolet absorbing layer): | |
| Gelatin | 1.58 |
| Ultraviolet Absorbent (UV-1) | 0.47 |
| Color Stain Inhibitor (Cpd-5) | 0.05 |
| Solvent (Solv-5) | 0.24 |
| Fifth Layer (red-sensitive layer): | |
| Silver Chlorobromide Emulsion (having a cubic crystal form, and being a 1:4 mixture of an emulsion having an average grain size of 0.58 μm and a variation coefficient of 0.09 with respect to grain size distribution with an emulsion having an average grain size of 0.45 μm and a variation coefficient of 0.11 with respect to grain size distribution, which each contained 0.6 mol % of AgBr in such a condition as to be localized at the grain surface) | 0.23 |
| Gelatin | 1.34 |
| Cyan Coupler (ExC) | 0.32 |
| Color Image Stabilizer (Cpd-6) | 0.17 |
| Color Image Stabilizer (Cpd-7) | 0.40 |
| Color Image Stabilizer (Cpd-8) | 0.04 |
| Solvent (Solv-6) | 0.15 |

-continued

| | |
|---|---|
| Sixth Layer (ultraviolet absorbing layer): | |
| Gelatin | 0.53 |
| Ultraviolet Absorbent (UV-1) | 0.16 |
| Color Stain Inhibitor (Cpd-5) | 0.02 |
| Solvent (Solv-5) | 0.08 |
| Seventh Layer (protective layer): | |
| Gelatin | 1.33 |
| Acryl-Modified Polyvinyl Alcohol (modification degree: 17%) | 0.17 |
| Liquid Paraffin | 0.03 |

(ExY) Yellow Coupler

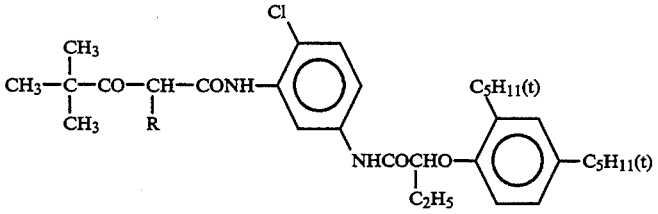

1:1 (by mole) mixture of that of R =

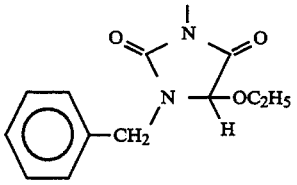

with that of R =

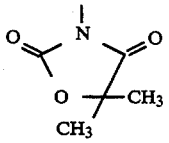

(ExM) Magenta Coupler

1:1 (by mole) mixture of

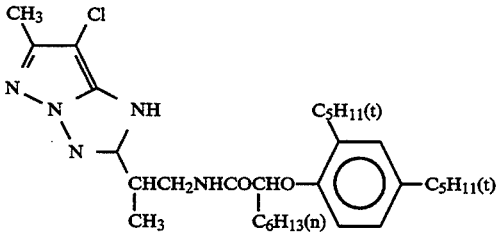

with

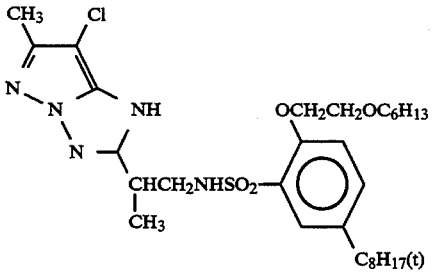

(ExC) Cyan Coupler

-continued
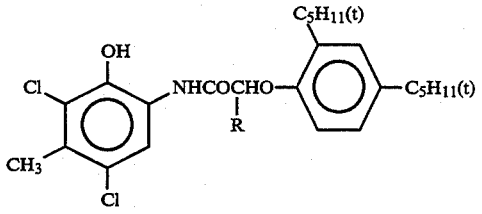
2:4:4 (by weight) mixture of that of R = $C_2H_5$, that of R = $C_4H_9$ and that of R =
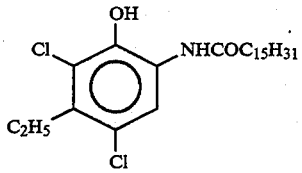
(Cpd-1) Color Image Stabilizer
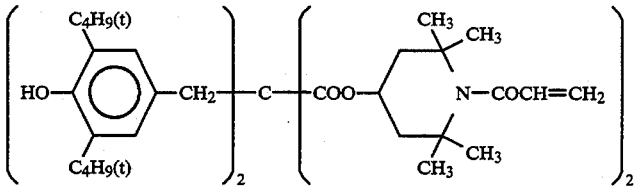
(Cpd-2) Color Image Stabilizer
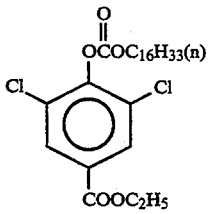
(Cpd-3) Color Image Stabilizer
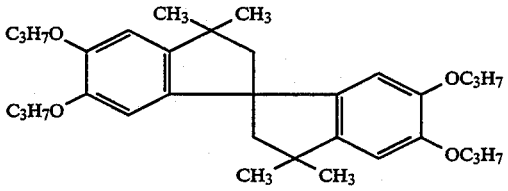
(Cpd-4) Color Image Stabilizer
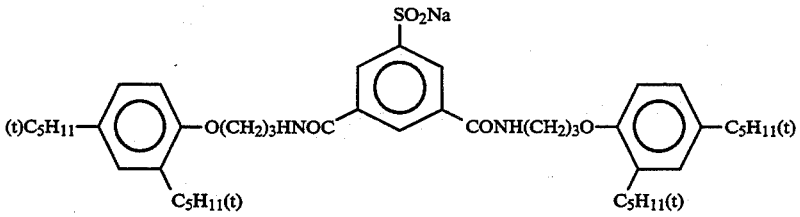
(Cpd-5) Color Stain Inhibitor -continued
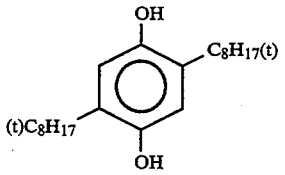
(Cpd-6) Color Image Stabilizer)
2;4:4 (by weight) mixture of
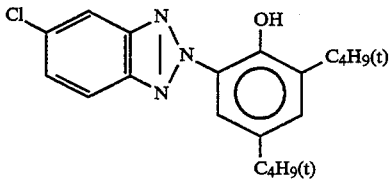
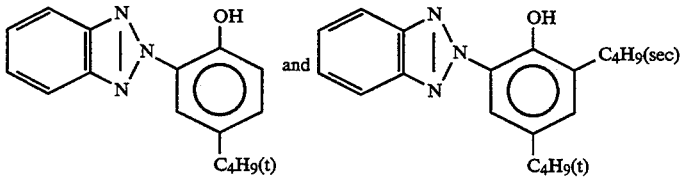
(Cpd-7) Color Image Stabilizer
$-(CH_2-CH)-$
$CONHC_4H_9(t)$
average molecular weight: 60,000
(Cpd-8) Color Image Stabilizer
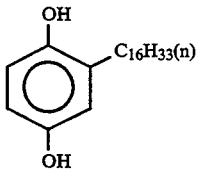
(Cpd-9) Color Image Stabilizer
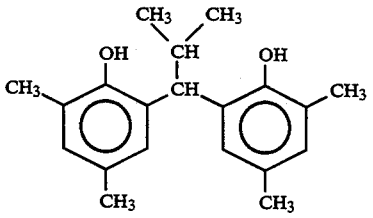
(UV-1) Ultraviolet Absorbent
4:2:4 (by weight) mixture of
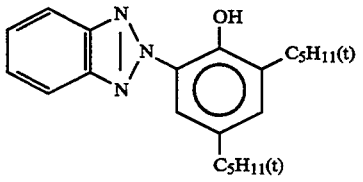

-continued

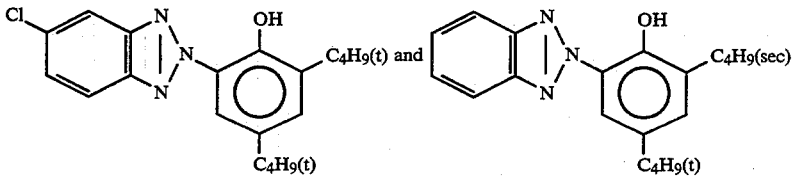

(Solv-1) Solvent

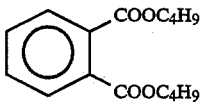

(Solv-2) Solvent

2:1 (by volume) mixture of

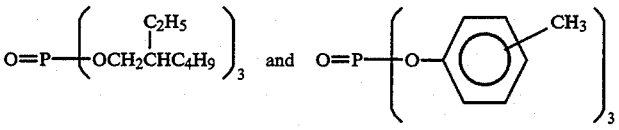

(Solv-4) Solvent

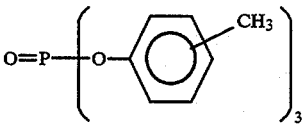

(Solv-5) Solvent

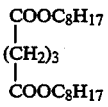

(Solv-6) Solvent

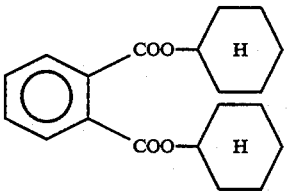

The foregoing photosensitive material was subjected to black-and-white exposure, and then a continuous processing (running test) was performed using a paper processor in accordance with the following procedure until the amount of the replenisher used in the bleach-fixing step became twice the volume of the tank used.

| Processing Step | Temperature (°C.) | Time (sec) | Amount* Replenished (ml) | Tank Volume (l) |
|---|---|---|---|---|
| Color Development | 35 | 45 | 161 | 17 |
| Bleach-Fixing | 35 | 45 | (1) 61 ml or (2) 30 ml | 17 |
| Rinsing (1) | 35 | 30 | — | 10 |
| Rinsing (2) | 35 | 30 | — | 10 |
| Rinsing (3) | 35 | 30 | 300 | — |
| Drying | 80 | 60 | — | — |

*per $m^2$ of photosensitive material

The bleach-fixing solution was replenished by both the replenisher and 121 ml af the rinsing solution (1).

The rinsing step was carried out accarding to 3-stage countercurrent process in the direction of from the tank 3 to the tank 1.

The composition of each processing solution used was described below.

| | Tank Solution | Replenisher |
|---|---|---|
| Color Developer: | | |
| Water | 800 ml | 800 ml |
| Ethylenediamine-N,N,N,N-tetramethylenephosphonic Acid | 3.0 g | 3.0 g |
| Triethanolamine | 5.0 g | 5.0 g |
| Potassium Chloride | 3.1 g | — |
| Potassium Bromide | 0.015 g | — |
| Potassium Carbonate | 25 g | 25 g |
| Hydrazinodiacetic Acid | 5.0 g | 7.0 g |

-continued

| | | |
|---|---|---|
| N-Ethyl-N-(β-methanesulfonamidoethyl)-3-methyl-4-aminoaniline Sulfate | 5.0 g | 9.5 g |
| Brightening Agent (WHITEX-4, produced by Sumitomo Chemical Co., Ltd.) | 1.0 g | 2.5 g |
| Water to make | 1,000 ml | 1,000 ml |
| pH (adjusted with KOH) | 10.05 | 10.45 |

| | Tank Solution | Replenisher (1) | Replenisher (2) |
|---|---|---|---|
| Bleach-Fixing Solution: | | | |
| Water | 600 ml | 150 ml | 150 ml |
| Ammonium Thiosulfate (70 wt % aq. soln.) or | 100 ml | 245 ml | 245 ml |
| Compound of the Present Invention | 0.4 mol | 1.0 mol | 1.0 mol |
| Ammonium Sulfite | 45 g | 105 g | 105 g |
| Ammonium Ethylenediaminetetraacetatoferrate(III) | 55 g | 135 g | 135 g |
| Ethylenediaminetetraacetic Acid | 3.0 g | 8.0 g | 8.0 g |
| Ammonium Bromide | 30 g | 75 g | 150 g |
| Nitric Acid (67 wt % aq. soln.) | 27 g | 68 g | 100 g |
| Water to make | 1,000 ml | 1,000 ml | 1,000 ml |
| pH adjusted to | 5.80 | 5.60 | 5.40 |

Rinsing Bath (Tank solution=Replenisher):

The ion exchange water contained calcium and magnesium ion concentrations which were 3 ppm or less.

The processed samples after completion of the running processing were stored in thermal condition (i.e., the warm and humid condition) of 60° C. and 70% RH for 10 days, the minimum density (Dmin) of magenta before and after warming and humidifying was measured for the samples. Further, the processed samples were measured by using the fluorescent X-ray analyzer with respect to the residual silver amount at the unexposed portion.

After the conclusion of the running processing, the bleach-fixing bath and the rinsing bath (1) were examined by visual observation as to whether precipitates were generated or not.

Further, the bleach-fixing solution in which Compound A or B (see Comparative Compounds A and B) described in U.S. Pat. No. 2,748,000 was used in the same amount as that of the compound of the present invention, potassium ferricyanide was used as a bleaching agent and ammonium ethylenediaminetetraacetatoferrate(III) was used as a bleach-fixing agent, was compared.

Comparative Compound A:

$$HOOCCH_2SCH_2CH_2SCH_2COOH$$

Comparative Compound B:

$$HOOCCH_2S(CH_2CH_2S)_2CH_2COOH$$

The results obtained are shown in Table 2. Therein, the evaluation marks regarding the absence or presence of precipitates in the processing baths represent the following situations, respectively:

G: No precipitate was observed by naked eye.

M: Small amounts of precipitates were observed.

B: Large amounts of precipitates were observed.

BB: Extremely large amounts of precipitates were observed.

TABLE 2

| Fixing Agent | Residual Silver Amount (μg/cm²) | Amount Replenished (fixing bath) | Presence or Absence of Precipitates in Fixing Bath | Presence or Absence of Precipitates in Washing Bath | Variation of Minimum Density of Magenta before and after Warming and Humidifying (ΔDmin) | Note |
|---|---|---|---|---|---|---|
| Ammonium | 0.4 | (1) | M | B | +0.03 | Comparison |
| Thiosulfate | 0.7 | (2) | B | BB | +0.05 | |
| Compound 1 | 0.4 | (1) | G | G | ±0 | Invention |
| | 0.5 | (2) | G | G | ±0 | |
| Compound 2 | 0.3 | (1) | G | G | ±0 | Invention |
| | 0.4 | (2) | G | G | ±0 | |
| Compound 5 | 0.4 | (1) | G | G | ±0 | Invention |
| | 0.5 | (2) | G | G | ±0 | |
| Compound 6 | 0.3 | (1) | G | G | ±0 | Invention |
| | 0.4 | (2) | G | G | ±0 | |
| Compound 9 | 0.4 | (1) | G | G | ±0 | Invention |
| | 0.6 | (2) | G | G | ±0 | |
| Comparative | 3.1 | (1) | G | G | +0.09 | Comparison |
| Compound A | 5.7 | (2) | G | G | +0.10 | |
| Comparative | 2.9 | (1) | G | G | +0.08 | Comparison |
| Compound B | 5.5 | (2) | G | G | +0.10 | |

As is apparent from the results of Table 2, no precipitation was caused even by the running processing when the compounds of the present invention were substituted for thiosulfates as fixing agent, that is to say, excellent solution stability was achieved by the use of the compounds of the present invention. Additionally, the effects were more remarkable when replenishment was reduced in quantity. Further, when the bleach-fixing solution described in U.S. Pat. No. 2,748,000 was used, excellent solution stability was obtained but the residual silver amount and thermostains were increased, which made worse as compared with the present invention.

EXAMPLE 4

The same procedures as in Example 3 were repeated, except that Compounds 4, 15, 25, 28, 33, 34, 35, 36, 37, 38 and 39 were used, respectively, in place of Compound 1. Thus, by analogy with Example 3, an excellent result that no precipitation occurred during the running processing and residual silver amount and thermostains were not increased was obtained. In addition, the effect was remarkable particularly when the bleach-fixing bath was replenished in the reduced amount.

EXAMPLE 5

Preparation of Emulsion:

To one liter of water placed in a vessel were added 30 g of gelatin and 6 g of potassium bromide. The resulting solution was kept at 60° C. with stirring. Thereto, an aqueous solution containing 5 g of silver nitrate and an aqueous potassium bromide solution containing 0.15 g of potassium iodide were added in a 1 minute period according to a double jet method. Further, an aqueous solution containing 145 g of silver nitrate and an aqueous potassium bromide solution containing 4.2 g of potassium iodide were added in accordance with a double jet method, in which the addition was accelerated so that the flow rate at the conclusion of the addition might be increased to 5 times that at the beginning of the addition. The thus prepared emulsion was cooled to 35° C. and therefrom soluble salts were removed by the flocculation method. Then, the resulting emulsion was warmed to 40° C. and thereto was added 75 g of gelatin. Furthermore, the emulsion was adjusted to pH 6.7. The thus obtained emulsion grains were tabular grains having a projected area diameter of 0.98 μm, an average thickness of 0.138 μm and an iodide content of 3 mol %. Th emulsion was sensitized chemically by the combined use of gold and sulfur sensitization methods.

Preparation of Photographic Material:

As a coating composition for the surface protecting layer an aqueous gelatin solution was used, that solution containing, in additign to gelatin, polyacrylamide having an average molecular weight of 8,000, sodium polystyrenesulfonate, fine particles of polymethyl methacrylate (average size: 3.0 μm), polyethylene oxide, a hardener and so on.

To the foregoing emulsion were added 500 mg/mol-Ag of sodium salt of anhydro-5,5'-dichloro-9-ethyl-3,3'-di(3-sulfopropyl)oxacarbocyanine hydroxide (as a sensitizing dye) and 200 mg/mol-Ag of potassium iodide. Thereto were furthermore added 4-hydroxy-6-methyl-1,3,3a,7-tetraazaindene, 2,6-bis(hydroxyamino)-4-diethylamino-1,3,5-triazine (as stabilizers), trimethylolpropane as a drying mark inhibitor, coating aids and a hardener. Thus, a photosensitive coating composition was prepared. The photosensitive coating composition and the surface protecting composition described above were coated simultaneously on both sides of a polyethylene terephthalate support and dried to prepare a photographic material. A silver coverage of the material was 2 g/m$^2$ per each side. A swelling degree obeying to the foregoing definition was 180%.

The photosensitive material was exposed to X-rays by 50% and processed with the following developing, fixing and washing solutions.

| Photographic Processing Step | | | | |
|---|---|---|---|---|
| Step | Time (sec) | Temperature (°C.) | Amount Replenished* | Tank Volume (l) |
| Development | 13.7 | 35 | 20 ml of developing solution + 10 ml of diluting solution (i.e., water) | 15 |
| Fixing | 12.5 | 32 | (1) 10 ml of fixing solution + 30 ml of diluting solution (i.e., water) (2) 5 ml of fixing solution + 15 ml of diluting solution (i.e., water) | 15 |
| Washing | 6.2 | 20 | 500 ml | 10 |
| Cleaning tank equipped with squeegee rollers | | | | 200 ml |

| | Tank Solution | Replenisher |
|---|---|---|
| Developing Solution | | |
| Potassium Hydroxide | 24 g | 60 g |
| Sodium Sulfite | 40 g | 100 g |
| Potassium Sulfite | 50 g | 125 g |
| Diethylenetriaminepentaacetic Acid | 2.4 g | 6 g |
| Boric Acid | 10 g | 25 g |
| Hydroquinone | 35 g | 87.5 g |
| Diethylene Glycol | 11.2 g | 28 g |
| 4-Hydroxymethyl-4-methyl-1-phenyl-3-pyrazolidone | 2.5 g | 6.25 g |
| 5-Methylbenzotriazole | 0.06 g | 0.15 g |
| pH adjusted to | 10.05 | 11.00 |

| | Tank Solution | Replenisher (1) | Replenisher (2) |
|---|---|---|---|
| Fixing Solution: | | | |
| Fixing Agent | | | |
| Ammonium Thiosulfate | 140 g | 560 g | 560 g |
| or | | | |
| Compound of the Present Invention | 1 mol | 4 mol | 4 mol |
| Sodium Sulfite | 15 g | 60 g | 60 g |
| Disodium Ethylenediaminetetraacetate Dihydrate | 0.025 g | 0.1 g | 0.1 g |
| Sodium Hydroxide | 6 g | 24 g | 48 g |
| pH adjusted to | 5.5 | 5.10 | 4.70 |

| | Tank Solution | Replenisher |
|---|---|---|
| Washing Solution | | |
| Disodium Ethylenediaminetetraacetate Dihydrate | 0.5 g | 0.5 g |

*Per one sheet of the photosensitive material measuring 10 inch × 12 inch (size of JP(10 × 12)).

Such a running processing as to process continuously 50 sheets of the JP(10×12)-size photosensitive material per day (development rate of one sheet of film: 40%) was carried out day after day until a cumulated amount of the replenisher for the fixing solution became 3 times the tank volume of the mother liquor (tank solution).

A volume of the developing solution forced to circulate with stirring was set to 20 liter/min while the developing solution was being used for the development processing of the photosensitive material, but on the other hand, to 6 liter/min when the developing solution was on standby.

After the conclusion of the running processing, samples of the same kind as used in the running processing were subjected to the same running processing as described above, except that the fixing time was shortened to 10.5 seconds and 11.5 seconds, respectively.

Each of the thus processed samples was examined for the amount of residual silver in the unexposed area using a fluorescent X-ray analyzer.

Further, the fixing bath was examined by visual observation as to whether precipitates were generated or not. The evaluation was carried out in the same manner as in Example 3.

The results obtained are shown in Table 3.

TABLE 3

| Fixing Agent | Replenished (fixing bath) | 10.5 Second Fixation | 11.5 Second Fixation | Presence or Absence of Precipitates in Fixing Bath | Note |
|---|---|---|---|---|---|
| Ammonium | (1) | 10.3 | 3.2 | B | Comparison |
| Thiosulfate | (2) | 15.5 | 5.1 | BB | |
| Compound 1 | (1) | 7.0 | 1.0 | G | Invention |
| | (2) | 7.5 | 1.1 | G | |
| Compound 2 | (1) | 5.5 | 0.9 | G | Invention |
| | (2) | 6.0 | 0.9 | G | |
| Compound 5 | (1) | 6.8 | 1.2 | G | Invention |
| | (2) | 7.2 | 1.4 | G | |
| Compound 6 | (1) | 5.6 | 0.8 | G | Invention |
| | (2) | 6.0 | 0.9 | G | |

As is apparent from the results of Table 3, no precipitation was caused even by the running processing when the compounds of the present invention were used, that is to say, excellent solution stability was achieved by the use of the compounds of the present invention, and what is more, 11.5 second fixation sufficed for the desilvering. Consequently, it is seen that the compounds of the present invention are superior to thiosulfates. Additionally, the effects were more remarkable when replenishment was reduced in quantity.

EXAMPLE 6

The same procedures as in Example 1 were repeated, except that Compounds 8, 12, 18 and 20 were used, respectively, in place of Compound 1. Thus, by analogy with Example 5 an excellent result that the fixing solutions of the present invention had high fixing ability and no precipitation occurred during the running processing was obtained. In addition, the effects were remarkable particularly when the fixing solutions were replenished in the reduced amount.

EXAMPLE 7

Preparation of Light-sensitive Emulsion:

To an aqueous gelatin solution kept at 50° C., an aqueous solution of silver nitrate and an aqueous solution containing potassium iodide and potassium bromide were added simultaneously in the presence of $4\times10^{-7}$ mol/mol-Ag of iridium(III) chloride and ammonia over a 60 minute period as the pAg of the reaction system was kept at 7.8. Thus, a monodispersed cubic silver iodobromide emulsion having an average grain size of 0.28 μm and an average iodide cantent of 0.3 mol % was prepared. From the emulsion were removed soluble salts by a flocculation method, and thereto was added inert gelatin in an amount of 40 g per mol of silver. Thereafter, the emulsion was kept at 50° C. and thereto were added 5,5'-dichloro-9-ethyl-3,3'-bis(3-sulfopropyl-)oxacarbocyanine as a sensitizing dye and $1\times10^{-3}$ mol/mol-Ag of KI in the form of an aqueous solution. The resulting emulsion was allowed to stand for 15 minutes. Then, the temperature of the emulsion was lowered.

Coating of Light-sensitive Emulsion:

The emulsion obtained was fused again and kept at 40° C. Thereto were added $7.1\times10^{-5}$ mol/mol-Ag of the hydrazine derivative illustrated below,

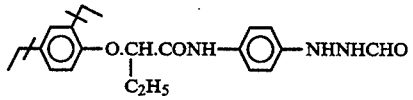

one of thioether compounds set forth in Table 4, which are represented by formula (I) of the present invention, and further 5-methylbenzotriazole, 4-hydroxy-1,3,3a,7-tetraazaindene, Compounds (a) and (b) illustrated below, polyethyl acrylate in a proportion of 30 wt % to gelatin and Compound (c) as a gelatin hardener. The thus obtained composition was coated at a silver coverage of 3.4 g/m²on a 150 μm thick polyethylene terephthalate film provided with a 0.5 μm thick subbing layer of vinylidene chloride copolymer.

Compound (a)

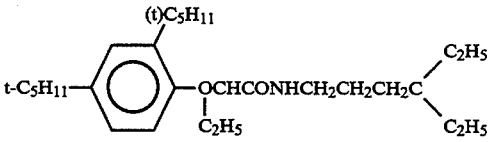

3.5 mg/m²

Compound (b)

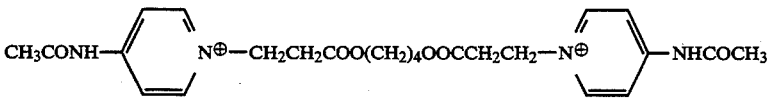

15.0 mg/m²

Compound (c)

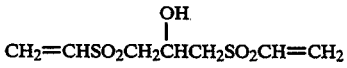

2.0 wt % on the gelatin

Coating of Protective Layer:

On the light-sensitive emulsion layer, 1.5 g/m$^2$ of gelatin, 0.3 g/m$^2$ of polymethyl methacrylate particles (average size: 2.5 μm) and 0.3 g/m$^2$, based on silver, of AgCl fine grains were coated with the aid of the following surface active agents to form a protective layer.

Surface Active Agents:

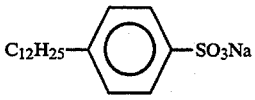

$C_{12}H_{25}$—C$_6$H$_4$—$SO_3Na$ 37 mg/m$^2$ $CH_2COOC_6H_{13}$
|
$CHCOOC_6H_{13}$
|
$SO_3Na$ 37 mg/m$^2$ $C_8F_{17}SO_2N(C_3H_7)CH_2COOK$ 2.5 mg/m$^2$

The thus obtained samples each was cut into sheet films measuring 50.8 cm by 61.0 cm. 200 sheets per each sample were subjected to 50% blacking exposure with a tungsten lamp of 3,200° K. and then processed according to the prescription described below.

| Processing Steps | | | |
|---|---|---|---|
| Step | Time (sec) | Temperature (°C.) | Amount Replenished (ml) |
| Development | 30 | 34 | 240 |
| Fixing | 30 | 34 | (1) 390<br>(2) 250 |
| Washing | 30 | 20 | 2,000 |

Therein, the amount replenished was expressed in ml per m$^2$ of the photosensitive material.

| Composition of Developing Solution (mother liquor = replenisher) | |
|---|---|
| Hydroquinone | 50.0 g |
| N-Methyl-p-aminophenol | 0.3 g |
| Sodium Hydroxide | 18.0 g |
| Boric Acid | 20.0 g |
| Potassium Sulfite | 110.0 g |
| Disodium Ethylehediaminetetraacetate | 1.0 g |
| Potassium Bromide | 10.0 g |
| 5-Methylbenzotriazole | 0.4 g |
| 5-Mercaptobenzimidazole-5-sulfonic Acid | 0.3 g |
| Sodium 3-(5-mercaptotetrazole)-benzenesulfonate | 0.2 g |
| 6-Dimethylamino-1-hexanol | 4.0 g |
| Sodium p-toluenesulfonate | 15.0 g |
| 5-Sulfosalicylic Acid | 30.0 g |
| Water to make | 1 liter |
| pH adjusted with KOH | 11.7 |
| **Composition of Fixing Solution (mother liquor = replenisher)** | |
| Ammonium Thiosulfate, or | 190.0 g |
| Compound of the Present Invention | 1 mol |
| Sodium Sulfite | 22.0 g |
| Disodium Ethylenediaminetetraacetate | 0.1 g |
| Tartaric Acid | 3.0 g |
| Aqueous ammonia (27 wt % aq. soln.) | 10.0 g |
| Acetic Acid (90 wt % aq. soln.) | 30.0 g |
| Aluminum Sulfate (27 wt % aq. soln.) | 35.0 g |
| Water to make | 1 liter |
| pH adjusted with NaOH | 4.8 |

After a series of the continuous photographic processing described above, the fixing solution was examined by visual observatian as to whether precipitates were generated or not.

Further, each sample sheet processed just before the conclusion of a series of the processing was examined for the amount of residual silver in the unexposed area using a fluorescent X-ray analyzer.

The evaluation was carried out in the same manner as in Example 3.

The results obtained are shown in Table 4.

TABLE 4

| Fixing Agent | Amount Replenished (fixing bath) | Amount of Residual Silver (μg/cm$^2$) | Presence or Absence of Precipitates in Fixing Bath | Note |
|---|---|---|---|---|
| Ammonium Thiosulfate | (1) | 0.9 | M | Comparison |
| | (2) | 3.5 | B | |
| Compound 1 | (1) | 0.8 | G | Invention |
| | (2) | 1.0 | G | |
| Compound 2 | (1) | 0.6 | G | Invention |
| | (2) | 0.8 | G | |
| Compound 5 | (1) | 0.7 | G | Invention |
| | (2) | 1.3 | G | |
| Compound 6 | (1) | 0.6 | G | Invention |
| | (2) | 1.0 | G | |

As is apparent from the results of Table 4, when the compounds of the present invention were used, excellent fixability was obtained and no precipitation was caused even by the processing of a large quantity of sheet films. Thus, excellent solution stability was achieved by the use of the compounds of the present invention. Additionally, the effects were more remarkable when replenishment was reduced in quantity.

EXAMPLE 8

The same procedures as in Example 7 were repeated, except that Compounds 10, 13, 15 and 23 were used, respectively, in place of Compound 1. Thus, by analogy with Example 7, an excellent result that fix-ability acquired was high and no precipitation occurred during the running processing was obtained. In addition, the effect was remarkable particularly when the fixing bath was replenished in the reduced amount.

EXAMPLE 9

A silver chloroiodobromide emulsion (bromide content: 30 mol %, iodide content: 0.1 mol %) was prepared in a process comprising precipitating silver halide grains in accordance with a double jet method, ripening the grains physically, removing soluble salts therefrom and ripening the grains chemically. An average diameter of the silver halide grains contained in the emulsion was 0.3 μm. In a 1 kg portion of the emulsion, 0.6 mol of silver halide was contained.

Several separate portions of 1 kg of the emulsion were weighted out and melted by heating up to 40° C. Thereto were added a methanol solution of a sensitizing dye and an aqueous solution of sodium bromide in the respective prescribed amounts. Further, 25 ml of a 1.0 wt % methanol solution of dye, 30 ml of a 1.0 wt % aqueous solution of sodium 1-hydroxy-3,5-dichlorotriazine and 40 ml of a 1.0 wt % aqueous solution of sodium dodecylbenzenesulfonate were added and the resulting emulsion was stirred. The thus finished emulsion was coated and dried on a cellulose triacetate film base so as to have a dry thickness af 5 μm. The thus obtained samples of the photosensitive material ware cut and subjected to 50% blacking exposure with a sensitometer having a color temperature of 2,666° K. Then, the running processing was carried out in accordance with the processing prescription described below until a cumulated amount of the replenisher for the fixing solution became 3 times the volume of the mother liquor (tank solution).

| Step | Time (sec) | Processing Steps Temperature (°C.) | Amount Replenished (ml) | Tank Volume (l) |
|---|---|---|---|---|
| Development | 20 | 38 | 320 | 18 |
| Fixing | 20 | 38 | (1) 320<br>(2) 220 | 18 |
| Washing | 20 | 20 | 2,000 | 18 |

Therein, the amount replenished was expressed in ml per $m^2$ of the photosensitive material.

| Composition of Developing Solution (mother liquor = replenisher) | |
|---|---|
| Metol | 0.31 g |
| Anhydrous Sodium Sulfite | 39.6 g |
| Hydroquinone | 6.0 g |
| Anhydrous Sodium Carbonate | 18.7 g |
| Potassium Bromide | 0.86 g |
| Citric Acid | 0.68 g |
| Potassium Metabisulfite | 1.5 g |
| Water to make | 1 liter |
| **Composition of Fixing Solution (mother liquor = replenisher)** | |
| Ammonium thiosulfate, | 200 g |
| or | |
| Compound of the Present Invention | 1 mol |
| Sodium Hydrogensulfite | 12.0 g |
| Disodium Ethylenediaminetetraacetate | 0.1 g |
| Tartaric Acid | 3.0 g |
| Aqueous ammonia (27 wt % aq. soln.) | 7.0 g |
| Acetic Acid (90 wt % aq. soln.) | 20.0 g |
| Aluminum Sulfate (27 wt % aq. soln.) | 35.0 g |
| Water to make | 1 liter |

The pH of the fixing solution (1) was adjusted to 4.2 by the addition of NaOH, while that of the fixing solution (2) to 4.0.

After the running processing, the fixing solution was examined by visual observation as to whether precipitates were generated or not.

Further, each sample sheet processed just before the conclusion of the processing was examined for the amount of residual silver in the unexposed area using a fluorescent X-ray analyzer. The evaluation was carried out in the same manner as in Example 3.

The results obtained are shown in Table 5.

TABLE 5

| Fixing Agent | Amount Replenished (fixing bath) | Amount of Residual Silver ($\mu g/cm^2$) | Presence or Absence of Precipitates in Fixing Bath | Note |
|---|---|---|---|---|
| Ammonium | (1) | 0.8 | M | Comparison |
| Thiosulfate | (2) | 3.1 | B | |
| Compound | (1) | 1.0 | G | Invention |
| 1 | (2) | 1.3 | G | |
| Compound | (1) | 0.7 | G | Invention |
| 2 | (2) | 0.9 | G | |
| Compound | (1) | 1.0 | G | Invention |
| 5 | (2) | 1.3 | G | |
| Compound | (1) | 0.7 | G | Invention |
| 6 | (2) | 1.0 | G | |

As is apparent from the results of Table 5, when the compounds of the present invention were used, excellent fixability was obtained and no precipitation was caused even by the processing of a large quantity of films, that is to say, excellent solution stability was achieved by the use of the compounds of the present invention. Additionally, the effects were more remarkable when replenishment was reduced in quantity.

EXAMPLE 10

After applying a black-and-white exposure to the photosensitive material prepared as in Example 3, the photosensitive material was continuous processed (running test) using a paper processor in accordance with the following procedure until the amount of the replenisher used for the bleach-fixing step became twice the volume of the tank used.

| Processing Step | Processing Steps Temperature (°C.) | Time (sec) | Amount* Replenished (ml) | Tank Volume (l) |
|---|---|---|---|---|
| Color Development | 39 | 45 | 70 | 20 |
| Bleach-Fixing | 35 | 45 | (1) 60**<br>or<br>(2) 30 | 20 |
| Rinsing (1) | 35 | 20 | — | 10 |
| Rinsing (2) | 35 | 20 | — | 10 |
| Rinsing (3) | 35 | 20 | 360 | 10 |
| Drying | 80 | 60 | — | — |

*: Replenished amount per $m^2$ of photosensitve material. (Three tank countercurrent system of Rinsing (3) to Rinsing (1) was employed.)
**: In addition to the aforesaid 60 ml of the bleach-fixing solution, 120 ml of the rinsing solution was flowed in from Rinsing (1), per $m^2$of photosensitive material.

The composition of each processing solution was as follows.

| Color Developing Solution | Tank Solution | Replenisher |
|---|---|---|
| Water | 700 ml | 700 ml |
| Diethylenetriaminetetraacetic Acid | 0.4 g | 0.4 g |
| N,N,N-Tetrakis(methylene-phosphonic acid) | 4.0 g | 4.0 g |
| 1,2-Dihydroxybenzene-4,6-disulfonic Acid Disodium Salt | 0.5 g | 0.5 g |
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Whitening Agent (WHITEX-4B, porduced by Sumitomo Chemical Company, Limited) | 1.0 g | 3.0 g |
| Sodium Sulfite | 0.1 g | 0.1 g |
| N,N-Bis(sulfoethyl)hydroxylamine | 10.0 g | 13.0 g |
| N-Ethyl-N-(β-methanesulfonamido-ethyl)-3-methyl-4-aminoaniline Sulfate | 5.0 g | 11.5 g |
| Water to make | 1 liter | 1 liter |
| pH (25° C.) | 10.10 | 11.10 |

| Bleach-Fixing Solution: | Tank | Replenisher | Replenisher |
|---|---|---|---|

-continued

| Solution | (1) | (2) |
|---|---|---|
| Water | 600 ml | 150 ml | 150 ml |
| Ammonium Thiosulfate (700 g/liter) | 100 ml | 250 ml | 250 ml |
| or the Compound of the Present Invention | 0.47 mol | 1.18 mol | 1.18 mol |
| Ammonium Sulfite* | 40 g | 100 g | 100 g |
| Ethylenediaminetetraacetic Acid Iron(III) Ammonium | 55 g | 135 g | 135 g |
| Ethylenediaminetetraacetic Acid | 5 g | 12.5 g | 12.5 g |
| Ammonium Bromide | 40 g | 75 g | 150 g |
| Nitric Acid (27 wt % aq. soln.) | 30 g | 65 g | 100 g |
| Water to make | 1,000 ml | 1,000 ml | 1,000 ml |
| pH (25° C.) adjusted by acetic acid or aqueous ammonium solution | 5.8 | 5.6 | 5.4 |

*In the case of using the fixing agent of the present invention, ammonium sulfite was omitted.

Rinsing Solution (Tank solution=Replenisher):

The ion exchange water (containing calcium and magnesium ion concentrations in which each was 3 ppm or less).

After finishing the running processing, the existence of precipitates in the bleach-fixing bath and the rinsing bath (1) was visually observed.

The evaluation was carried out in the same manner as in Example 3.

The results obtained are shown in Table 6.

TABLE 6

| Fixing Agent | Amount Replenished (bleach-fixing bath) | Presence or Absence of Precipitates in Bleach-Fixing Bath | Presence or Absence of Precipitates in Rinsing Bath (1) | Note |
|---|---|---|---|---|
| Ammonium Thiosulfate | (1) | M | B | Comparison |
| | (2) | B | BB | |
| Compound 1 | (1) | G | G | Invention |
| | (2) | G | G | |
| Compound 2 | (1) | G | G | Invention |
| | (2) | G | G | |
| Compound 5 | (1) | G | G | Invention |
| | (2) | G | G | |
| Compound 6 | (1) | G | G | Invention |
| | (2) | G | G | |
| Compound 9 | (1) | G | G | Invention |
| | (2) | G | G | |

As is apparent from the results of Table 6, when the compounds of the present invention were used in place of the thioulfate as a fixing agent, precipitations do not occur at running processing and the processing solution was excellent in stability. Also, the effect was particularly remarkable in the case of reducing the amount of the replenisher.

EXAMPLE 11

The same procedures as in Example 10 were repeated except that Compounds 4, 7, 25, and 28 were used, respectively, in place of Compound 1.

In the examples, the same good results that precipitates did not occur at running processing as in Example 10 were obtained.

The effect is particularly remarkable in the case of reducing the amount of the replenisher.

EXAMPLE 12

After applying a black-and-white exposure to the photosensitive material prepared as in Example 1, the photosensitive material was subjected to running processing using a small automatic processor according to the following processing procedure until the accumulated amount of the replenisher for the fixing solution became thrice the volume of the tank for the tank solution (i.e., the mother liquor).

| Processing Steps | | | | |
|---|---|---|---|---|
| Step | Time | Temperature (°C.) | Amount* Replenished (ml) | Tank Volume (l) |
| Color Development | 3 min 15 sec | 38 | 23 | 15 |
| Bleaching | 50 sec | 38 | 5 | 5 |
| Bleach-Fixing | 50 sec | 38 | — | 5 |
| Fixing | 50 sec | 38 | (1) 16 ml or (2) 12 ml | 5 |
| Washing (1) | 30 sec | 38 | — | 3 |
| Washing (2) | 20 sec | 38 | 34 | 3 |
| Stabilization | 20 sec | 38 | 20 | 3 |
| Drying | 1 min | 55 | — | — |

*Amount per 1 meter long of photosensitive material of 35 mm width.

The washing system is a countercurrent system of from washing (2) to washing (1) and the overflow solution of wash water was all introduced into the fixing bath. For the replenishment to the bleach-fixing bath, the upper portion of the bleaching tank of the automatic processor was connected to the bottom of the bleach-fixing tank thereof with a pipe, the upper portion of the fixing tank was connected to the bottom of the bleach-fixing tank with a pipe, and by supplying the replenishers to the bleaching tank and the fixing tank, respectively, all of the overflow solutions thus formed were introduced into the bleach-fixing tank. In addition, the carried amount of the developing agent into the bleaching step, the carried amount of the bleaching solution into the fixing step, and the carried amount of the fixing solution into the washing step were 2.5 ml, 2.0 ml, and 2.0 ml, respectively, per 1 m long of a photosensitive material having a width of 35 mm. Also, the time of the crossover in each case was 5 seconds and the times are included in the processing time of the foregoing processing steps.

Then, the composition of each processing solution is shown below.

| | Tank Solution | Replenisher |
|---|---|---|
| Color Developing Solution | | |
| Diethylenetriaminepentaacetic Acid | 2.0 g | 2.2 g |
| 1-Hydroxyethylidene-1,1-diphosphonic Acid | 3.3 g | 3.3 g |
| Sodium Sulfite | 3.9 g | 5.2 g |
| Potassium Carbonate | 37.5 g | 39.0 g |
| Potassium Bromide | 1.4 g | 0.4 g |
| Potassium Iodide | 1.3 mg | — |
| Hydroxylamine Sulfate | 2.4 g | 3.3 g |
| 2-Methyl-4-[N-ethyl-N-(β-hydroxyethyl)amino]aniline Sulfate | 4.5 g | 6.1 g |
| Water to make | 1 liter | 1 liter |
| pH | 10.05 | 10.15 |
| Bleaching Solution | | |
| 1,3-Propylenediaminetetraacetic Acid Ferric Ammonium | 144.0 g | 206.0 g |

-continued

| | Tank Solution | Replenisher |
|---|---|---|
| Monohydrate | | |
| Ammonium Bromide | 84.0 g | 120.0 g |
| Ammonium Nitrate | 17.5 g | 25.0 g |
| Hydroxyacetic Acid | 63.0 g | 90.0 g |
| Acetic Acid | 33.2 g | 47.4 g |
| Water to make | 1 liter | 1 liter |
| pH (adjusted with aqueous ammonia) | 3.20 | 2.80 |

Bleach-Fixing Tank Solution

A mixed solution of the foreging bleaching tank solution and the following fixing tank solution (ratio) of 15:85.

| | Tank Solution | Replenisher |
|---|---|---|
| Fixing Solution | | |
| Ammonium Sulfite | 19.0 g | 57.0 g |
| Aqueous Ammonium Thiosulfate Solution (700 g/liter) | 280 ml | 840 ml |
| or the Fixing Agent Shown in Table 7 Below | 1.3 mol | 4.0 mol |
| Imidazole | 28.5 g | 85.5 g |
| Ethylenediaminetetraacetic Acid | 12.5 g | 37.5 g |
| Water to make | 1 liter | 1 liter |
| pH (adjusted with aqueous ammonia or acetic acid) | 7.40 | 7.45 |

Washing Solution (Tank solution=Replenisher)

City water was passed through a column of a mixed-bed system in which an H-type strongly acid cation exchange resin (Amberlite IR-120B, produced by Rohm & Haas Co.) and an OH-type strongly basic anion exchange resin (Amberlite IRA-400, produced by Rohm & Haas Co.) were charged, to reduce calcium and magnesium ion concentrations 3 mg/liter or less and then 20 mg/liter of sodium dichloroisocyanurate and 150 mg/liter of sodium sulfate were added thereto. The pH of the solution was in the range of from 6.5 to 7.5.

| Stabilization Solution (Tank solution = Replenisher) | |
|---|---|
| Formalin (37 wt %) | 2.0 ml |
| Polyoxyethylene-p-monononylphenylether (mean polymerization degreeg: 10) | 0.3 g |

-continued

| Stabilization Solution (Tank solution = Replenisher) | |
|---|---|
| Ethylenediaminetetraacetic Acid Disodium Salt | 0.05 g |
| Water to make | 1 liter |
| pH | 5.0 to 8.0 |

After finishing running processing, the same samples for the running processing were processed.

Then, on each sample thus processed, the amount of residual silver in the unexposed area was measured using a fluorescent X-ray analyzer.

Also, the existence of precipitates in the fixing bath and the washing bath (1) were determined visually.

The evaluation was carried out in the same manner as in Example 3.

The results obtained are shown in Table 7.

TABLE 7

| Fixing Agent | Amount Replenished (fixing bath) | Residual Silver Amount ($\mu g/cm^2$) | Presence or Absence of Precipitates in Bleach-Fixing Bath | Presence or Absence of Precipitates in Washing Bath | Note |
|---|---|---|---|---|---|
| Ammonium Thiosulfate | (1) | 0.9 | M | M | Comparison |
| | (2) | 1.6 | B | B | |
| Compound 1 | (1) | 1.0 | G | G | Invention |
| | (2) | 1.3 | G | G | |
| Compound 2 | (1) | 0.9 | G | G | Invention |
| | (2) | 1.3 | G | G | |
| Compound 5 | (1) | 1.0 | G | G | Invention |
| | (2) | 1.4 | G | G | |
| Compound 6 | (1) | 0.9 | G | G | Invention |
| | (2) | 1.3 | G | G | |
| Compound 23 | (1) | 1.1 | G | G | Invention |
| | (2) | 1.5 | G | G | |
| Compound 26 | (1) | 1.3 | G | G | Invention |
| | (2) | 1.6 | G | G | |

As is apparent from the results of Table 7, in the case of using the compounds of the present invention, precipitations do not occur at running processing, the processing solution had, thus, a good stability, and also, the desilvering property was good. Thus, the fixing agents of the present invention were clearly superior to thiosulfates. Also, the effect is particularly remarkable in the case of reducing the amount of the replenisher.

EXAMPLE 13

The same procedures as in Example 12 were repeated except that Compounds 8, 11, 12, 16, 17, 18, 19, and 22 were used, respectively, in place of Compound 1. In the example, the same good results that the fixing ability was high and precipitations did not occur at running processing as in Example 12 were obtained. Also, the effect was particularly remarkable in the case of reducing the amount of the replenisher.

EXAMPLE 14

A sample as the multilayer color photographic material (Photosensitive Material 1) described in Example 1 of JP-A-2-93641 was prepared, cut into a width of 35 mm, and after applying thereto a black-and-white exposure, was processed according to the same processing procedure as in Example 12 and using the same processing solutions as in Example 12.

In the example, the same good results that the fixing property was good and precipitations did not occur at running processing as in Example 12 were obtained.

Also, the effect was particularly remarkable in the case of reducing the amount of the reprenisher.

EXAMPLE 15

The same procedures as in Example 14 were repeated except that Compounds 8, 11, 12, 16, 17, 18, 19, and 22 were, respectively, used in place of Compound 1. In the example, the same good results as in Example 14 were also obtained.

EXAMPLE 16

On a cellulose triacetate film support having a subbing layer were coated the layers having the compositions described below to provide a multilayer color photosensitive material.

As the coverages of ingredients of each constituent layer, those of silver halide emulsions and colloidal silver are expressed in g/m$^2$ based on silver, those of couplers, additives, and gelatin in g/m$^2$, and those of sensitizing dyes are expressed in mol per mol of the silver halide contained in the same layer.

| | |
|---|---|
| First Layer(antihalation layer) | |
| Black Colloidal Silver | 0.15 (as Ag) |
| Gelatin | 2.20 |
| UV-1 | 0.11 |
| UV-2 | 0.20 |
| Cpd-1 | $4.0 \times 10^{-2}$ |
| Cpd-2 | $1.9 \times 10^{-2}$ |
| Solv-1 | 0.30 |
| Solv-2 | $1.2 \times 10^{-2}$ |
| Second Layer (interlayer) | |
| Fine Grain Silver Iodobromide Emulsion (AgI: 1.0 mol %, sphere corresponding diameter: 0.07 μm) | 0.15 (as Ag) |
| Gelatin | 1.00 |
| ExC-4 | $6.0 \times 10^{-2}$ |
| Cpd-3 | $2.0 \times 10^{-2}$ |
| Third Layer (first red-sensitive emulsion layer) | |
| Silver Iodobromide Emulsion (AgI: 15.0 mol %; surface high AgI type; sphere corresponding diameter: 0.9 μm; variation coefficient of sphere corresponding diameters: 21%; tabular grains; diameter/thickness ratio: 7.5) | 0.42 (as Ag) |
| Silver Iodobromide Emulsion (AgI: 4.0 mol %; inside high AgI type; sphere corresponding diameter: 0.4 μm, variation coefficient of sphere corresponding diameters: 18%; tetradecahedral grains) | 0.40 (as Ag) |
| Gelatin | 1.90 |
| ExS-1 | $4.5 \times 10^{-4}$ |
| ExS-2 | $1.5 \times 10^{-4}$ |
| ExS-3 | $4.0 \times 10^{-5}$ |
| ExC-1 | 0.65 |
| ExC-3 | $1.0 \times 10^{-2}$ |
| ExC-4 | $2.3 \times 10^{-2}$ |
| Solv-1 | 0.32 |
| Fourth Layer (second red-sensitive emulsion layer) | |
| Silver Iodobromide Emulsion (AgI: 8.5 mol %; inside high AgI type; sphere corresponding diameter: 1.0 μm; variation coefficient of sphere corresponding diameters: 25%; tabular grains; diameter/thickness ratio: 3.0) | 0.85 (as Ag) |
| Gelatin | 0.91 |
| ExS-1 | $3.0 \times 10^{-4}$ |
| ExS-2 | $1.0 \times 10^{-4}$ |
| ExS-3 | $3.0 \times 10^{-5}$ |
| ExC-1 | 0.13 |
| ExC-2 | $6.2 \times 10^{-2}$ |
| ExC-4 | $4.0 \times 10^{-2}$ |
| Solv-1 | 0.10 |
| Fifth Layer (third red-sensitive emulsion layer) | |
| Silver Iodobromide Emulsion (AgI: 11.3 mol %; inside high AgI type; sphere corresponding diameter: 1.4 μm; variation coefficient of sphere corresponding diameters: 28%; tabular grains; diameter/thickness ratio: 6.0) | 1.50 (as Ag) |
| Gelatin | 1.20 |
| ExS-1 | $2.0 \times 10^{-4}$ |
| ExS-2 | $6.0 \times 10^{-5}$ |
| ExS-3 | $2.0 \times 10^{-5}$ |
| ExC-2 | $8.5 \times 10^{-2}$ |
| ExC-5 | $7.3 \times 10^{-2}$ |
| Solv-1 | 0.12 |
| Solv-2 | 0.12 |
| Sixth Layer (interlayer) | |
| Gelatin | 1.00 |
| Cpd-4 | $8.0 \times 10^{-2}$ |
| Solv-1 | $8.0 \times 10^{-2}$ |
| Seventh Layer (first green-sensitive emulsion layer) | |
| Silver Iodobromide Emulsion (AgI: 5.0 mol %; surface high AgI type; sphere corresponding diameter: 0.9 μm; variation coefficient of sphere corresponding diameters: 21%; tabular grains; diameter/thickness ratio: 7.0) | 0.28 (as Ag) |
| Silver Iodobromide Emulsion (AgI: 4.0 mol %; inside high AgI type; sphere corresponding diameter: 0.4 μm; variation coefficient of sphere corresponding diameters: 18%; tetradecahedral grains) | 0.16 (as Ag) |
| Gelatin | 1.20 |
| ExS-4 | $5.0 \times 10^{-4}$ |
| ExS-5 | $2.0 \times 10^{-4}$ |
| ExS-6 | $1.0 \times 10$ |
| ExM-1 | 0.50 |
| ExM-2 | 0.10 |
| Solv-1 | 0.20 |
| Solv-3 | $3.0 \times 10^{-2}$ |
| Eighth Layer (second green-sensitive emulsion layer) | |
| Silver Iodobromide Emulsion (AgI: 8.5 mol %; inside high AgI type; sphere corresponding diameter: 1.0 μm; variation coefficient of sphere corresponding diameters: 25%; tabular grains; diameter/thickness ratio: 3.0) | 0.57 (as Ag) |
| Gelatin | 0.45 |
| ExS-4 | $3.5 \times 10^{-4}$ |
| ExS-5 | $1.4 \times 10^{-3}$ |
| ExS-6 | $7.0 \times 10^{-5}$ |
| ExM-1 | 0.12 |
| ExM-2 | $7.1 \times 10^{-3}$ |
| ExM-3 | $3.5 \times 10^{-2}$ |
| Solv-1 | 0.15 |
| Solv-3 | $1.0 \times 10^{-2}$ |
| Ninth Layer (interlayer) | |
| Gelatin | 0.50 |
| Solv-1 | $2.0 \times 10^{-2}$ |
| Tenth Layer (third green-sensitive emulsion layer) | |
| Silver Iodobromide Emulsion (AgI: 11.3 mol %; inside high AgI type; sphere corresponding diameter: 1.4 μm; variation coefficient of sphere corresponding diameters: 28%; tabular grains; diameter/thickness ratio: 6.0) | 1.30 (as Ag) |
| Gelatin | 1.20 |
| ExS-4 | $2.0 \times 10^{-4}$ |
| ExS-5 | $8.0 \times 10^{-5}$ |
| ExS-6 | $8.0 \times 10^{-5}$ |
| ExM-4 | $4.5 \times 10^{-2}$ |
| ExM-6 | $1.0 \times 10^{-2}$ |
| ExC-2 | $4.5 \times 10^{-3}$ |
| Cpd-5 | $1.0 \times 10^{-2}$ |
| Solv-1 | 0.25 |
| Eleventh Layer (yellow filter layer) | |
| Gelatin | 0.50 |
| Cpd-6 | $5.2 \times 10^{-2}$ |
| Solv-1 | 0.12 |
| Twelfth Layer (interlayer) | |
| Gelatin | 0.45 |
| Cpd-3 | 0.10 |

-continued

| | |
|---|---|
| Thirteenth Layer (first blue-sensitive emulsion layer) | |
| Silver Iodobromide Emulsion (AgI: 12 mol %; uniform AgI type; sphere corresponding diameter: 0.55 μm; variation coefficient of sphere corresponding diameters: 25%; tabular grains; diameter/thickness ratio: 7.0) | 0.20 (as Ag) |
| Gelatin | 1.00 |
| ExS-7 | $3.0 \times 10^{-4}$ |
| ExY-1 | 0.60 |
| ExY-2 | $2.3 \times 10^{-2}$ |
| Solv-1 | 0.15 |
| Fourteenth-Layer (second blue-sensitive emulsion layer) | |
| Silver Iodobromide Emulsion (AgI: 19.0 mol %; inside high AgI type; sphere corresponding diameter: 1.0 μm; variation coefficient of sphere corresponding diameters: 16%; octahedral grains) | 0.19 (as Ag) |
| Gelatin | 0.35 |
| ExS-7 | $2.0 \times 10^{-4}$ |
| ExY-1 | 0.22 |
| Solv-1 | $7.0 \times 10^{-2}$ |
| Fifteenth Layer (interlayer) | |
| Fine Grain Silver Iodobromide Emulsion (AgI: 12 mol %; uniform AgI type; sphere corresponding diameter: 0.13 μm) | 0.20 (as Ag) |
| Gelatin | 0.36 |
| Sixteenth Layer (third blue-sensitive layer) | |
| Silver Iodobromide Emulsion (AgI: 14.0 mol %; inside high AgI type; sphere corresponding diameter: 1.7 μm; variation coefficient of sphere corresponding diameters: 28%; tabular grains; diameter/thickness ratio: 5.0) | 1.55 (as Ag) |
| Gelatin | 1.00 |
| ExS-8 | $1.5 \times 10^{-4}$ |
| ExY-1 | 0.21 |
| Solv-1 | $7.0 \times 10^{-2}$ |
| Seventeenth-Layer (first protective layer) | |
| Gelatin | 1.80 |
| UV-1 | 0.13 |
| UV-2 | 0.21 |
| Solv-1 | $1.0 \times 10^{-2}$ |
| Solv-2 | $1.0 \times 10^{-2}$ |
| Eighteenth Layer (second protective layer) | |
| Fine Grain Silver Chloride Emulsion (sphere corresponding diameter: 0.07 μm) | 0.36 (as Ag) |
| Gelatin | 0.70 |
| B-1 (diameter: 1.5 μm) | $2.0 \times 10^{-2}$ |
| B-2 (diameter: 1.5 μm) | 0.15 |
| B-3 | $3.0 \times 10^{-2}$ |
| W-1 | $2.0 \times 10^{-2}$ |
| H-1 | 0.35 |
| Cpd-7 | 1.00 |

The sample thus prepared further contained 1,2-benzoisothiazolin-3-one (200 ppm on average to gelatin), n-butyl-p-hydroxybenzoate (about 1,000 ppm to gelatin), and 2-phenoxyethanol (about 10,000 ppm to gelatin).

Furthermore, the samples further contained Compounds B-4, B-5, W-2, W-3, F-1, F-2, F-3, F-4, F-5, F-6, F-7, F-8, F-9, F-10, F-11, F-12, and F-13 and also an iron salt, a lead salt, a gold salt, a platinum salt, an iridium salt, and a rhodium salt.

The compounds used for preparing the foregoing sample were as follows.

UV-1

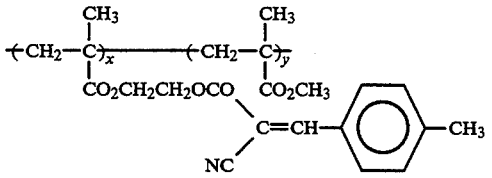

x/y = 7/3 (by weight)

UV-2

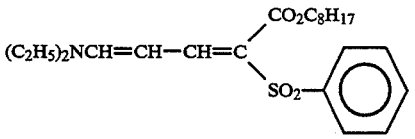

ExC-1

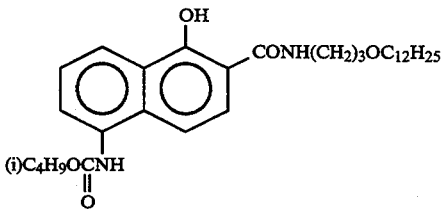

ExC-2

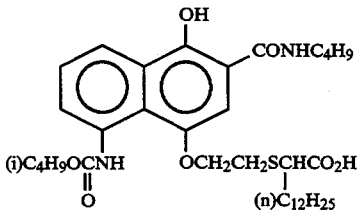

-continued
ExC-3
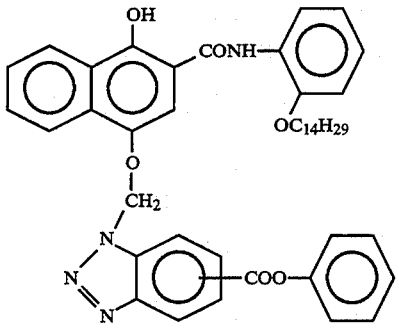
ExC-4
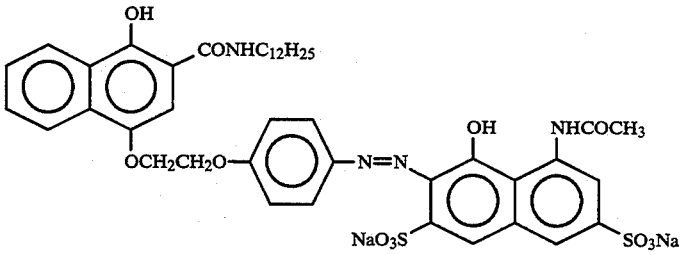
ExC-5
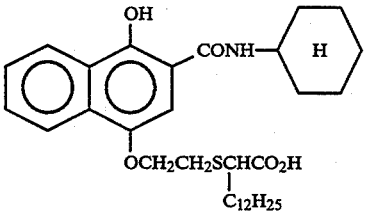
ExM-1
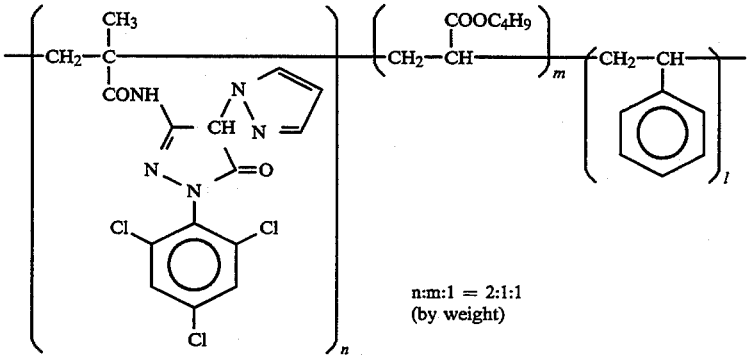
n:m:1 = 2:1:1
(by weight)
Average molecular weight:
20,000
ExM-2
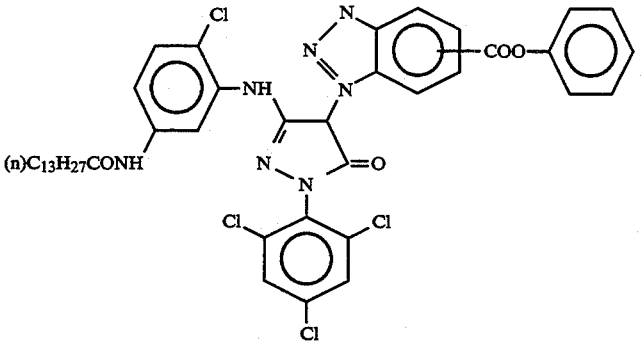

-continued
ExM-3
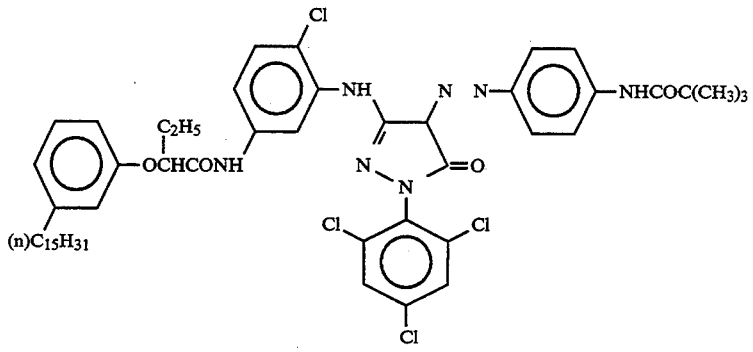
ExM-4
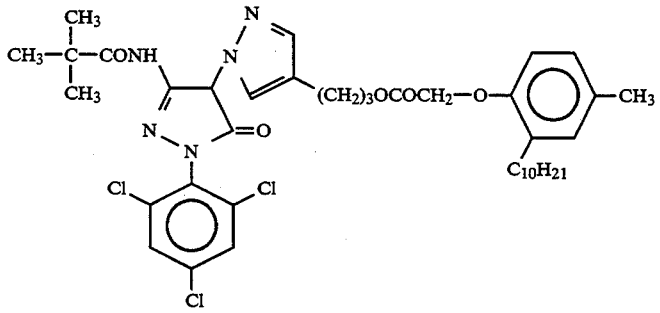
ExM-5
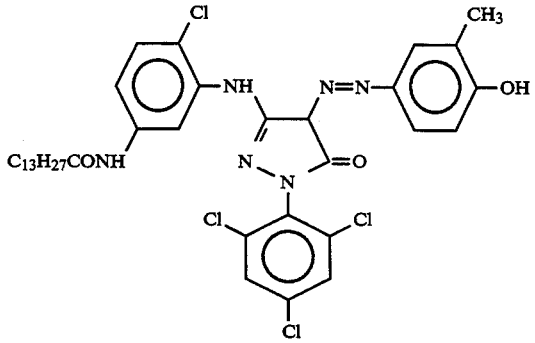
ExM-6
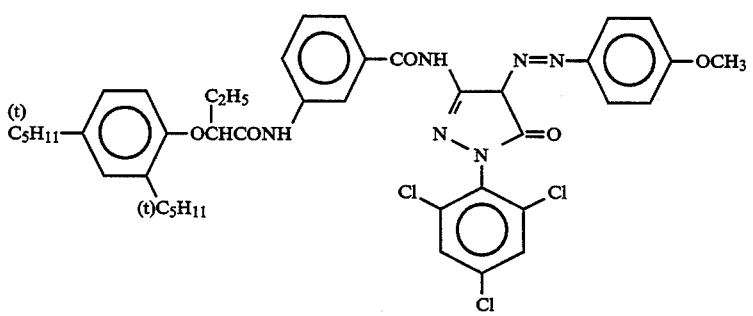
ExY-1
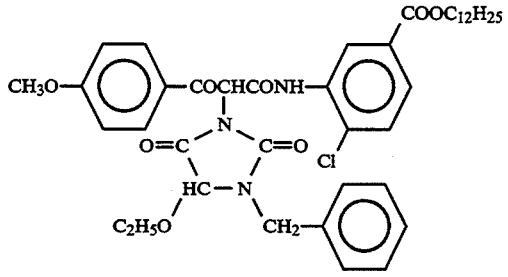

-continued
ExY-2
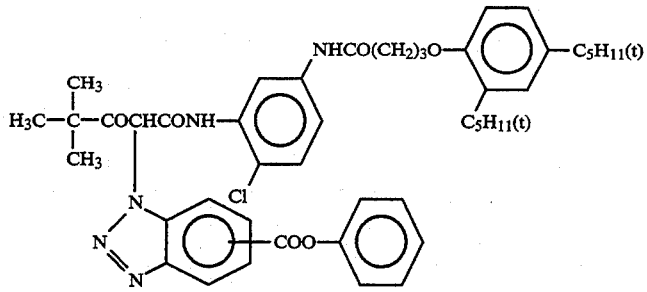
Cpd-1
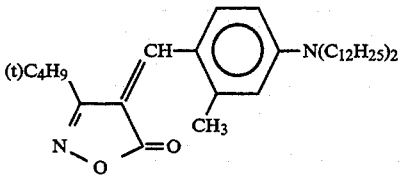
Cpd-2
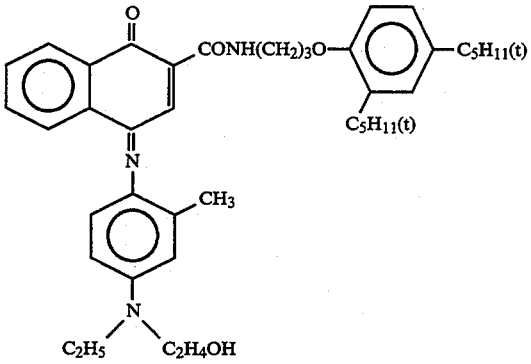
Cpd-3
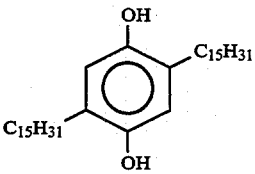
Cpd-4
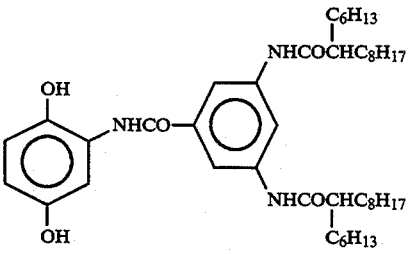
Cpd-5
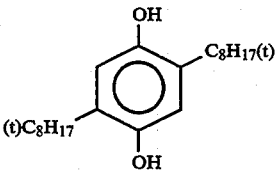
Cpd-6
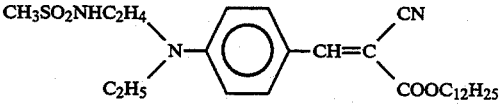

-continued
Cpd-7
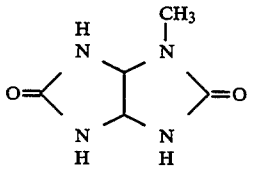
Solv-1
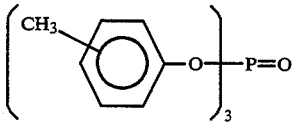
Solv-2
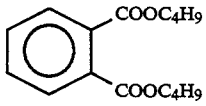
Solv-3
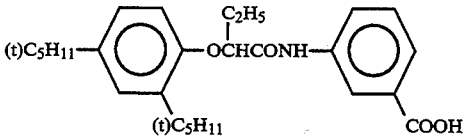
ExS-1
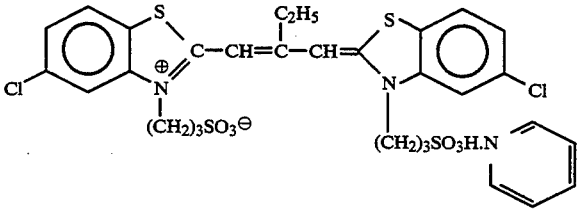
ExS-2
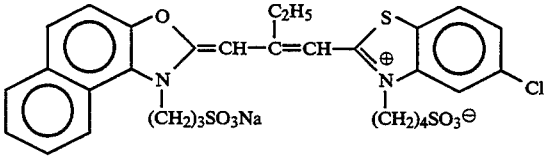
ExS-3
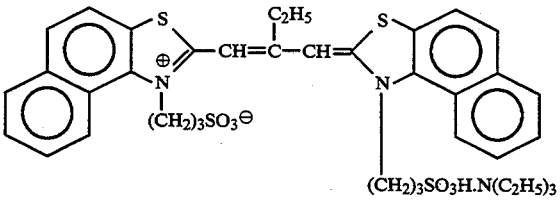
ExS-4
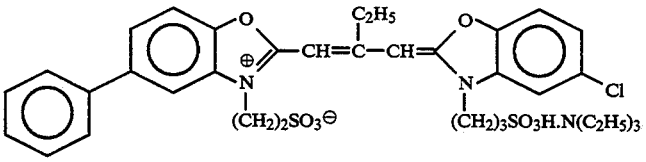
ExS-5
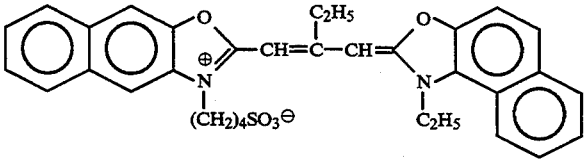

-continued
ExS-6
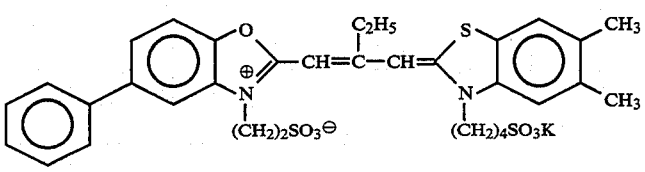
ExS-7
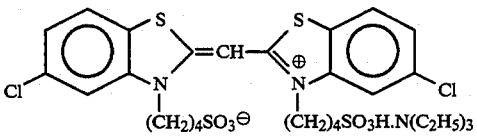
ExS-8
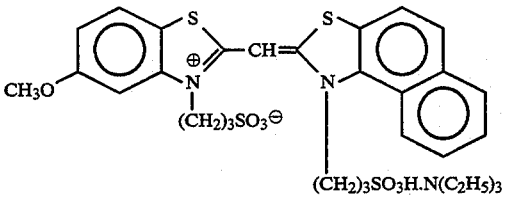
B-1
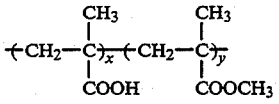
x/y = 10/90 (by weight)
B-2
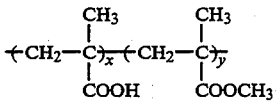
x/y = 40/60 (by weight)
B-3
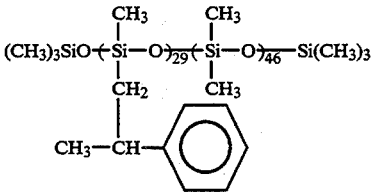
B-4
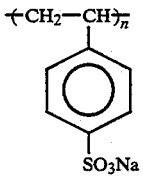
B-5
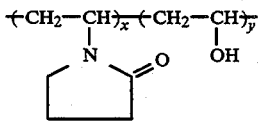
x/y = 70/30 (by weight)
W-1
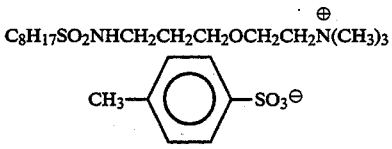
W-2
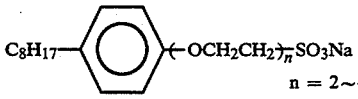
n = 2~4

-continued
W-3
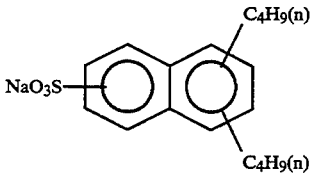
H-1
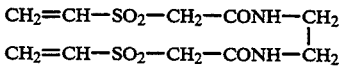
F-1
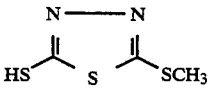
F-2
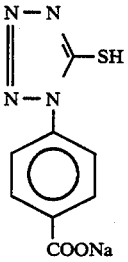
F-3
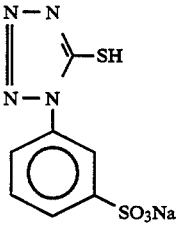
F-4
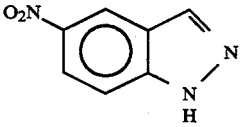
F-5
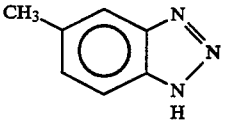
F-6
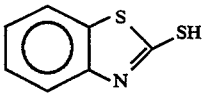
F-7
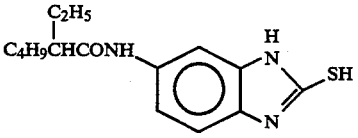
F-8
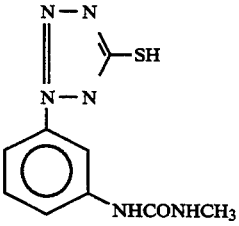

-continued

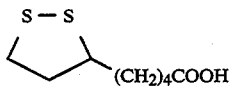

F-9

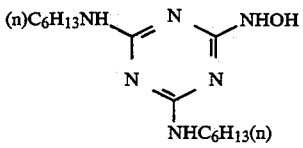

F-10

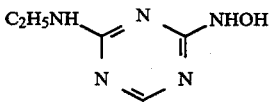

F-11

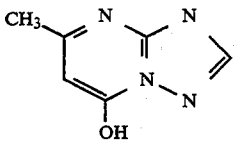

F-12

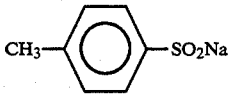

F-13

The sample prepared was cut into a width of 35 mm and after applying thereto a black-and-white exposure, the sample was processed according to the same processing procedure as in Example 12 and using the same processing solutions as in Example 12.

In this example, good results that the fixing property was good and precipitations did not occur at running were obtained. Also, the effect was particularly remarkable in the case of reducing the amount of the replenisher.

EXAMPLE 17

The same procedures as in Example 14 were prepared except that Compounds 8, 11, 12, 15, 16, 18, 19, 20, and 22 were, respectively, used in place of Compound 1. Thus, the same good results as in Example 14 were obtained.

EXAMPLE 18

The same procedure as Example 12 was repeated except that a color negative film, REALA (trade name, made by Fuji Photo Film Co., Ltd., Emulsion No. 803025) in place of the sample in Example 12. Also, the same procedures as in Example 12 were repeated except that Compounds 2, 8, and 11 were, respectvely, used in place of Compound 1.

In the example, the same good results that the fixing porperty was good and precipitations did not occur at running processing as in Example 12 were obtained. The effect was also particularly remarkable in the case of reducing the amount of the replenisher.

EXAMPLE 19

In the example, following processing was carried out.

Processing Procedure

| Preparation of Concentrated Solutions | |
|---|---|
| (Developing Solution) | |
| Part A: | |

-continued

| Preparation of Concentrated Solutions | |
|---|---|
| Potassium Hydroxide | 330 g |
| Potassium Sulfite | 630 g |
| Sodium Sulfite | 240 g |
| Potassium Carbonate | 90 g |
| Boric Acid | 45 g |
| Diethylene Glycol | 180 g |
| Diethylenetriaminepentaacetic Acid | 30 g |
| 1-(Diethylaminoethyl)-5-mercaptotetrazole | 0.75 g |
| Hydroquinone | 450 g |
| Water to make | 4,125 ml |
| Part B: | |
| Diethylene Glycol | 525 g |
| Glacial Acetic Acid | 102.6 g |
| 5-Nitroindazole | 3.75 g |
| 1-Phenyl-3-pyrazolidone | 34.5 g |
| Water to make | 750 ml |
| Part C: | |
| Glutaraldehyde (50 wt/wt %) | 150 g |
| Potassium Metahydrogensulfite | 150 g |
| Potassium Bromide | 15 g |
| Water to make | 750 ml |
| (Fixing Solution) | |
| Ammonium Thiosulfate (70 wt/vol %) | 200 ml |
| or | |
| The Compound of the Present Invention | 1 mol |
| Ethylenediaminetetraacetic Acid .Disodium Dihydrate | 0.03 g |
| Sodium Thiosulfate.pentahydrate (not used in the case of using the compound of the present invention) | 10 g |
| Sodium Sulfite | 20 g |
| Boric Acid | 4 g |
| 1-(N,N-Dimethylamino)-ethyl-5-mercaptotetrazole | 1 g |
| Tartaric Acid | 3.2 g |
| Glacial Acetic Acid | 45 g |
| Sodium Hydroxide | 15 g |
| Sulfuric Acid (36 N) | 3.9 g |
| Aluminum Sulfate | 10 g |
| Water to make | 400 ml |
| pH | 4.68 |

Each part of the concentrated developing solution described above was filled in each polyethylene container. A container for the concentrated developing solution was composed of the containers for Part A, Part B, and Part C, respectively.

Also, the foregoing concentrated fixing solution was filled in a polyethylene container.

After preparing the foregoing concentrated developing solution, the solution was stored for 3 months in the containers at a temperature of 50° C. and thereafter, the solution was supplied for the preparing of the developing solution.

These concentrated developing solution and fixing solution were filled in the developing tank and the fixing tank, respectively, of an autoamtic processor using the replenishment pumps equipped to the automatic processor.

| | |
|---|---|
| Developing Solution I: | |
| Component A (Part A) | 55 ml |
| Component B (Part B) | 10 ml |
| Component C (Part C) | 10 ml |
| Water | 125 ml |
| pH | 10.50 |
| Fixing Solution: | |
| Concentrated Fixing Solution | 80 ml |
| Water | 120 ml |
| pH | 4.65 |

City water was filled in a washing tank and 4 bags of a nonwoven cloth each containing 50 g of a silver slowly releasing agent of a dissoluble glass composed of $Na_2O/B_2O_5/SiO_2$ (10/65/25 by weight ratio) and containing 1.7% by weight of $Ag_2O$ were sank in the tank.

Constitution of the Automatic Processor

The automatic processor having the following constitution was used.

| | Liquid Amount in Tank (l) | Processing Temperature (°C.) | Processing Pass Length (mm) | Process (1) Step Time (sec) | Process (2) Step Time (sec) |
|---|---|---|---|---|---|
| Development | 15 | 35* 32** | 613 | 13.3 | 24.5 |
| | (liquid surface area/tank volume = 35 $cm^2$/liter) | | | | |
| Fixing | 15 | 32 | 541 | 11.7 | 21.6 |
| Washing | 13 | 17 running water | 305 | 5.7 | 10.5 |
| Squeegee | — | | | 6.6 | 12.2 |

-continued

| | Liquid Amount in Tank (l) | Processing Temperature (°C.) | Processing Pass Length (mm) | Process (1) Step Time (sec) | Process (2) Step Time (sec) |
|---|---|---|---|---|---|
| Drying | — | 58 | 368 | 8.0 | 14.7 |
| Total | — | — | 1,827 | 45.3 | 83.6 |

*Processing (1)
**Processing (2)

Processing

An X-ray photographic film described in Example 2 of Japanese Patent Application No. 1-239278 (which is incorporated by reference) was prepared as photosensitive material A and after applying thereto an X-ray exposure of 50%, the photosensitive material was processed using the foregoing automatic processor and each processing solution prepared by mixing at the ratios described above while replenishing 45 ml of the developing solution and 30 ml of the fixing solution per one photosensitive material (10 inch×12 inch).

The flow rate of washing water was 5 liters/min in Process(2) and 1.0 liter/min in Process(1), the washing water was supplied (about 1 liter per one photosensitive material of 10 inch×12 inch) by opening an electromagnetic valve synchronized with the time of processing the photosensitive material, and at finishing the work of one day, an electromagentic valve automatically opened to remove whole water in the tank. Also, to the crossover rollers between the development and fixing and between the fixing and washing were equipped the means of washing the rollers by automatically applying thereto washing water as described in JP-A-62-287252.

The test is called Test 1.

In Test 1, the kind of the photosensitive material, the processing steps, and the replenishing amount of the fixing solution were changed as shown in Table 8 and the photosensitive materials (10 inch×12 inch) were subjected to running processing under each condition until the accumulated amount of the replenisher for the fixing solution became thrice the tank volume.

After finishing running processing, the samples as used for running processing were processed.

On each of the samples thus processed, residual silver in the unexposed area was measured using a fluorescent X-ray analyzer. Also, the existence of precipitates in the fixing bath was visually determined.

The evaluation was carried out in the same manner as in Example 3.

The results obtained are shown in Table 8.

TABLE 8

| Fixing Agent | Developing Solution Component | Processing Steps | Amount Replenished (fixing bath) (per 10 inch × 12 inch (ml) | Residual Silver Amount ($\mu g/cm^2$) | Presence or Absence of Precipitates in Fixing Bath | Note |
|---|---|---|---|---|---|---|
| Ammonium Thiosulfate | A | (1) | 30 | 1.1 | M | Comparison |
| Ammonium Thiosulfate | A | (1) | 20 | 1.6 | B | " |
| Ammonium Thiosulfate | A | (2) | 30 | 1.0 | M | " |
| Ammonium Thiosulfate | A | (2) | 20 | 1.5 | B | " |
| Ammonium Thiosulfate | B | (2) | 30 | 0.9 | M | " |
| Ammonium Thiosulfate | B | (2) | 20 | 1.4 | B | " |

TABLE 8-continued

| Fixing Agent | Developing Solution Component | Processing Steps | Amount Replenished (fixing bath) (per 10 inch × 12 inch (ml) | Residual Silver Amount ($\mu g/cm^2$) | Presence or Absence of Precipitates in Fixing Bath | Note |
|---|---|---|---|---|---|---|
| Compound 1 | A | (1) | 30 | 1.2 | G | Invention |
| " | A | (1) | 20 | 1.4 | G | " |
| " | A | (2) | 30 | 1.1 | G | " |
| " | A | (2) | 20 | 1.3 | G | " |
| " | B | (2) | 30 | 1.1 | G | " |
| " | B | (2) | 20 | 1.4 | G | " |
| Compound 2 | A | (1) | 30 | 1.1 | G | Invention |
| " | A | (1) | 20 | 1.4 | G | " |
| " | A | (2) | 30 | 1.1 | G | " |
| " | A | (2) | 20 | 1.4 | G | " |
| " | B | (2) | 30 | 1.0 | G | " |
| " | B | (2) | 20 | 1.2 | G | " |

As is apparent from the results of Table 8, in the case of using the compounds of the present invention, precipitates do not occur at running processing, the fixing solution shows good stability, and the fixing property is also good. Thus, the compounds of the present invention are clearly superior to thiosulfates.

EXAMPLE 20

The same procedures as in Example 19 were repeated except that Compounds 8, 11, 15, 17 and 19 were, respectively, used in place of Compound 1. In the example, by using the compounds of the present invention, the same good results as in Example 19 were obtained.

While the invention has been described in detail and with reference to specific embodiments thereof, it will be apparent to one skilled in the art that various changes and modifications can be made therein without departing from the spirit and scope thereof.

What is claimed is:

1. A method for processing an exposed silver halide photographic material comprising a support having thereon at least one light-sensitive silver halide emulsion layer, said method comprising the steps of: (a) developing with a developing solution, and then (b) processing said material with a composition having a fixing ability, said composition being substantially free of thiosulfate ion and comprising as a fixing agent at least one thioether compound represented by Formula (I):

$$L_1—(A—L_2)_n—B—L_3 \quad (I)$$

wherein $L_1$ and $L_3$ each represents an alkyl group; $L_2$ represents an alkylene group, an arylene group, an aralkylene group, a heterocyclic linkage group or a linkage group formed by combining two or more of the above cited groups; A and B each represents —S—; and n represents an integer of from 1 to 10; wherein at least one of $L_1$ and $L_3$ is substituted by $—SO_3M_1$ or $—PO_3M_2M_3$, wherein $M_1$, $M_2$ and $M_3$ may be the same or different, each represents a hydrogen atom or a counter cation.

2. A method for processing an exposed silver halide photographic material comprising a support having thereon at least one light-sensitive silver halide emulsion layer comprising bromoiodide having an iodide content of 1 mol % or more, said method comprising the steps of: (a) developing with a developing solution, and then (b) processing said material with a composition having a fixing ability, said composition being substantially free of thiosulfate ion and comprising as a fixing agent at least one thioether compound represented by Formula (I):

$$L_1—(A—L_2)_n—B—L_3 \quad (I)$$

wherein $L_1$ and $L_3$ each represents an alkyl group; $L_2$ represents an alkylene group, an arylene group, an aralkylene group, a heterocyclic linkage group or a linkage group formed by combining two or more of the above cited groups; A and B each represents —S—; and n represents an integer of from 1 to 10; wherein at least one of $L_1$ and $L_3$ is substituted by $—SO_3M_1$ or $—PO_3M_2M_3$, wherein $M_1$, $M_2$ and $M_3$ may be the same or different, each represents a hydrogen atom or a counter cation; and wherein said thioether compound is present in an amount of 0.5 to 2.0 mol/liter.

3. A method for processing an exposed silver halide photographic material comprising a support having thereon at least one light-sensitive silver halide emulsion layer comprising bromide, chlorobromide, or a halide having a chloride content of 80 mol % or more, said method comprising the steps of: (a) developing with a developing solution, and then (b) processing said material with a composition having a fixing ability, said composition being substantially free of thiosulfate ion and comprising as a fixing agent at least one thioether compound represented by Formula (I):

$$L_1—(A—L_2)_n—B—L_3 \quad (I)$$

wherein $L_1$ and $L_3$ each represents an alkyl group; $L_2$ represents an alkylene group, an arylene group, an aralkylene group, a heterocyclic linkage group or a linkage group formed by combining two or more of the above cited groups; A and B each represents —S—; and n represents an integer of from 1 to 10; wherein at least one of $L_1$ and $L_3$ is substituted by $—SO_3M_1$ or $—PO_3M_2M_3$, wherein $M_1$, $M_2$ and $M_3$ may be the same or different, each represents a hydrogen atom or a counter cation; and wherein said thioether compound is present in an amount of 0.1 to 1 mol/liter.

4. The method as in claim 1, 2 or 3 wherein said thioether compound is present in an amount of $1\times10^{-5}$ to 10 mol/liter.

5. The method as in claims 1, 2 or 3 wherein $L_1$ is an alkyl group.

6. The method as in claims 1, 2 or 3, wherein at least one of $L_1$ and $L_3$ represents an alkyl group having 1 to 6 carbon atoms substituted by $—SO_3M_1$ or $—PO_3M_2M_3$, $L_2$ represents an alkylene group having 1 to 6 carbon atoms; and n represents an integer of 1 to 6.

* * * * *